US012571150B2

(12) United States Patent
Lee et al.

(10) Patent No.: US 12,571,150 B2
(45) Date of Patent: Mar. 10, 2026

(54) CLOTHES CARE APPARATUS AND METHOD FOR CONTROLLING CLOTHES CARE APPARATUS

(71) Applicant: SAMSUNG ELECTRONICS CO., LTD., Suwon-si (KR)

(72) Inventors: Myungwoo Lee, Suwon-si (KR); Jaeryong Park, Suwon-si (KR); Younghak Kong, Suwon-si (KR); Byeongcheol Yoon, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 92 days.

(21) Appl. No.: 18/743,103

(22) Filed: Jun. 14, 2024

(65) Prior Publication Data

US 2025/0066976 A1 Feb. 27, 2025

Related U.S. Application Data

(63) Continuation of application No. PCT/KR2024/007478, filed on May 31, 2024.

(30) Foreign Application Priority Data

Aug. 25, 2023 (KR) ..... 10-2023-0112168
Oct. 19, 2023 (KR) ..... 10-2023-0140718

(51) Int. Cl.
*D06F 34/18* (2020.01)
*D06F 33/36* (2020.01)
(Continued)

(52) U.S. Cl.
CPC ..... *D06F 34/18* (2020.02); *D06F 33/36* (2020.02); *D06F 34/04* (2020.02); *D06F 34/20* (2020.02);
(Continued)

(58) Field of Classification Search
CPC ..... D06F 34/18
See application file for complete search history.

(56) References Cited

U.S. PATENT DOCUMENTS 8,850,855 B2 10/2014 Kim et al.
11,242,647 B2 2/2022 Kim et al.
(Continued)

FOREIGN PATENT DOCUMENTS

CN 105063951 B 7/2017
CN 209741521 U 12/2019
(Continued)

OTHER PUBLICATIONS

Written Opinion and International Search Report mailed Sep. 27, 2024 for PCT/KR2024/007478.

*Primary Examiner* — Jason Y Ko
(74) *Attorney, Agent, or Firm* — CANTOR COLBURN LLP

(57) ABSTRACT

A clothes care apparatus includes a cabinet, where a first chamber is defined in the cabinet; a first door configured to open or close the first chamber, where a second chamber separated from the first chamber and configured to accommodate a garment is defined in the first door; a second door pivotally coupled to the first door and configured to open or close the second chamber; a switchable mirror arranged on the second door and operable in a mirror mode or a transparent mode; a spot cleaning device arranged in the second chamber to partially clean the garment accommodated in the second chamber, and movable in the second chamber; and a controller configured to control the switchable mirror and the spot cleaning device.

20 Claims, 37 Drawing Sheets

(51) Int. Cl.

| | |
|---|---|
| ***D06F 34/04*** | (2020.01) |
| ***D06F 34/20*** | (2020.01) |
| ***D06F 34/32*** | (2020.01) |
| ***D06F 35/00*** | (2006.01) |
| ***D06F 39/14*** | (2006.01) |
| *D06F 19/00* | (2006.01) |
| *D06F 103/02* | (2020.01) |
| *D06F 103/40* | (2020.01) |
| *D06F 105/58* | (2020.01) |

(52) U.S. Cl.
CPC ..... *D06F 34/32* (2020.02); *D06F 35/00* (2013.01); *D06F 39/14* (2013.01); *D06F 19/00* (2013.01); *D06F 2103/02* (2020.02); *D06F 2103/40* (2020.02); *D06F 2105/58* (2020.02)

(56) References Cited

U.S. PATENT DOCUMENTS

| | | | |
|---|---|---|---|
| 11,460,817 | B2 | 10/2022 | Kim et al. |
| 11,624,148 | B2 | 4/2023 | Kim et al. |
| 11,634,849 | B2 | 4/2023 | Park et al. |
| 2020/0116627 | A1 | 4/2020 | Kessler et al. |
| 2023/0151535 | A1 | 5/2023 | Kim et al. |

FOREIGN PATENT DOCUMENTS

| | | | |
|---|---|---|---|
| CN | 108823901 | B | 8/2020 |
| CN | 212404575 | U | 1/2021 |
| CN | 217710012 | U | 11/2022 |
| JP | 2023067004 | A | 5/2023 |
| KR | 20180126838 | A | 11/2018 |
| KR | 20190084915 | A | 7/2019 |
| KR | 20190139400 | A | 12/2019 |
| KR | 20210059532 | A | 5/2021 |
| KR | 20230066179 | A | 5/2023 |

CLOTHES CARE APPARATUS AND METHOD FOR CONTROLLING CLOTHES CARE APPARATUS

This application is a continuation application, under 35 U.S.C. § 111 (a), of international application No. PCT/KR2024/007478, filed on May 31, 2024, which claims priority to Korean Patent Application Nos. 10-2023-0112168, filed on Aug. 25, 2023 and 10-2023-0140718, filed on Oct. 19, 2023, in the Korean Intellectual Property Office, the disclosure of which is incorporated by reference herein in its entirety.

BACKGROUND

1. Field

The disclosure relates to a clothes care apparatus including a spot cleaning device and a method of controlling the clothes care apparatus.

2. Description of the Related Art

A clothes care apparatus is a device for performing garment care such as drying wet clothes, removing dust or odors from clothes, reducing wrinkles from clothes, etc.

The clothes care device may include a hot air supplier for supplying hot air into a care room to dry the clothes, and a steam generator for performing refresh functions such as unwrinkling of the clothes, deodorizing, removing static electricity from the clothes, putting a scent, etc.

SUMMARY

According to an embodiment of the disclosure, a user may easily set up a target portion for a spot cleaning device through a switchable mirror.

According to an embodiment of the disclosure, a user may easily set up a target portion for a spot cleaning device through a control panel.

According to an embodiment of the disclosure, a spot cleaning device may automatically set up a target portion, thereby increasing user convenience.

According to an embodiment of the disclosure, the user may set up a target portion remotely.

According to an embodiment of the disclosure, a clothes care apparatus includes a cabinet, where a first chamber is defined in the cabinet; a first door configured to open or close the first chamber, where a second chamber separated from the first chamber and configured to accommodate a garment is defined in the first door; a second door pivotally coupled to the first door and configured to open or close the second chamber; a switchable mirror arranged on the second door and operable in a mirror mode or a transparent mode; a spot cleaning device arranged in the second chamber to partially clean the garment accommodated in the second chamber and movable in the second chamber; and a controller configured to control the switchable mirror and the spot cleaning device.

According to an embodiment of the disclosure, a method of controlling a clothes care apparatus including a cabinet; a first chamber formed in the cabinet; a first door configured to open or close the first chamber and having a second chamber separated from the first chamber and configured to accommodate a garment; a second door pivotally coupled to the first door and configured to open or close the second chamber; a switchable mirror arranged on the second door and operable in a mirror mode or a transparent mode; and a spot cleaning device arranged in the second chamber to partially clean the garment accommodated in the second chamber and movable in the second chamber includes controlling the switchable mirror and the spot cleaning device.

According to an embodiment of the disclosure, a user may easily set up a target portion for a spot cleaning device through a switchable mirror.

According to an embodiment of the disclosure, a user may easily set up a target portion for a spot cleaning device through a control panel.

According to an embodiment of the disclosure, a spot cleaning device may automatically set up a target portion, thereby increasing user convenience.

According to an embodiment of the disclosure, a user may set up a target portion remotely.

The effects according to the disclosure are not limited thereto, and throughout the specification it will be clearly appreciated by those of ordinary skill in the art that there may be other effects unmentioned.

DETAILED DESCRIPTION OF THE DRAWINGS

DETAILED DESCRIPTION

Figure 1:
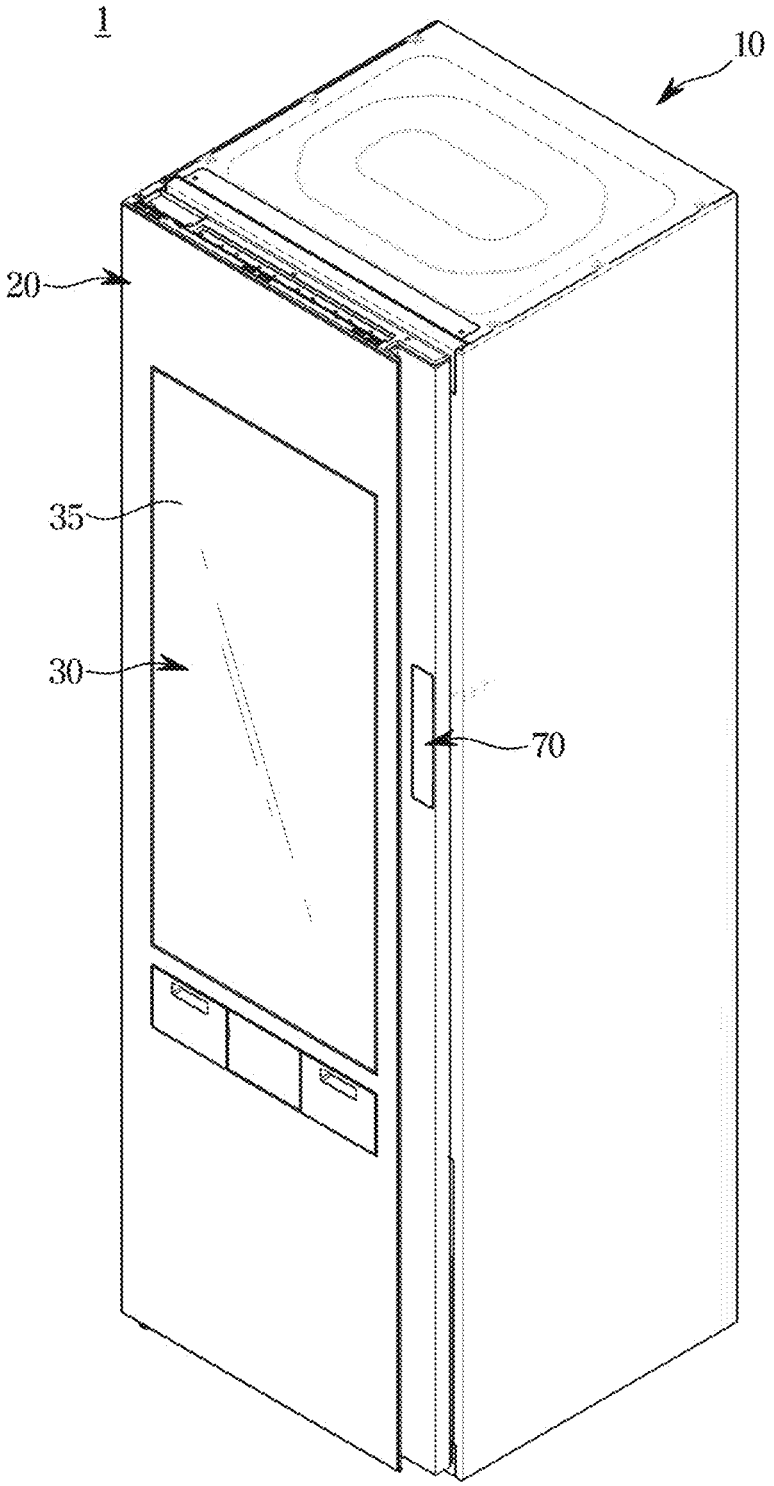
FIG. 1 is a perspective view of a clothes care apparatus, according to an embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

Like reference numerals may be used for like or related elements throughout the drawings.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. Thus, reference to "an" element in a claim followed by reference to "the" element is inclusive of one element and a plurality of the elements. For example, "an element" has the same meaning as "at least one element," unless the context clearly indicates otherwise. "At least one" is not to be construed as limiting "a" or "an.".

Throughout the specification, "A or B", "at least one of A and B", "at least one of A or B", "A, B or C", "at least one selected from A, B and C", and "at least one of A, B, or C" may each include any one or all the possible combinations of A, B and C.

"Or" means "and/or." As used herein, the term "and/or" includes any and all combinations of one or more of the associated listed items.

Terms like "first", "second", etc., may be simply used to distinguish an element from another, without limiting the elements in a certain sense (e.g., in terms of importance or order).

When an element is mentioned as being "coupled" or "connected" to another element with or without an adverb "functionally" or "operatively", it means that the element may be connected to the other element directly (e.g., wiredly), wirelessly, or through a third element.

It will be further understood that the terms "comprise" and/or "comprising," or "includes" and/or "including" when used in this specification, specify the presence of stated features, integers, steps, operations, elements, parts or combinations thereof, but do not preclude the possible presence or addition of one or more other features, integers, steps, operations, elements, components, and/or groups thereof.

When an element is mentioned as being "connected to", "coupled to", "supported on" or "contacting" another element, it includes not only a case that the elements are directly connected to, coupled to, supported on or contact each other but also a case that the elements are connected to, coupled to, supported on or contact each other through a third element.

Throughout the specification, when an element is mentioned as being located "on" another element, it implies not only that the element is abut on the other element but also that a third element exists between the two elements.

The terms "forward or front", "rearward or behind", "left", "right", "up (upward)" and "down (downward)" as herein used are defined with respect to the drawings, but the terms may not restrict the shapes and position of the respective components.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2:
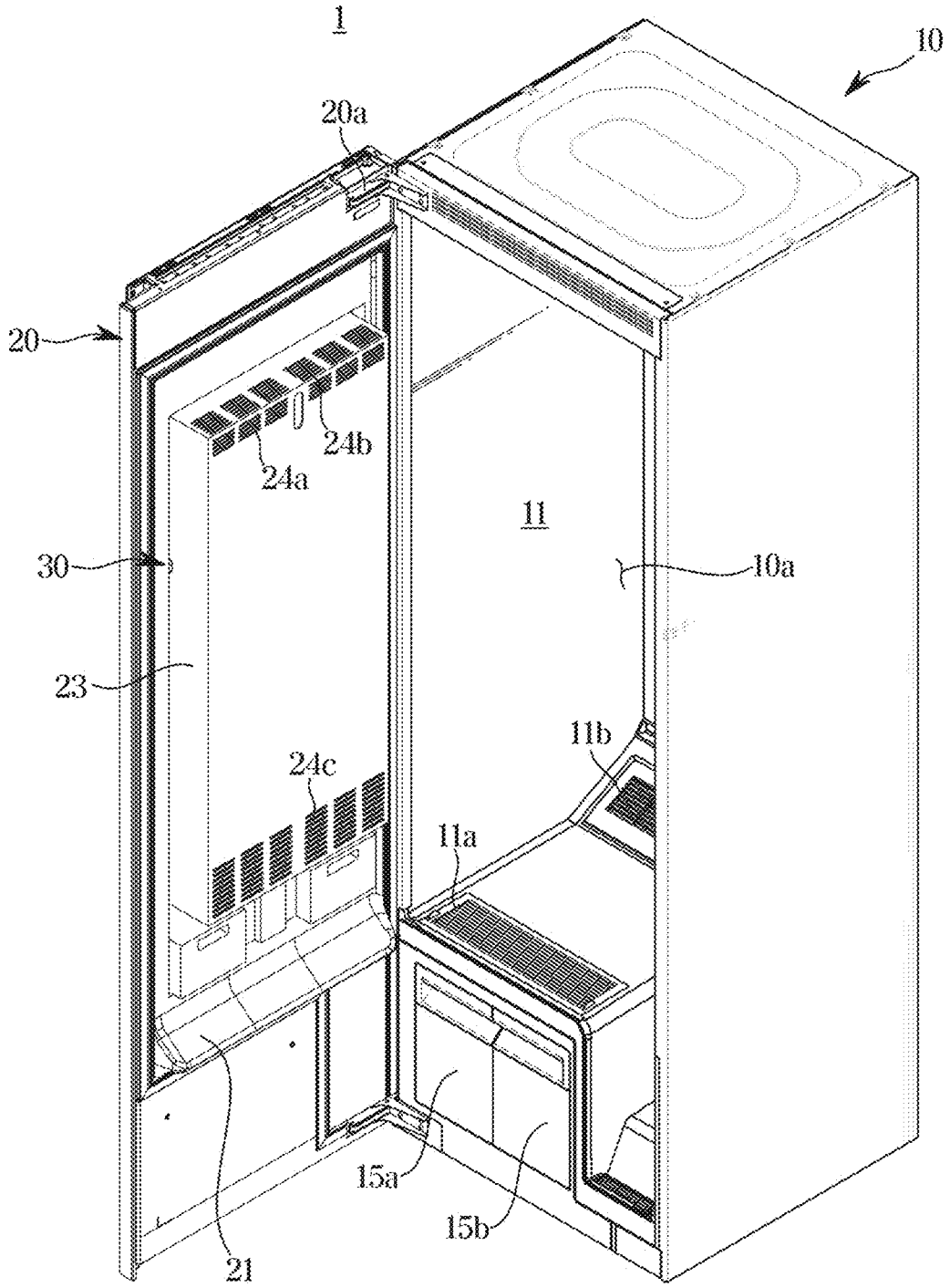
FIG. 2 illustrates a clothes care apparatus with a first door opened, according to an embodiment.
Figure 3:
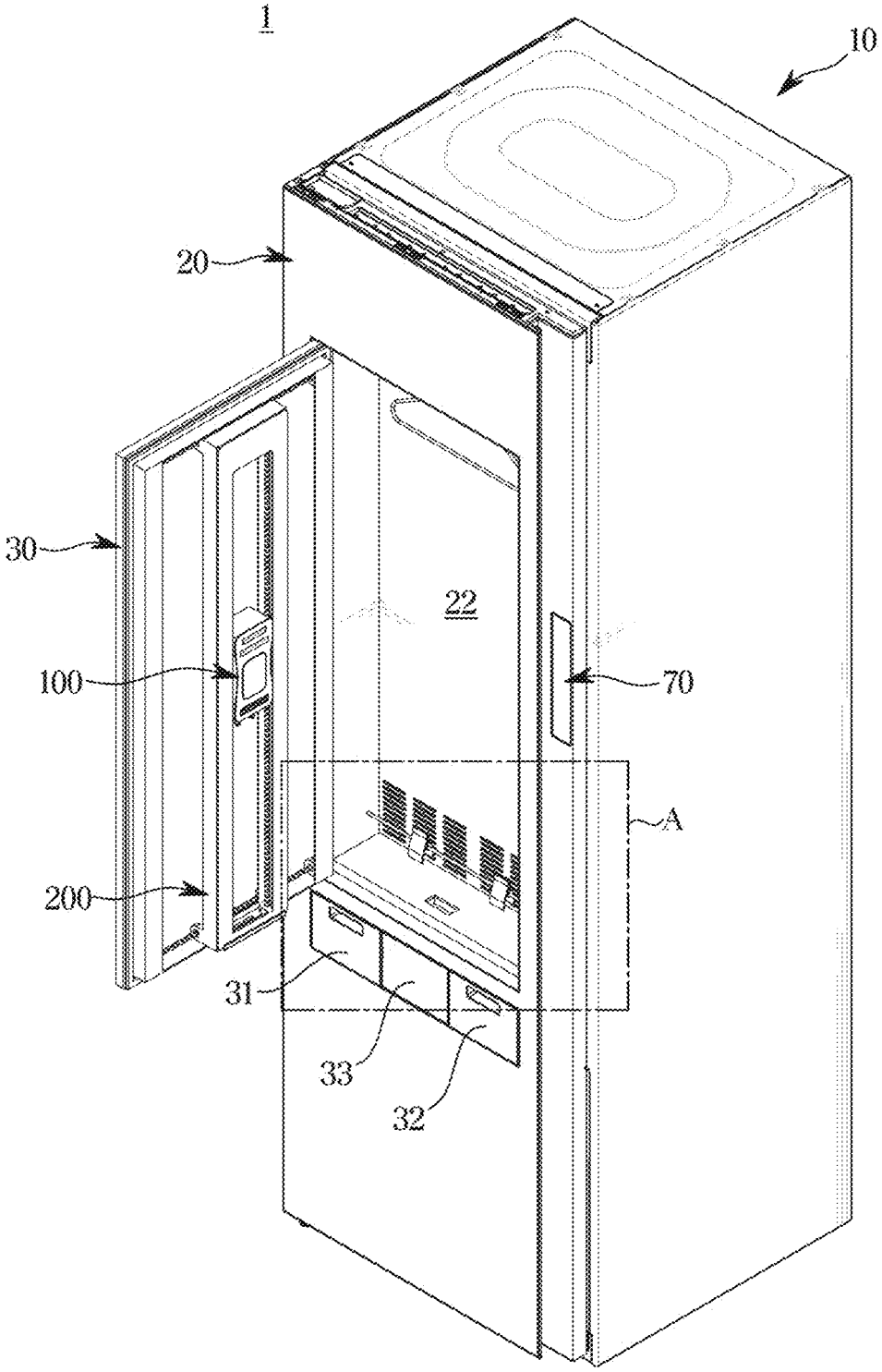
FIG. 3 illustrates a clothes care apparatus with a second door opened, according to an embodiment.
Figure 4:
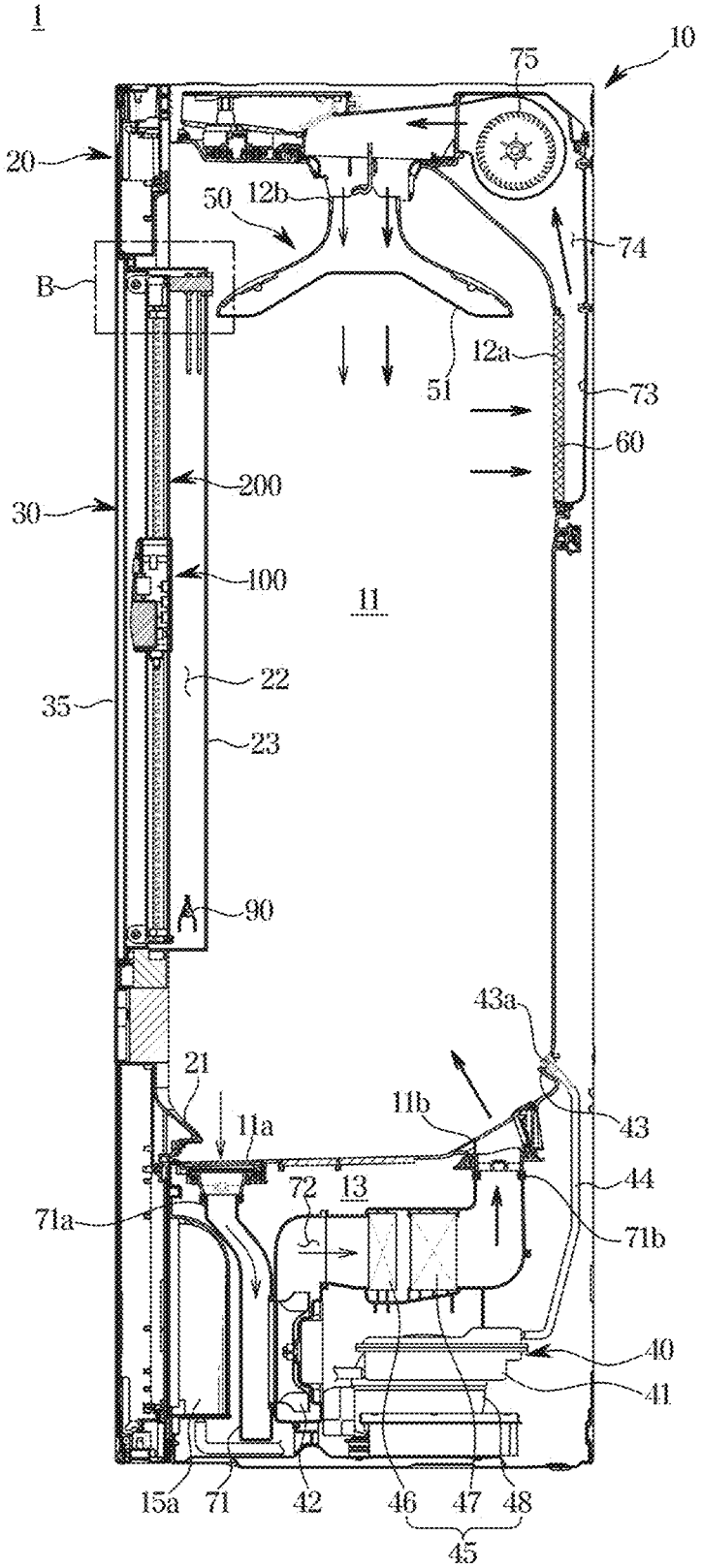
FIG. 4 is a cross-sectional view of a clothes care apparatus, according to an embodiment.

FIG. 1 is a perspective view of a clothes care apparatus, according to an embodiment. FIG. 2 illustrates a clothes care apparatus with a first door opened, according to an embodiment. FIG. 3 illustrates a clothes care apparatus with a second door opened, according to an embodiment. FIG. 4 is a cross-sectional view of a clothes care apparatus, according to an embodiment.

As shown in FIGS. 1 to 4, an embodiment of a clothes care apparatus 1 may include a cabinet 10 that forms (or defines) an exterior of the clothes care apparatus 1, a first door 20 pivotally coupled to the cabinet 10, and a second door 30 pivotally coupled to the first door 20.

The cabinet 10 may form a first chamber 11 configured to receive (or accommodate) a garment. The cabinet 10 may be shaped like a cuboid with one open side. An opening 10*a* may be formed on the front of the cabinet 10. Hence, the first chamber 11 may be formed to have the open front side.

The first door 20 may be configured to open or close the opening 11 of the cabinet 10. The first door 20 may be pivotally coupled to the cabinet 10. The first door 20 may open or close the first chamber 11 by opening or closing the opening 10*a* of the cabinet 10. The first door 20 may be pivotally coupled to the cabinet 10 through a connection member such as a hinge 20*a*.

A machine room 13 may be defined in the cabinet 10 to be separated from the first chamber 11. The machine room 13 may accommodate a heat exchange device 45 configured to heat or dehumidify air in the first chamber 11. The machine room 13 may accommodate a steam generating device 40 configured to supply steam into the first chamber 11.

The first chamber 11 may be defined in the cabinet 10 to accommodate a garment. The first chamber 11 may provide a space for receiving clothes. A garment support member 50 may be provided in the first chamber to support a garment. The garment support member 50 may be detachably coupled to an upper side of the first chamber 11. In an embodiment, one or more garment support members 50 may be provided in the first chamber 11. For example, a plurality of garment support members 50 may be provided in the first chamber 11. The garment support member 50 may be shaped like a hanger to hang a garment thereon. The garment support member 50 may be disposed in a predetermined position in the first chamber 11 for air to move therearound within the garment support member 50. Dust or foreign materials on the garment may be removed by spraying the air supplied into the garment support member 50 toward the garment.

The first door 20 may have a second chamber 22 separated from the first chamber 11 and arranged to accommodate a garment. The second chamber 22 may be formed inside the first door 20. The first door 20 may include a case 23 shaped like a cuboid with one open side, and the case 23 may form the second chamber 22. The case 23 may be provided integrally with the first door 20 or provided separately to be coupled to the first door 20. The second chamber 22 may be formed to have an open front side.

The second door 30 may be provided to open or close the second chamber 22. The second door 30 may be pivotally coupled to the first door 20 to open or close the second chamber 22.

A switchable mirror 35 may be provided on the second door 30. In an embodiment, the switchable mirror 35 may constitute the front (or a front surface) of the second door 30. The switchable mirror 35 may be arranged on the front side of the second door 30. The switchable mirror 35 may operate in a mirror mode or a transparent mode.

The first chamber 11 and the second chamber 22 may be separated from each other, but linked fluid-dynamically to each other.

The first chamber 11 may include a first air current inlet 11, a second air current inlet 12*a*, a first air current outlet 11*b* and a second air current outlet 12*b*.

The first air current inlet 11*a* and the first air current outlet 11*b* may be formed on the lower side of the first chamber 11. The first air current inlet 11*a* may be arranged on a front portion of the lower side of the first chamber 11. The first air current outlet 11*b* may be arranged on a rear portion of the lower side of the first chamber 11. The second air current inlet 12*a* may be formed on the rear side of the first chamber 11. The second air current outlet 12*b* may be formed on the upper side of the first chamber 11. The second air current inlet 12*a* and the second air current outlet 12*b* may be arranged close to each other. In an embodiment, the second air current inlet 12*a* may be arranged on an upper rear side of the first chamber 11. The second air current outlet 12*b* may be arranged to be adjacent to the center of the upper side of the first chamber 11.

A grill or filter may be provided at the first air current inlet 11*a* to effectively prevent inflow of foreign materials other than water through the first air current inlet 11*a*. A grill or filter may be provided at the first air current outlet 11*b* to prevent inflow of foreign materials and help the air current spread well into the first chamber 11.

The second air current outlet 12*b* of the first chamber 11 may be coupled to the garment support member 50. Air discharged through the second air current outlet 12*b* is delivered to the garment hung on the garment support member 50 through an air hole 51 formed at the garment support member 50.

A control panel 70 may be provided on the cabinet 10. The control panel 70 may be placed on one side of the second door 30. For example, the control panel 70 may be arranged on the right side of the second door 30, but the location of the control panel 70 is not limited thereto.

The control panel 70 may provide the user with a user interface to interact with the clothes care apparatus 1. The user interface may include at least one input interface and at least one output interface.

Referring to FIG. 2, the second chamber 22 may include a third air current inlet 24*a* and 24*b* and a third air current outlet 24*c*.

The third air current inlet 24*a* and 24*b* may include a rear air current inlet 24*a* formed (or defined) on an upper rear side of the second chamber 22, and a top air current inlet 24*b* formed on the upper side of the second chamber 22. The third air current outlet 24*c* may be formed on a lower rear side of the second chamber.

The third air current inlet 24*a* and 24*b* and the third air current outlet 24*c* may be formed through the case 23. Dry air and/or steam inside the first chamber 11may flow into the second chamber 22 through the third air current inlet 24*a* and 24*b*. The air and/or steam inside the second chamber 22 may be released into the first chamber 11 through the third air current outlet 24*c*.

As the third air current inlet 24*a* and 24*b* is arranged to be adjacent to the second air current outlet 12*b*, the amount of air inflow through the third air current inlet 24*a* and 24*b* may be greater than the amount of air release through the third air current inlet 24*a* and 24*b*. In such an embodiment, air release through the third air current inlet 24*a* and 24*b* may also be possible.

In another embodiment, unlike what is shown in FIG. 2, the clothes care apparatus 1 may be provided with a plurality of holes formed (or defined) all across at least one side of the case 23. The plurality of holes may include inlets through which air and steam flow into the second chamber 22 from the first chamber 11, and outlets through which air and steam are released from the second chamber 22. For example, the plurality of holes may be formed all across the rear side of the case 23 or all across the top, bottom, left and right and rear sides of the case 23. In such an embodiment, exchange of the air and steam between the first chamber 11 and the second chamber 22 may be facilitated. The plurality of holes may be formed across at least a portion of the top, bottom, left and right and rear sides of the case 23.

In such an embodiment, the third air current outlet 24*c* is arranged to be adjacent to the first air current inlet 11*a*, the amount of air release through the third air current outlet 24*c* may be greater than the amount of air inflow through the third air current outlet 24*c*. In such an embodiment, air inflow through the third air current outlet 24*c* may also be possible.

In an embodiment, the clothes care apparatus 1 may include a spot cleaning device 100 provided in the second chamber 22 to partially clean the garment accommodated in the second chamber 22.

The spot cleaning device 100 may be placed inside the second chamber 22 when the second chamber 22 is closed by the second door 30. The spot cleaning device 100 may be arranged on the rear side of the second door 30.

The clothes care apparatus 1 may include a moving device 200 arranged to move the spot cleaning device 100 in the second chamber 22 in a first direction and a second direction crossing the first direction.

The spot cleaning device 100 may be arranged to be movable in the second chamber 22. Specifically, the spot cleaning device 100 may be arranged to be moved by the moving device 200 in the second chamber 22 along the first direction and the second direction. Herein, the first direction may indicate a vertical direction and the second direction may indicate a horizontal direction. The vertical direction may include upward and downward directions. The horizontal direction may include left and right directions on the assumption that the second door 30 is in a closed state and viewed from a front (or viewed in a thickness direction of the second door 30).

In an embodiment, the moving device 200 may receive a power from a battery of the spot cleaning device 100 or receive power from a power supplier of the clothes care apparatus 1.

In such an embodiment where the spot cleaning device 100 is arranged to be movable in the second chamber 22, the spot cleaning device 100 may perform spot cleaning on the garment accommodated in the second chamber 22. Spot cleaning may mean selectively cleaning (or washing) a portion of the garment. The portion of the garment to be subject to spot cleaning may be called a target portion. The target portion may be determined by the user's setting or determined automatically by the clothes care apparatus 1. The target portion may be multiple portions of the garment.

The spot cleaning device 100 may move to face the target portion to partially clean the target portion in response to an instruction of the clothes care apparatus 1, and clean the target portion.

The spot cleaning device 100 may be provided to spray water and a washing fluid to the garment. The washing fluid may include a detergent or a fluid, which is a mixture of a detergent and water. The spot cleaning device 100 may provide micro-vibration for the garment after or at the same time as spraying water and the washing fluid to the garment. For example, as will be described later, the spot cleaning device 100 may include a vibrator 103 (e.g., ultrasonic vibrator) configured to provide micro-vibration (e.g., ultrasonic vibration). The spot cleaning device 100 may wash the target portion by providing micro-vibration for the target portion of the garment where the water and washing fluid have been sprayed. The spot cleaning device 100 may be arranged to draw in the water and washing fluid sprayed toward the garment. The spot cleaning device 100 may reduce or remove the water and the washing fluid that remain on the garment by drawing in the water and the washing fluid. The spot cleaning device 100 may also absorb contaminants or foreign materials on the garment as well as draw in the water and the washing fluid. A detailed structure of the spot cleaning device 100 will be described later.

A cabinet drain tub 15*a* and a cabinet water supply tub 15*b* may be installed in a lower portion of the cabinet 10 to be detachable from the cabinet 10. The cabinet drain tub 15*a* and the cabinet water supply tub 15*b* may be arranged under the first chamber 11.

The cabinet drain tub 15*a* may be provided to store condensate produced in an operation process of the heat exchange device 45 or water condensed from the steam before being released. The cabinet drain tub 15*a* may be installed to be detachable from the cabinet 10 for efficient water release.

The cabinet water supply tub 15*b* may be provided to store water used to produce steam in the steam generating device 40, which will be described later. The water in the cabinet water supply tub 15*b* may be supplied to the steam generating device 40 to be used to produce steam. The cabinet water supply tub 15*b* may be installed to be detachable from the cabinet 10 for easy water replenishment.

The cabinet drain tub 15*a* and the cabinet water supply tub 15*b* may be arranged in front of the machine room 13. The machine room 13 may be arranged in a lower portion of the cabinet 10. The machine room 13 may be arranged under the first chamber 11 and separated from the first chamber 11 to form a separate space.

The machine room 13 may receive the heat exchange device 45 provided to dehumidify and heat air in the first chamber 11.

In the machine room 13, a first fan 42, the heat exchange device 45 and the steam generating device 40 may be arranged.

The heat exchange device 45 may heat and dehumidify the air supplied into the first chamber 11. The heat exchange device 45 may include an evaporator 46, a compressor 48 and a condenser 47, through which a refrigerant circulates. The heat exchange device 45 may dehumidify and heat the air.

The refrigerant absorbs latent heat of surrounding air while evaporating in the evaporator 46 of the heat exchange device 45, so the heat exchange device 45 may condense and eliminate moisture in the air. When the refrigerant is condensed in the condenser 47 through the compressor 48, latent heat may be released to the surrounding air, so the heat exchange device 45 may heat the surrounding air. The air brought into the machine room 13 by a first fan 42 may be dehumidified and heated while sequentially going through the evaporator 46 and the condenser 47.

The clothes care apparatus 1 may include a first duct 71 arranged to receive the evaporator 46, the condenser 47 and the first fan 42. The first duct 71 may be placed in the machine room 13. One end 71*a* of the first duct 71 may be coupled to the first air current inlet 11*a*. The other end 71*b* of the first duct 71 may be coupled to the first air current outlet 11*b*. The first duct 71 may be connected to the first chamber 11 through the first air current inlet 11*a* and the first air current outlet 11*b*.

The air in the first chamber 11 may flow into the first duct 71 through the first air current inlet 11*a*, and may be released back into the first chamber 11 through the first air current outlet 11*b*. The air brought into the first duct 71 may be dehumidified and heated while going through the evaporator 46 and the condenser 47. The first duct 71 may form a first circulation path 72 that circulates through the first chamber 11, the first fan 42, the evaporator 46 and the condenser 47. The first fan 42 may be placed in the first circulation path 72 to draw the air of the first chamber 11 into the first duct 71. The air drawn into the first duct 71 by the first fan 42 may be released into the first chamber 11 through the first air current outlet 11*b*. The first circulation path 72 may refer to a circulation path in which the air brought into the first duct 71 from the first chamber 11through the first air current inlet 11*a* is released back into the first chamber 11 from the first duct 71 through the first air current outlet 11*b*.

The clothes care apparatus 1 may include the steam generating device 40 placed in the machine room 13. The steam generating device 40 may produce steam with water received from the cabinet water supply tub 15*b* in the machine room 13.

The steam generating device 40 may include a steam generator 41 connected to the cabinet water supply tub 15*b* for producing steam with the supplied water, a steam sprayer 43 for spraying steam produced by the steam generator 41, and a steam connection tube 44 connecting between the steam generator 41 and the steam sprayer 43.

The steam sprayer 43 may be fixed to a steam outlet 43*a* formed at a rear lower side of the first chamber 11. The steam outlet 43*a* may be formed to correspond to the steam sprayer 43. The steam sprayer 43 may spray the steam produced in the machine room 13 into the first chamber 11 through the steam outlet 43*a*. In an embodiment, the locations of the steam sprayer 43 and the steam outlet 43*a* may be variously modified.

The steam generator 41 may include a heater (not shown) inside. The steam generator 41 may produce steam by heating water with the heater.

The first door 20 may include a door guide 21 arranged to lead the water moving down by gravity to the first air current inlet 11*a*. The door guide 21 may be arranged in a lower portion of the rear side of the first door 20. The door guide 21 may slope down to the first air current inlet 11*a* from the rear side of the first door 20. The water on the rear side of the first door 20 may move to the door guide 21 by gravity and may be led rearward by the door guide 21 to flow in through the first air current inlet 11*a*. The water flowing in through the first air current inlet 11*a* may be moved by a connection member (not shown) into the cabinet drain tub 15*a*.

The clothes care apparatus 1 may include a second fan 75 for forcing the air inside to move around, and a second duct 73 in which the second fan 75 is installed. The second duct 73 may be connected to the first chamber 11. One end of the second duct 73 may be coupled to the second air current inlet 12*a*. The other end of the second duct 73 may be coupled to the second air current outlet 12*b*. The air flowing into the second duct 73 through the second air current inlet 12*a* may be released into the first chamber 11 through the second air current outlet 12*b*. The second fan 75 may be installed in the second duct 73 to draw air into the second duct 73 through the second air current inlet 12*a*. The air drawn into the second duct 73 by the second fan 75 may be released into the first chamber 11 through the second air current outlet 12*b*.

The second duct 73 may connect the first chamber 11 to the second air current inlet 12*a* and the second air current outlet 12*b*, thereby creating a second circulation path 74. The second circulation path 74 may refer to a circulation path in which the air drawn into the second duct 73 from the first chamber 11 through the second air current inlet 12*a* is released back into the first chamber 11 from the second duct 73 through the second air current outlet 12*b*.

The second duct 73 may be arranged behind the first chamber 11. The second duct 73 may be placed behind the second air current inlet 12*a* formed on the rear side of the first chamber 11. The second duct 73 may be located in an upper portion of the rear side of the first chamber 11. A filter member 60 may be detachably installed at the second air current inlet 12*a* to filter off foreign materials in the air drawn in through the second air current inlet 12*a*. Foreign materials such as dust and odor in the air drawn into the second duct 73 may be removed by the filter member 60. The filter member 60 may include not only a filter but also a sheet (not shown) arranged to provide a scent for the garment.

The garment support member 50 may be coupled onto the top of the first chamber 11 to be connected to the second air current outlet 12*b*. The garment support member 50 may spray the air released from the second air current outlet 12*b* toward the garment. The air sprayed by the garment support member 50 may get rid of foreign materials such as dust on the garment.

The clothes care apparatus 1 may perform a garment care mode while clothes are hung on the garment support member 50 and the first door 20 is in a closed state. In the garment care mode, the air in the first chamber 11 may circulate in the cabinet 10 along the first circulation path 72 and the second circulation path 74. A portion of the air in the first chamber 11 may flow into the second chamber 22 through the third air current inlet 24*a* and 24*b*. The air in the second chamber 22 may be released into the first chamber 11 through the third air current outlet 24*c*.

Figure 5:
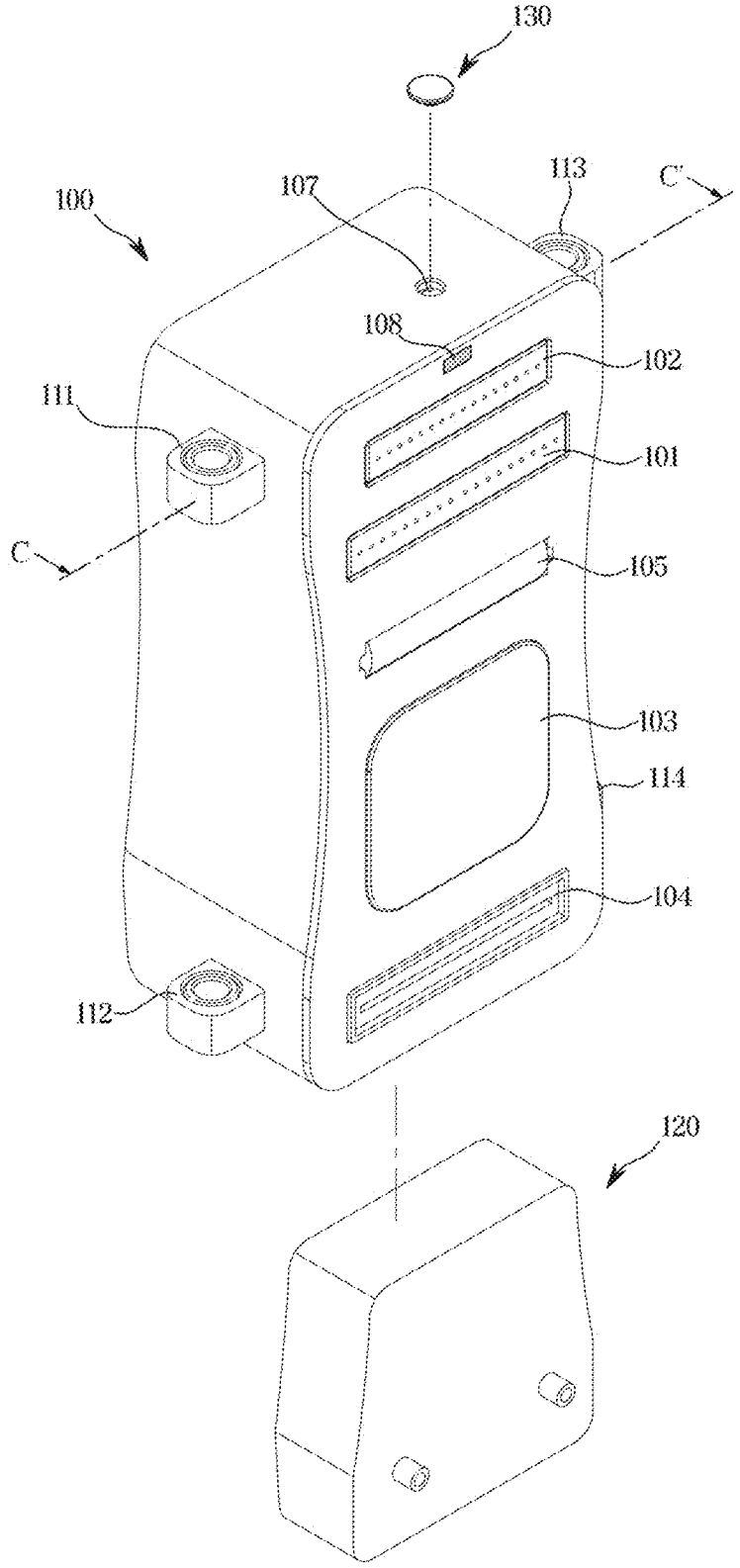
FIG. 5 illustrates a spot cleaning device, according to an embodiment.
Figure 6:
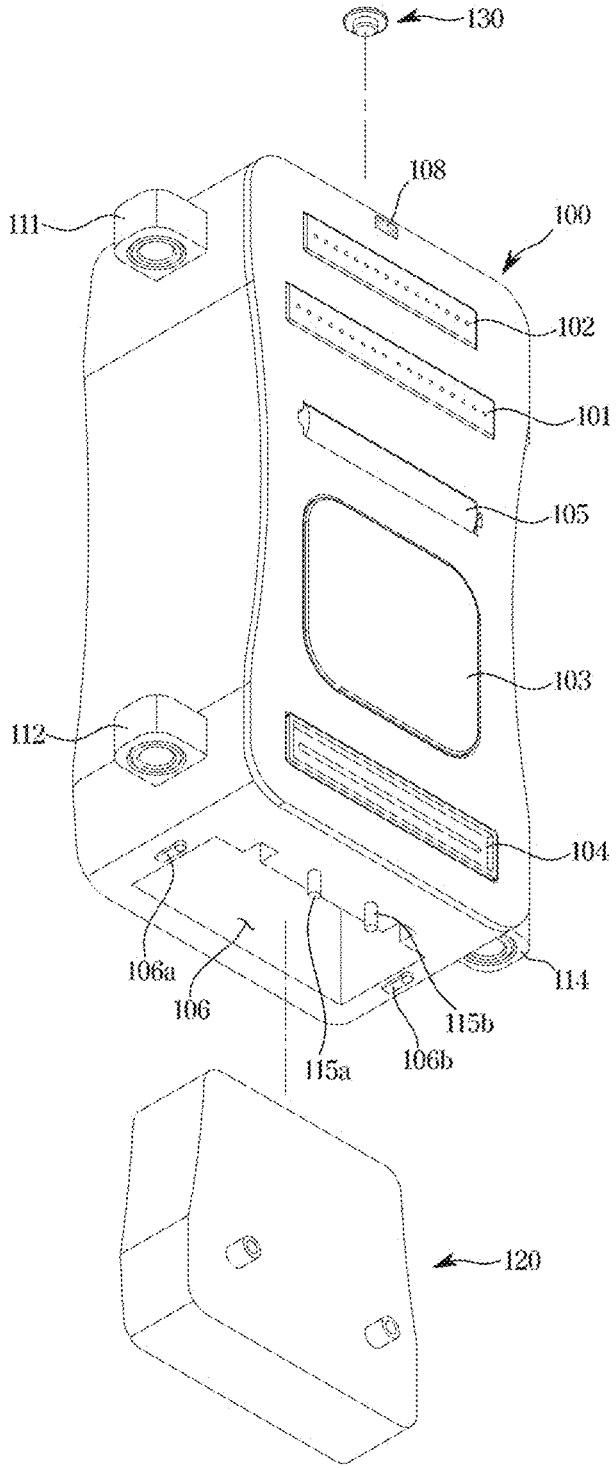
FIG. 6 illustrates a spot cleaning device at a different angle, according to an embodiment.

FIG. 5 illustrates a spot cleaning device, according to an embodiment. FIG. 6 illustrates a spot cleaning device at a different angle, according to an embodiment.

Referring to FIGS. 5 and 6, an embodiment of the clothes care apparatus 1 may include the spot cleaning device 100. The spot cleaning device 100 may be arranged in the second chamber 22 to do the partial wash (spot cleaning) on the garment accommodated in the second chamber 22.

The spot cleaning device 100 may include a water sprayer 101 arranged to spray water, a washing fluid sprayer 102 arranged to spray the washing fluid, a vibrator 103 arranged to contact the garment and provide micro-vibration for the garment, and a suction part 104 arranged to draw in the water and the washing fluid.

In an embodiment, the spot cleaning device 100 may include at least one sensor 108 for collecting sensor data associated with the garment accommodated in the second chamber 22. The at least one sensor 108 may include a camera and/or a photo sensor.

The camera may have a capturing direction toward the garment accommodated in the second chamber 22. The photo sensor may include a light irradiator and a light receiver, and the light irradiator and the light receiver may have irradiation and reception directions toward the garment accommodated in the second chamber 22.

The at least one sensor 108 may be located at an upper end of the spot cleaning device. For example, the at least one sensor 108 may be arranged above the washing fluid sprayer 102. In the disclosure, the at least one sensor 108 may be effectively prevented from being stained by contaminated water, and may secure a viewing angle of the camera when the at least one sensor 108 includes the camera.

The water sprayer 101 may spray water toward the garment. The washing fluid sprayer 102 may spray the washing fluid, which is a mixture of water and detergent, toward the garment. The vibrator 103 may clean the garment by contacting the garment and providing micro-vibration for the garment. The suction part 104 may draw in the water and washing fluid sprayed to the garment, and foreign materials.

The spot cleaning device 100 may further include a roller 105 arranged to rotate to remove foreign materials on the garment. The spot cleaning device 100 may include a motor (not shown) provided to rotate the roller 105. The roller 105 may clean the target portion of the garment along with the vibrator 103. The roller 105 may clean the garment by contacting the garment. The roller 105 may facilitate blending of contaminants on the garment with the washing fluid by physically contacting the garment onto which the water and washing fluid are sprayed. Furthermore, the roller 105 may remove foreign materials such as dust on the garment by contacting the garment.

The roller 105 may be shaped like a brush. Alternatively, the spot cleaning device 100 may not include the roller 105. In another example, the spot cleaning device 100 may include the roller 105 instead of the vibrator 103.

In an embodiment, the spot cleaning device 100 may include a water tub 120 including a water supply tub 121 (see FIG. 7) provided to supply water to be sprayed by the water sprayer 101 and a drain tub 122 (see FIG. 7) provided to store water drawn in by the suction part 104. The water tub 120 may be partitioned by a wall 123 (see FIG. 7) into the water supply tub 121 and the drain tub 122. In various embodiments, the spot cleaning device 100 may include the water supply tub and the drain tub which are separated from each other.

The water tub 120 may be provided with a first water tub opening 121*a* through which water is supplied into the water supply tub 121 or released from the water supply tub 121. The water tub 120 may be provided with a second water tub opening 122*a* through which water and washing fluids, foreign materials, etc., flow into the drain tub 122 or flow out of the drain tub 122.

Referring to FIGS. 5 to 6, the water tub 120 may be detachably coupled to the spot cleaning device 100. The user may fill the water supply tub 121 of the water tub 120 with water and then couple the water supply tub 121 to the spot cleaning device 100. The user may detach the water tub 120 from the spot cleaning device 100 and then discharge the water and washing fluids and foreign materials filled in the drain tub 122. In an embodiment, the water tub 120 may be separated down from the spot cleaning device 100. This may allow the user to decouple the water tub 120 from the spot cleaning device 100 or couple the water tub 120 to the spot cleaning device 100 without separating the spot cleaning device 100 from the second door 30. In other words, the user may decouple the water tub 120 from the spot cleaning device 100 or couple the water tub 120 to the spot cleaning device 100 without approaching behind the spot cleaning device 100.

The spot cleaning device 100 may include a water tub insertion part 106 provided for the water tub 120 to be inserted thereto, and water tub fixers 106*a* and 106*b* for fixing the water tub 120 to prevent the water tub 120 inserted to the water tub insertion part 106 from falling out of the water tub insertion part 106 due to gravity.

The water tub fixers 106*a* and 106*b* may be arranged to be adjacent to the water tub insertion part 106. The water tub fixers 106*a* and 106*b* may be arranged to be turned. The water tub fixers 106*a* and 106*b* may be arranged to be turned between a pinning position to prevent the water tub 120 inserted to the water tub insertion part 106 from falling out of the water tub insertion part 106 and an unpinning position to allow the water tub 120 inserted to the water tub insertion part 106 to be pulled out of the water tub insertion part 106. The water tub fixers 106*a* and 106*b* may be provided in a pair. In embodiments, the number and arrangement of the water tub fixers may be variously modified. Alternatively, instead of the water tub fixers, elastic projections may be provided on the water tub 120 to fit the water tub 120 in the water tub insertion part 106.

The spot cleaning device 100 may include a detergent inlet 107 arranged for the detergent to be put into a detergent container. The user may put the detergent into the detergent container through the detergent inlet 107 without separating the spot cleaning device 100 from the second door 30. In other words, the detergent may be put into the detergent container without approaching behind the spot cleaning device 100.

The spot cleaning device 100 may further include an inlet cover 130 provided to cover the detergent inlet 107 and detachably coupled to the detergent inlet 107. In a case that the detergent inlet 107 is arranged on the top of the spot cleaning device 100 as shown in FIG. 5, the inlet cover 130 may be omitted. This is because the detergent may not flow out through the detergent inlet even without the inlet cover.

The spot cleaning device 100 may include moving parts 111, 112, 113 and 114. The moving parts 111, 112, 113 and 114 may include the first moving part 111 and the second moving part 112 arranged to couple to a first shaft 211. The moving parts 111, 112, 113 and 114 may include the third moving part 113 and the fourth moving part 114 arranged to couple to a third shaft 231. The moving parts 111, 112, 113 and 114 may be arranged to move in a first direction with the rotation of the first shaft 211 and the third shaft 231.

The first moving part 111 and the second moving part 112 may be spaced apart in the first direction. The third moving part 113 and the fourth moving part 114 may be spaced apart in the first direction. The first direction may refer to upward and downward directions or a vertical direction. Hence, the first moving part 111 and the second moving part 112 may be vertically spaced apart, and the third moving part 113 and the fourth moving part 114 may be vertically spaced apart.

The moving parts 111, 112, 113 and 114 may each be provided with a hole defined therein for the shaft to be disposed through. A screw thread may be formed in the hole of each of the moving parts 111, 112, 113 and 114 to correspond to a screw thread formed at the first shaft 211 or the third shaft 231. This may enable the first moving part 111 and the second moving part 112 to move upward or downward with the rotation of the first shaft 211 in one direction, and enable the first moving part 111 and the second moving part 112 to move downward or upward with the rotation of the first shaft 211 in the other direction. Likewise, the third moving part 113 and the fourth moving part 114 may move upward or downward with the rotation of the third shaft 231 in one direction, and the third moving part 113 and the fourth moving part 114 may move downward or upward with the rotation of the third shaft 231 in the other direction. The one direction and the other direction may refer to clockwise (CW) and counterclockwise (CCW), respectively.

Figure 7:
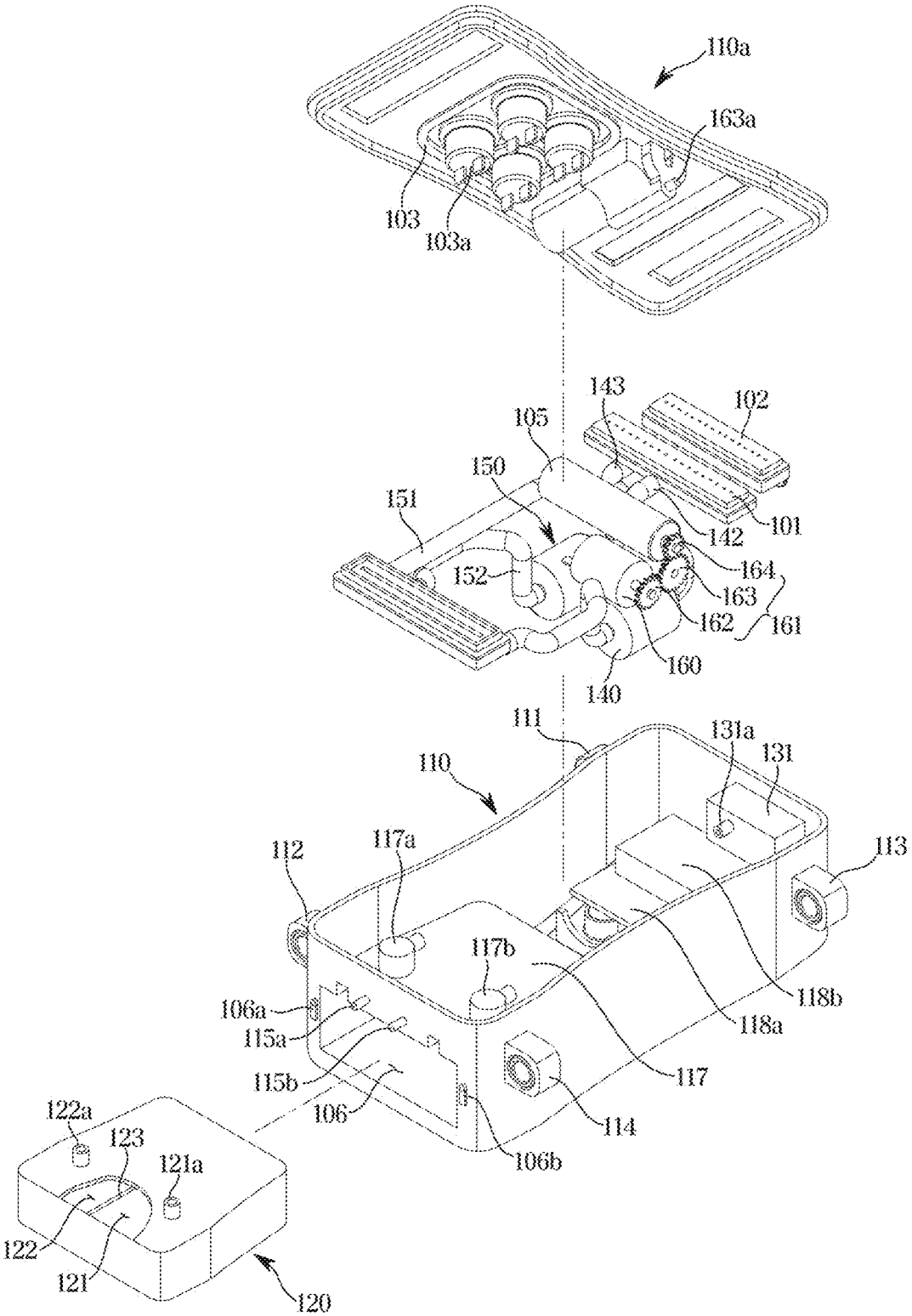
FIG. 7 is an exploded view of a spot cleaning device, according to an embodiment.
Figure 8:
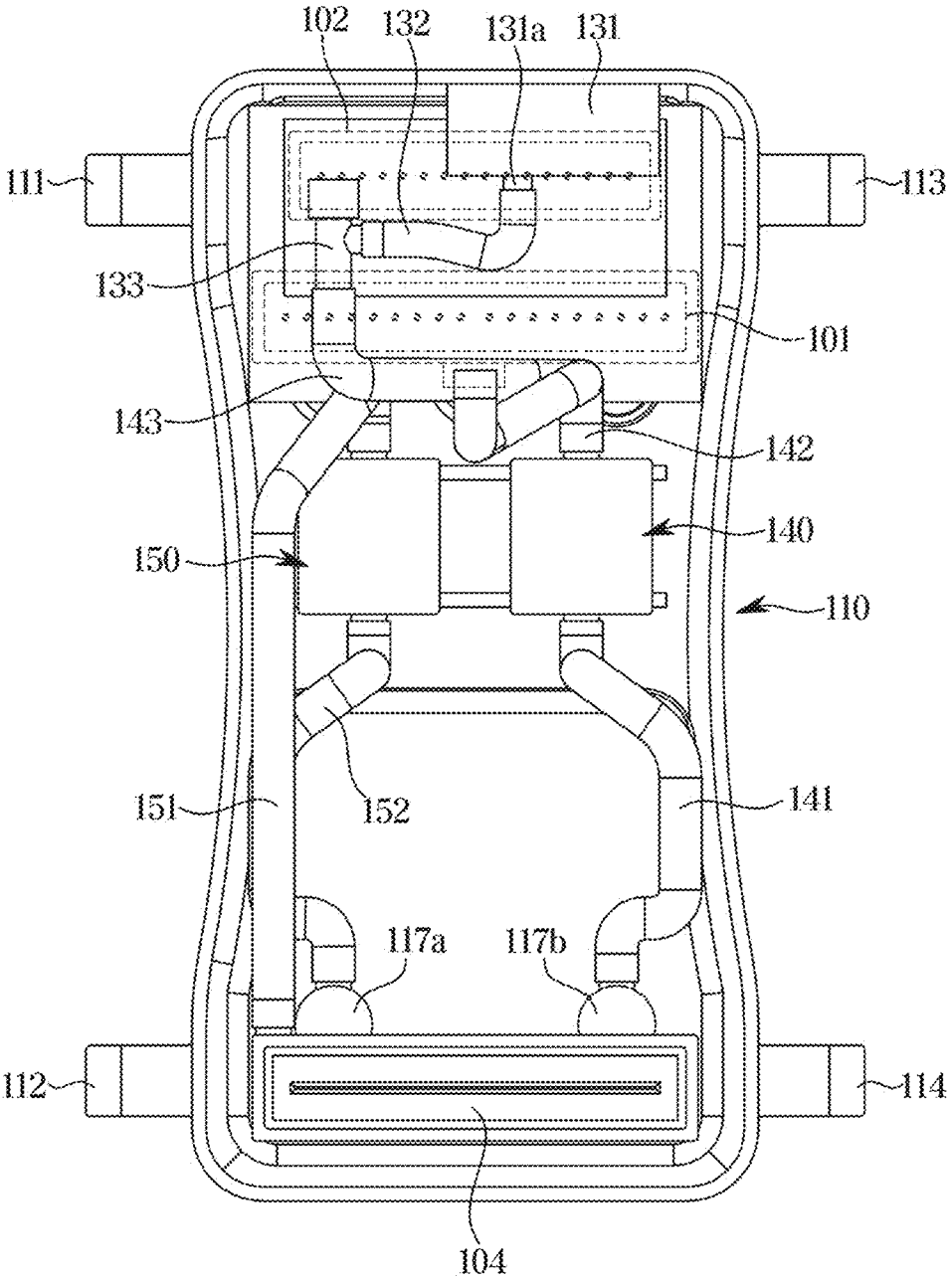
FIG. 8 illustrates a spot cleaning device with some components omitted therefrom to describe a water supply path and a drain path, according to an embodiment.
Figure 9:
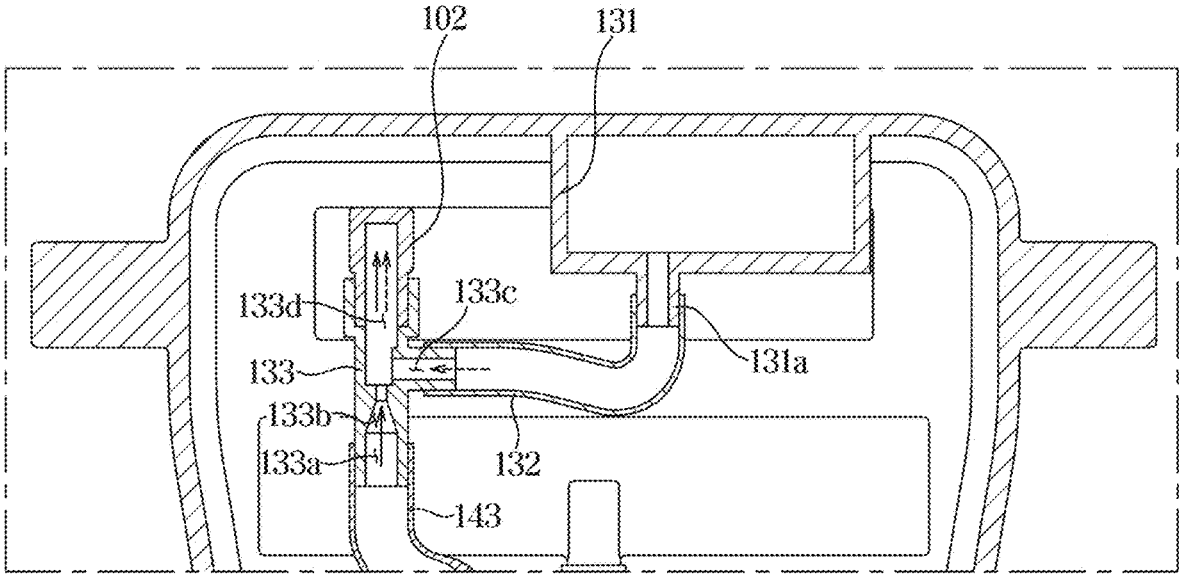
FIG. 9 is an enlarged cross-sectional view of a portion of a spot cleaning device, according to an embodiment.

FIG. 7 is an exploded view of a spot cleaning device, according to an embodiment. FIG. 8 illustrates a spot cleaning device with some components omitted therefrom to describe a water supply path and a drain path, according to an embodiment. FIG. 9 is an enlarged cross-sectional view of a portion of a spot cleaning device, according to an embodiment.

Referring to FIG. 7, in an embodiment, the spot cleaning device 100 may include a housing 110, a water supply pump 140 accommodated in the housing 110, a drain pump 150, a driving motor 160 and a housing cover 110*a*. The spot cleaning device 100 may further include the detergent container 131, a substrate 118*a* and a battery 118*b*.

The housing 110 may have a form with one open side. The housing 110 may include the first, second, third and fourth moving parts 111, 112, 113 and 114. The housing may accommodate the water supply pump 140, the drain pump 150 and the driving motor 160 inside, which will be described later. The detergent container 131 may be arranged and the substrate 118*a* and the battery 118*b* may be accommodated in the housing 110. The housing cover 110*a* may be provided to cover the one open side of the housing 110.

In an embodiment, the housing 110 may include the water tub insertion part 106 arranged to put in the water tub 120 or pull out the water tub 120, and a water tub receiver 117 arranged to accommodate the water tub 120 put into the housing 110 through the water tub insertion part 106. At the water tub receiver 117, a water supply connector 117*b* coupled to the first water tub opening 121*a* of the water tub 120 and a drain connector 117*a* coupled to the second water tub opening 122*a* of the water tub 120.

Referring to FIG. 7, the spot cleaning device 100 may include the driving motor 160 for providing a driving force to rotate the roller 105, and a gear module 161 provided to deliver the driving force of the driving motor 160 to the roller 105. In an embodiment, the gear module 161 may include a first gear 162 coupled to the driving shaft of the driving motor 160, a second gear 164 coupled to the roller 105, and a third gear 163 arranged to interlock with the first and second gears 162 and 164 between the first and second gears 162 and 164. The third gear 163 may be coupled to a gear connector 163*a* of the housing cover 110*a*.

The spot cleaning device 100 may include an ultrasonic vibrator 103*a* arranged to provide micro-vibration for the vibrator 103. The ultrasonic vibrator 103*a* may be provided in plural, and for example, there may be four ultrasonic vibrators 103*a* arranged inside the vibrator 103. The ultrasonic vibrator 103*a* may be placed in the housing 110 when the housing cover 110*a* is coupled to the housing 110.

Referring to FIGS. 7 and 8, the spot cleaning device 100 may include the water supply pump 140 arranged to move the water stored in the water supply tub 121 into the water sprayer 101 and the washing fluid sprayer 102. The water supply pump 140 may be connected to a first water supply duct 141 and a second water supply duct 142. The water may be moved into the first water supply duct 141 and the second water supply duct 142, which may form a flow path in which the water is moved. The first water supply duct 141 may connect between the water supply connector 117*b* and the water supply pump 140. The second water supply duct 142 may connect between the water supply pump 140 and the water sprayer 101. As the water supply pump 140 operates, the water in the water supply tub 121 may flow into the water supply pump 140 through the first water tub opening 121*a*, the water supply connector 117*b* and the first water supply duct 141. The water brought into the water supply pump 140 may be released into the second water supply duct 142. As the second water supply duct 142 is connected to the water sprayer 101, the water released into the second water supply duct 142 may be sprayed out of the spot cleaning device 100 through the water sprayer 101.

In an embodiment, the spot cleaning device 100 may further include a third water supply duct 143 branched from a point of the second water supply duct 142. The third water supply duct 143 may be connected to a connection duct 133, which will be described later. The water in the third water supply duct 143 may be mixed with the detergent in the detergent container 131 in the connection duct 133, and then sprayed out of the spot cleaning device 100 through the washing fluid sprayer 102. This will be described later in detail.

Referring to FIGS. 7 and 8, the spot cleaning device 100 may include the drain pump 150 arranged to move the water, the washing fluid and foreign materials into the drain tub 122 from the suction part 104. The drain pump 150 may be connected to a first drain duct 151 and a second drain duct 152. The water may be moved into the first drain duct 151 and the second drain duct 152, which may form a flow path in which the water is moved. The first drain duct 151 may connect between the suction part 104 and the drain pump 150. The second drain duct 152 may connect between the drain pump 150 and the drain connector 117*a*. As the drain pump 150 operates, water, washing fluids and foreign materials through the suction part 104 may flow into the drain pump 150 through the first drain duct 151. The water, washing fluids and foreign materials brought into the drain pump 150 may be released into the second drain duct 152. The second drain duct 152 is connected to the drain tub 122 through the drain connector 117*a* and the second water tub opening 122*a*, so the water, washing fluids and foreign materials released into the second drain duct 152 may be stored in the drain tub 122.

The spot cleaning device 100 may include the detergent container 131 arranged to contain the detergent. In an embodiment, the detergent container 131 may be integrally formed with the housing 110. It is not, however, limited thereto, and the detergent container 131 is a separate component accommodated in the housing 110 and may be detachable from the housing 110. The detergent container 131 may be connected to the detergent inlet 107. The detergent put in through the detergent inlet 107 may be stored in the detergent container 131.

The detergent container 131 may include a detergent outlet 131*a*. The detergent in the detergent container 131 may be discharged out of the detergent container 131 through the detergent outlet 131*a*.

The detergent outlet 131*a* may be connected to a detergent duct 132. The detergent duct 132 may form a flow path in which the detergent moves. The detergent duct 132 may be connected to the connection duct 133. The connection duct 133 may be provided in the form of a T-shaped valve. The connection duct 133 may include two inlets and one outlet. One of the two inlets of the connection duct 133 may be connected to the third water supply duct 143 and the other may be connected to the detergent duct 132. The outlet of the connection duct 133 may be connected to the washing fluid sprayer 102.

Referring to FIG. 9, the connection duct 133 may include a first inlet 133*a* connected to the third water supply duct 143, a second inlet 133*c* connected to the detergent duct 132, and an outlet 133*d* connected to the washing fluid sprayer 102. The water brought in through the first inlet 133*a* and the detergent brought in through the second inlet 133*c* may be mixed in the connection duct 133, and the washing fluid of the mixture may be released through the outlet 133*d*.

The connection duct 133 may include a nozzle part 133*b* arranged at one end of the first inlet 133*a*. The one end of the nozzle part 133*b* may have the same diameter as the first inlet 133*a* to be connected to the first inlet 133*a*. The other end of the nozzle part 133*b* may have a smaller diameter than the first inlet 133*a*. That is, the nozzle part 133*b* may have the diameter decreasing from one end of the nozzle part 133*b* toward the other end. In such an embodiment, water brought in through the one end of the nozzle part 133*b* may be released through the other end at increasing flow velocity by such a structure of the nozzle part 133*b*. This is because pressure is reduced and flow velocity increases as the area of the flow path decreases while passing through the nozzle part. With the reduction in pressure of the fluid at the other end of the nozzle part 133*b*, the detergent in the detergent duct 132 is moved into the connection duct 133 having relatively low pressure. The water that has passed through the other end of the nozzle part 133*b* and the detergent brought in through the second inlet 133*c* may be mixed in the connection duct 133. The washing fluid that is the mixture of the water and the detergent may be released through the outlet 133*d* of the connection duct 133. The outlet 133*d* is connected to the washing fluid sprayer 102, so the water and detergent mixed in the connection duct 133 may be sprayed out of the spot cleaning device 100 through the washing fluid sprayer 102. As described above, the connection duct 133 may use the pressure difference generated by the nozzle part 133*b* included in the connection duct 133 to automatically mix the water and the detergent without using an extra driving device.

The spot cleaning device 100 may include the battery 118*b* arranged to provide power to electrical parts (e.g., water supply pump 140, the drain pump 150, the driving motor 160 and/or the ultrasonic vibrator 103*a*), and a charging terminal 115 arranged to charge the battery 118*b*. The charging terminal 115 may include a positive electrode 115*a* and a negative electrode 115*b*.

The spot cleaning device 100 may include the substrate 118*a* on which a second controller 180 and a second communicator 190 as will be described later are mounted. The substrate 118*a* may be accommodated in the housing 110. In addition to the second controller 180 and the second communicator 190, various parts (e.g., a heatsink) may be mounted on the substrate 118*a* as required.

Figure 10:
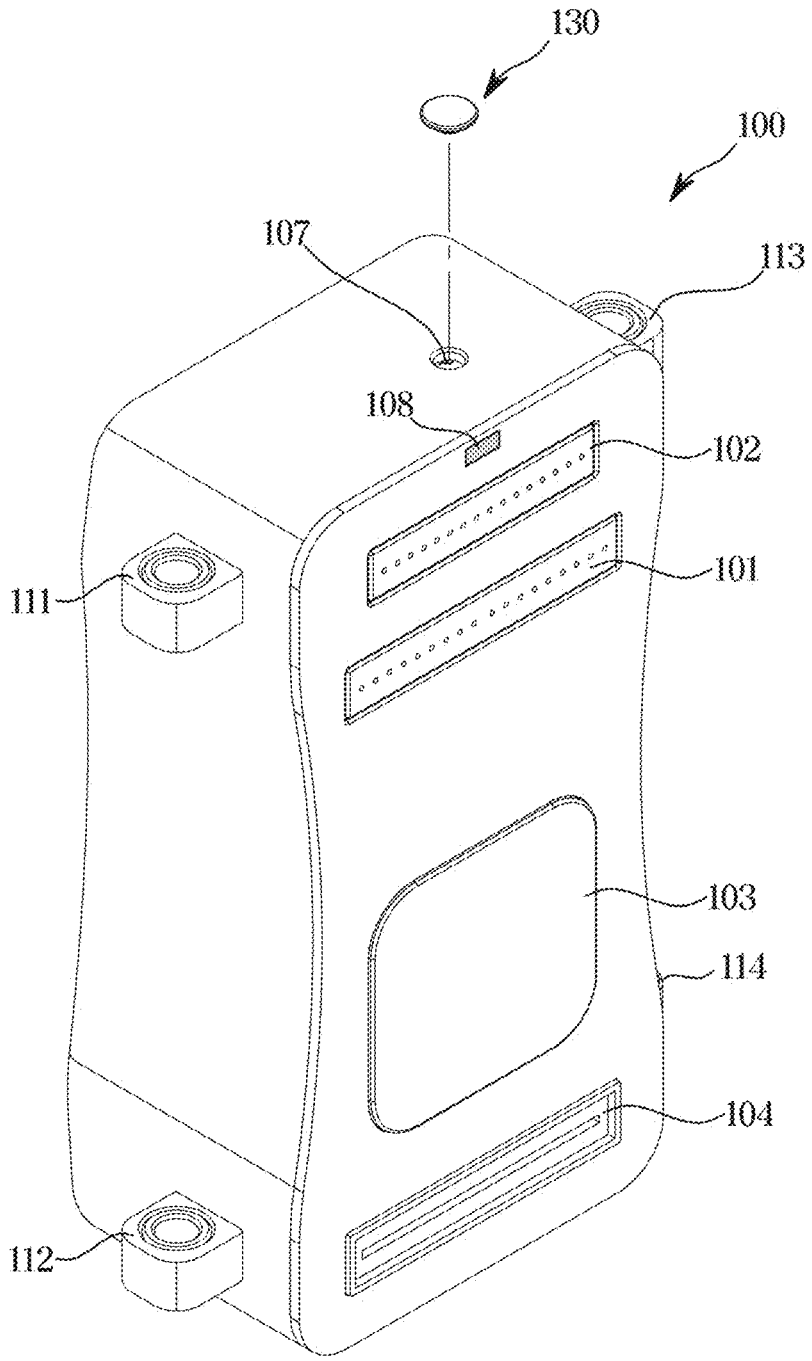
FIG. 10 illustrates a spot cleaning device, according to an embodiment.

FIG. 10 illustrates a spot cleaning device, according to an embodiment.

Referring to FIG. 10, the spot cleaning device 100 according to an embodiment may include the water sprayer 101, the washing fluid sprayer 102, the vibrator 103 and the suction part 104. In such an embodiment, the spot cleaning device 100 may be configured to include only the vibrator among the vibrator and the roller.

Figure 11:
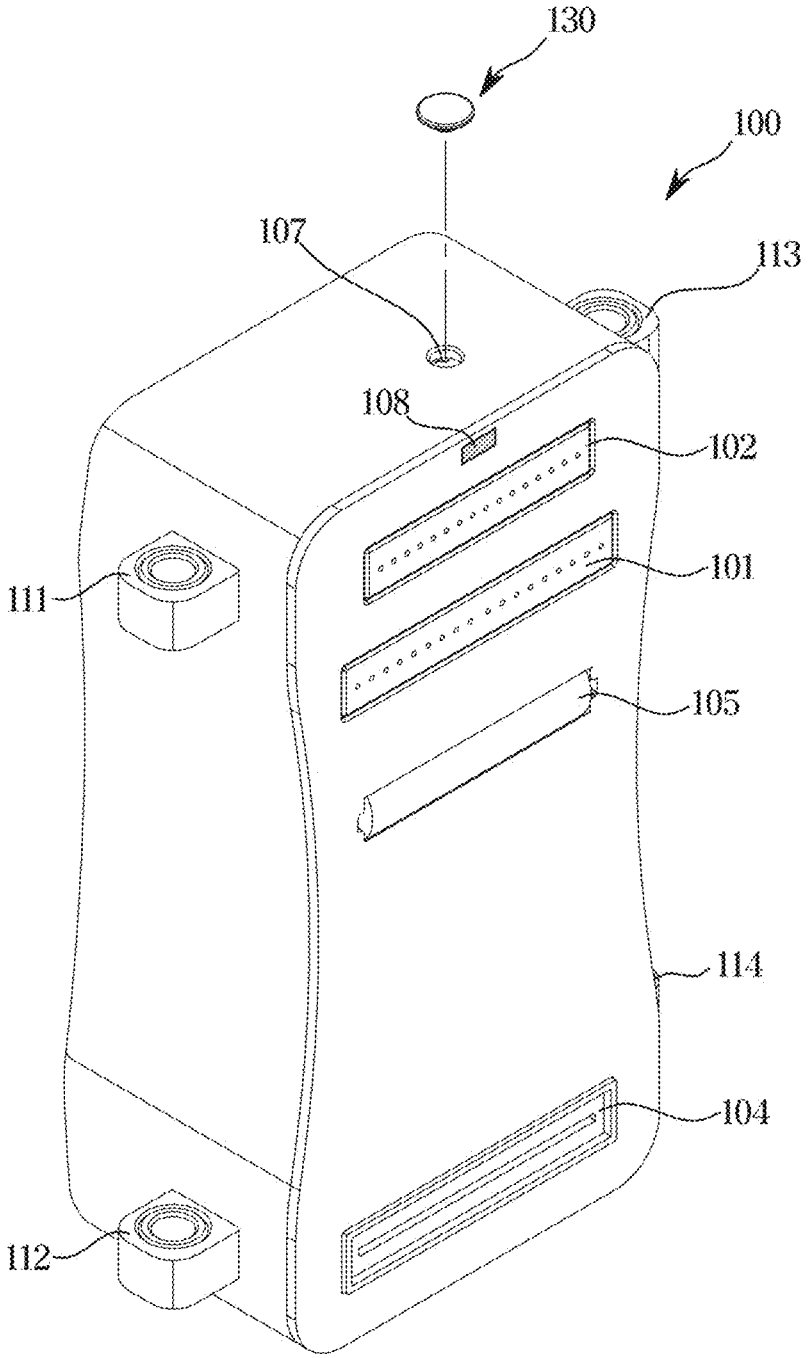
FIG. 11 illustrates a spot cleaning device, according to an embodiment.

FIG. 11 illustrates a spot cleaning device, according to an embodiment.

Referring to FIG. 11, the spot cleaning device 100 according to an embodiment may include the water sprayer 101, the washing fluid sprayer 102, the roller 105 and the suction part 104. In such an embodiment, the spot cleaning device 100 may be configured to include only the roller among the vibrator and the roller.

Figure 12:
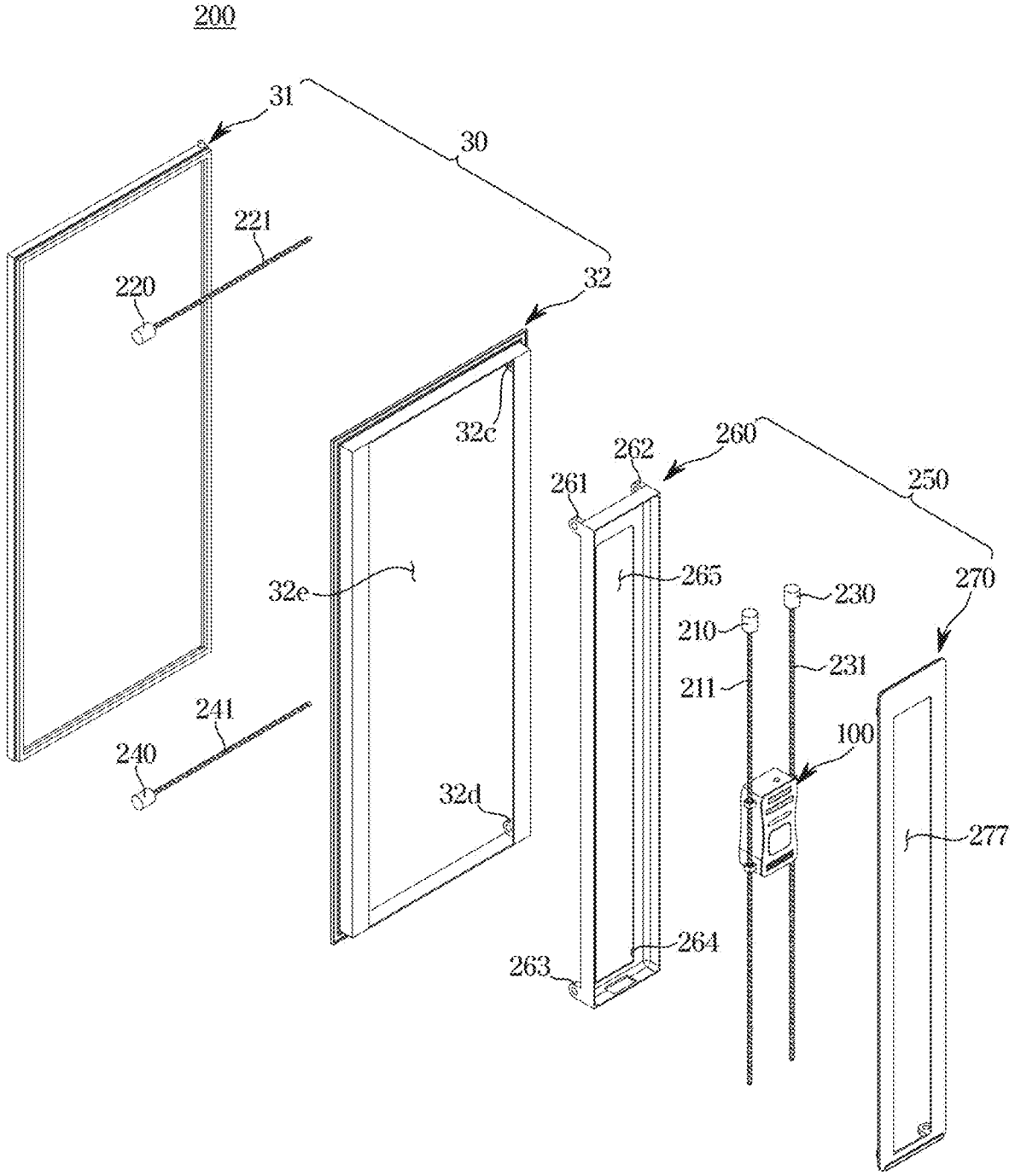
FIG. 12 is an exploded perspective view of a second door and a moving device, according to an embodiment.
Figure 13:
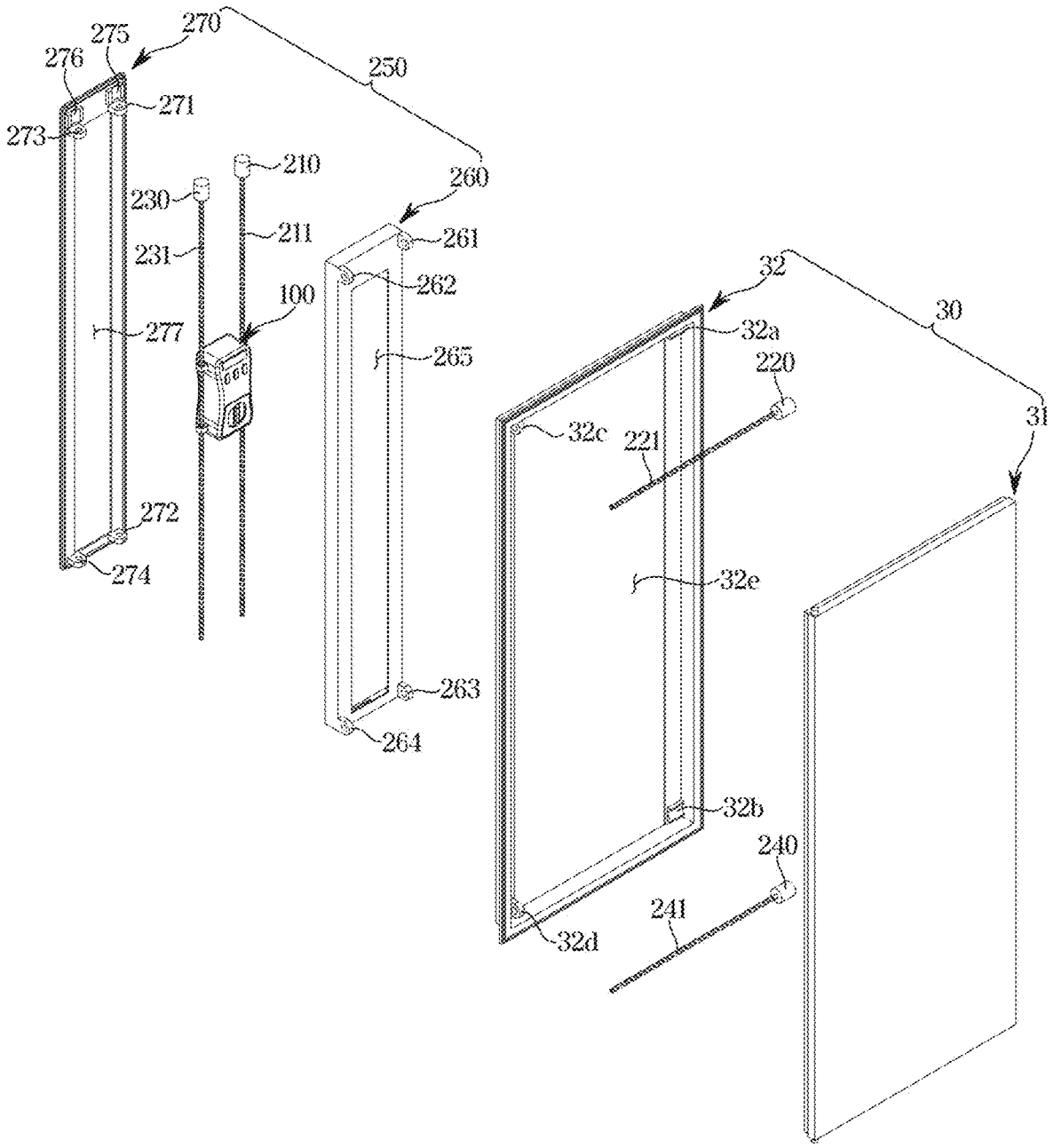
FIG. 13 is an exploded perspective view of the second door and the moving device shown in FIG. 12 at a different angle.

FIG. 12 is an exploded perspective view of a second door and a moving device, according to an embodiment. FIG. 13 is an exploded perspective view of the second door and the moving device shown in FIG. 12 at a different angle.

Referring to FIGS. 12 and 13, in an embodiment, the clothes care apparatus 1 may include the moving device 200 arranged to move the spot cleaning device 100. The moving device 200 may be provided to move the spot cleaning device 100 in the second chamber 22 along the first direction and the second direction. The moving device 200 may be arranged on the rear surface of the second door 30, and may be placed in the second chamber 22 when the second door 30 is closed.

The moving device 200 may include a first motor 210 for providing a driving force for the spot cleaning device 100 to be moved in the first direction, and a second motor 220 for providing driving force for the spot cleaning device 100 to be moved in the second direction. The moving device 200 may include a first shaft 211 extending in the first direction and connected to the first motor 210, and a second shaft 221 extending in the second direction and connected to the second motor 220. The first shaft 211 may be rotated clockwise or counterclockwise by the driving force of the first motor 210. The second shaft 221 may be rotated clockwise or counterclockwise by the driving force of the second motor 220.

In an embodiment, the moving device 200 may further include a third motor 230 for providing a driving force for the spot cleaning device 100 to be moved in the first direction, and a fourth motor 240 for providing a driving force for the spot cleaning device 100 to be moved in the second direction. The moving device 200 may further include a third shaft 231 extending in the first direction and arranged in parallel with the first shaft 211, and a fourth shaft 241 extending in the second direction and arranged in parallel with the second shaft 221. The third shaft 231 may be rotated by receiving the driving force from the third motor 230, and the fourth shaft 241 may be rotated by receiving the driving force from the fourth motor 240. The third motor 230 may provide driving force with the first motor 210 to move the spot cleaning device 100 in the first direction. The fourth motor 240 may provide driving force with the second motor 220 to move the spot cleaning device 100 in the second direction.

In another embodiment, the moving device may only include the first and second motors. In such an embodiment, the moving device may include a first link member connecting the first shaft to the third shaft so that the first shaft and the third shaft are rotated together, and a second link member connecting the second shaft to the fourth shaft so that the second shaft and the fourth shaft are rotated together. When the first motor rotates the first shaft clockwise or counterclockwise, the first shaft and the third shaft may be rotated together clockwise or counterclockwise by the first link member. When the second motor rotates the second shaft clockwise or counterclockwise, the second shaft and the fourth shaft may be rotated together clockwise or counterclockwise by the second link member.

The moving device 200 may include a frame 250 provided to support the spot cleaning device 100. The frame 250 may support the spot cleaning device 100 to be movable in the first direction within the frame 250. The frame 250 may extend in the first direction. The frame 250 may accommodate the spot cleaning device 100, the first motor 210, the third motor 230, the first shaft 211 and the third shaft 231. The frame 250 may be connected to the second shaft 221 and the fourth shaft 241. The frame 250 may move along the second shaft 221 and the fourth shaft 241.

The frame 250 may accommodate the spot cleaning device 100 so that at least a portion of the spot cleaning device 100 is exposed to the second chamber 22. The frame 250 may support the spot cleaning device 100 so that the spot cleaning device 100 is movable within the frame 250. The frame 250 may extend in the first direction, and the spot cleaning device 100 may be moved in the first direction within the frame 250. The spot cleaning device 100 may be moved in the vertical direction within the frame 250.

The frame 250 may include a frame body 260, and a frame cover 270 coupled to the frame body 260.

The frame body 260 may be provided with a first frame hole 265 in which the spot cleaning device 100 is inserted. The spot cleaning device 100 may be inserted to the first frame hole 265. At least a portion of the spot cleaning device 100 may be disposed through the first frame hole 265 and protrude outward from the frame body 260. The first frame hole 265 may extend in the first direction and guide the movement of the spot cleaning device 100 in the first direction. The spot cleaning device 100 may be moved in the first frame hole 265 in the first direction. In another embodiment, the frame body 260 may accommodate the spot cleaning device 100 without including the first frame hole.

The frame body 260 may include a first frame moving part 261 and a second frame moving part 262 connected to the second shaft 221 and arranged to move along the second shaft 221 in the second direction. The first frame moving part 261 and the second frame moving part 262 may be spaced apart in the left and right direction. The first frame moving part 261 may be arranged to be adjacent to the top on one side of the frame body 260 and the second frame moving part 262 may be arranged to be adjacent to the top on the other side of the frame body 260.

The frame body 260 may include a third frame moving part 263 and a fourth frame moving part 264 connected to the fourth shaft 241 and arranged to move along the fourth shaft 241 in the second direction. The third frame moving part 263 and the fourth frame moving part 264 may be spaced apart in the left and right direction. The third frame moving part 263 may be arranged to be adjacent to the bottom on one side of the frame body 260 and the fourth frame moving part 264 may be arranged to be adjacent to the bottom on the other side of the frame body 260.

The frame body 260 may include the first to fourth frame moving parts 261 to 264. Each of the first to fourth frame moving parts 261 to 264 may be provided with a hole formed for the shaft to be disposed therethrough. A screw thread may be formed in the hole of each of the first to fourth frame moving parts 261, 262, 263 and 264 to correspond to a screw thread formed at the second shaft 221 or the fourth shaft 241. In such an embodiment, the first frame moving part 261 and the second frame moving part 262 may move to the left or right with the rotation of the second shaft 221 in one direction, and the first frame moving part 261 and the second frame moving part 262 may move to the right or left with the rotation of the second shaft 221 in the other direction. Likewise, the third frame moving part 263 and the fourth frame moving part 264 may move to the left or right with the rotation of the fourth shaft 241 in one direction, and the third frame moving part 263 and the fourth frame moving part 264 may move to the right or left with the rotation of the fourth shaft 241 in the other direction. The one direction and the other direction may refer to clockwise (CW) and counterclockwise (CCW), respectively.

The frame cover 270 may be coupled to the frame body 260 to cover an open side of the frame body 260. The frame cover 270 may be coupled to the frame body 260 to form an inner space of the frame 250 that accommodates the spot cleaning device 100, the first motor 210, the third motor 230, the first shaft 211 and the third shaft 231.

The frame cover 270 may include first shaft supporters 271 and 272 provided to support the first shaft 211, and third shaft supporters 273 and 274 provided to support the third shaft 231. The frame cover 270 may include a first motor mounting part 275 on which the first motor 210 is mounted, and a third motor mounting part 276 on which the third motor 230 is mounted. The frame cover 270 may include a second frame hole 277 formed by penetrating the frame cover 270 to expose the spot cleaning device 100 to the second chamber 22.

The first shaft supporters 271 and 272 may be coupled to the first shaft 211. The first shaft supporters 271 and 272 may include the first upper supporter 271 arranged to be adjacent to the top on one side of the frame cover 270, and the first lower supporter 272 arranged to be adjacent to the bottom on the one side of the frame cover 270. The first upper supporter 271 and the first lower supporter 272 may each be provided with a hole formed for the first shaft 211 to be disposed therethrough. The first shaft 211 may be rotated within the first upper supporter 271 and the first lower supporter 272. The first shaft 211 may be idled within the first upper supporter 271 and the first lower supporter 272. In other words, even when the first shaft 211 is rotated within the first upper supporter 271 and the first lower supporter 272, the first upper supporter 271 and the first lower supporter 272 may not move in the first direction.

The third shaft supporters 273 and 274 may be coupled to the third shaft 231. The third shaft supporters 273 and 274 may include the second upper supporter 273 arranged to be adjacent to the top on the other side of the frame cover 270, and the second lower supporter 274 arranged to be adjacent to the bottom on the other side of the frame cover 270. The second upper supporter 273 and the second lower supporter 274 may each be provided with a hole formed for the third shaft 231 to be disposed therethrough. The third shaft 231 may be rotated within the second upper supporter 273 and the second lower supporter 274. The third shaft 231 may be idled within the second upper supporter 273 and the second lower supporter 274. In other words, even when the third shaft 231 is rotated within the second upper supporter 273 and the second lower supporter 274, the second upper supporter 273 and the second lower supporter 274 may not move in the first direction.

The first motor 210 may be mounted on the first motor mounting part 275. Although the specific structure is not shown, the first motor mounting part 275 may support the first motor 210 in various structures. For example, the first motor mounting part 275 may include an elastic projection for the first motor 210 to fit into the first motor mounting part 275.

The third motor 230 may be mounted on the third motor mounting part 276. Although the specific structure is not shown, the third motor mounting part 276 may support the third motor 230 in various structures. For example, the third motor mounting part 276 may include an elastic projection for the third motor 230 to fit into the third motor mounting part 276.

The frame cover 270 may include a second frame hole 277 provided for the spot cleaning device 100 to be inserted thereto. The spot cleaning device 100 may be inserted to the second frame hole 277. At least a portion of the spot cleaning device 100 may be disposed through the second frame hole 277 and protrude outward from the frame cover 270. The spot cleaning device 100 may be exposed to the second chamber 22 through the second frame hole 277. The spot cleaning device 22 exposed to the second chamber 22 may partially wash the garment accommodated in the second chamber 22. The second frame hole 277 may extend in the first direction and guide the movement of the spot cleaning device 100 in the first direction. The spot cleaning device 100 may be moved in the second frame hole 277 in the first direction.

The moving device 200 may include a second motor 220 and a fourth motor 240 for providing driving force for the spot cleaning device 100 to be moved in the second direction. The second motor 220 may be connected to the second shaft 221, and the fourth motor 240 may be connected to the fourth shaft 241.

The second motor 220 and the fourth motor 240 may be coupled to the second door 30. The second door 30 may include a door body 31, and a support frame 32 coupled onto the rear side of the door body 31. The door body 31 may be pivotally coupled to the first door 20. The door body 31 may open or close the second chamber 22.

The second motor 220 and the fourth motor 240 may be mounted on the support frame 32 of the second door 30. The second motor 220 may be mounted in a second motor mounting part 32*a* on the support frame 32. The second motor mounting part 32*a* may be arranged to be adjacent to the top on one side of the support frame 32. Although the specific structure is not shown, the second motor mounting part 32*a* may support the second motor 220 in various structures. For example, the second motor mounting part 32*a* may include an elastic projection for the second motor 220 to fit into the second motor mounting part 32*a*. The fourth motor 240 may be mounted in a fourth motor mounting part 32*b* on the support frame 32. The fourth motor mounting part 32*b* may be arranged to be adjacent to the bottom on the one side of the support frame. Although the specific structure is not shown, the fourth motor mounting part 32*b* may support the fourth motor 240 in various structures. For example, the fourth motor mounting part 32*b* may include an elastic projection for the fourth motor 240 to fit into the fourth motor mounting part 32*b*.

The second shaft 221 may be coupled with a second shaft supporter 32*c* on the support frame 32. The second shaft supporter 32*c* may be arranged to be adjacent to the top on the other side of the support frame 32. The second shaft supporter 32*c* may be provided with a hole formed for the second shaft 221 to be disposed therethrough. The second shaft 221 may be idled within the second shaft supporter 32*c*. In other words, even when the second shaft 221 is rotated within the second shaft supporter 32*c*, the second shaft supporter 32*c* may not move along the second direction.

The fourth shaft 241 may be coupled with a fourth shaft supporter 32*d* on the support frame 32. The fourth shaft supporter 32*d* may be arranged to be adjacent to the bottom on the other side of the support frame 32. The fourth shaft supporter 32*d* may be provided with a hole formed for the fourth shaft 241 to be disposed therethrough. The fourth shaft 241 may be idled within the fourth shaft supporter 32*d*. In other words, even when the fourth shaft 241 is rotated within the fourth shaft supporter 32*d*, the fourth shaft supporter 32*d* may not move along the second direction.

The support frame 32 may include a support frame hole 32*e* formed by penetrating the support frame 32 so that the frame 250 may move in the second direction within the support frame 32. The frame 250 may move in the support frame hole 32*e* in the second direction.

As described above, the spot cleaning device 100 may be moved in the first direction within the frame 250. The frame 250 that accommodates the spot cleaning device 100 may be moved in the second direction within the support frame 32 on the second door 30. With this, the spot cleaning device 100 may be moved in the first and second directions. In other words, the spot cleaning device 100 may be moved upward, downward, to the left or right in the second chamber 22.

Figure 14:
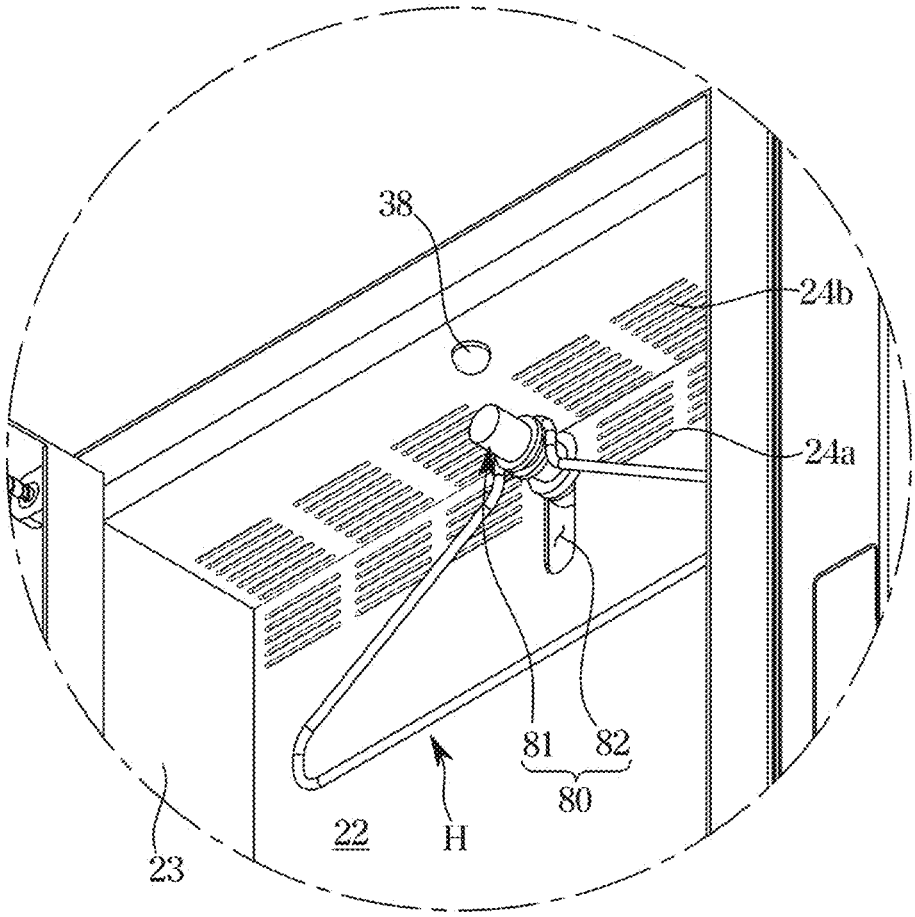
FIG. 14 illustrates a second chamber, according to an embodiment.
Figure 15:
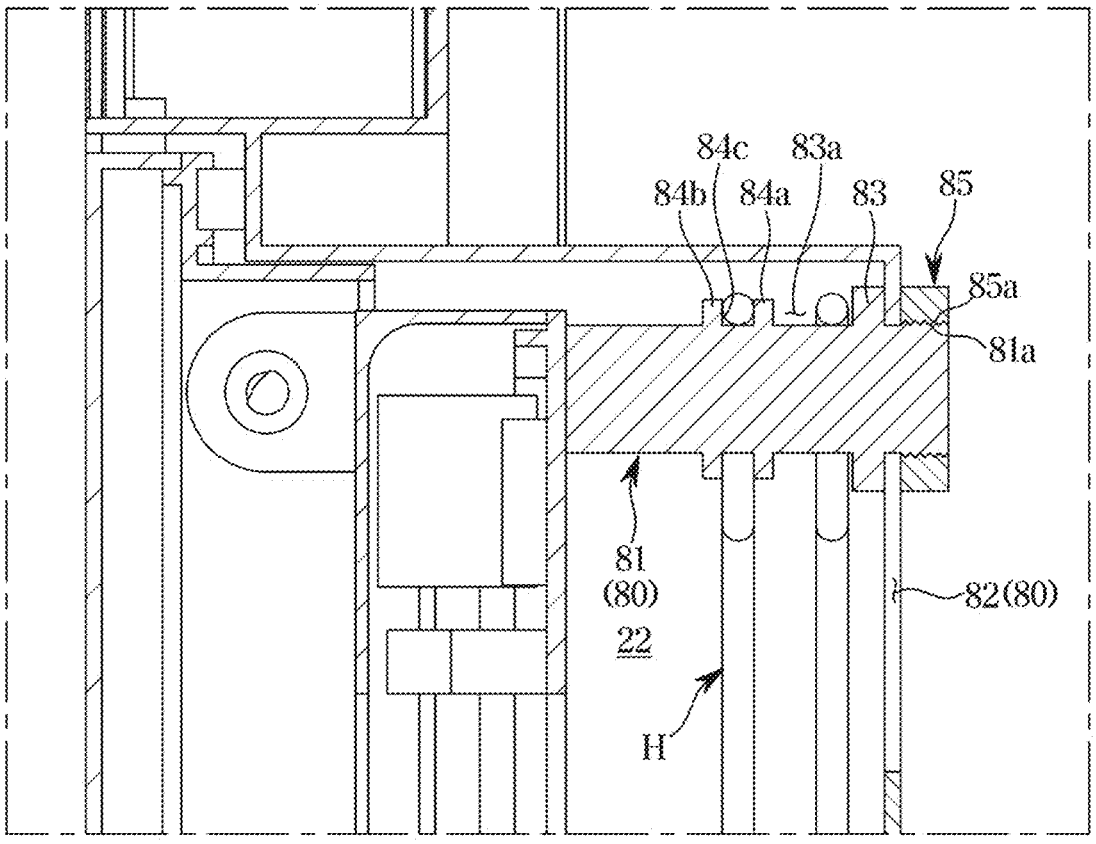
FIG. 15 is an enlarged view of the encircled portion B of FIG. 4.
Figure 16:
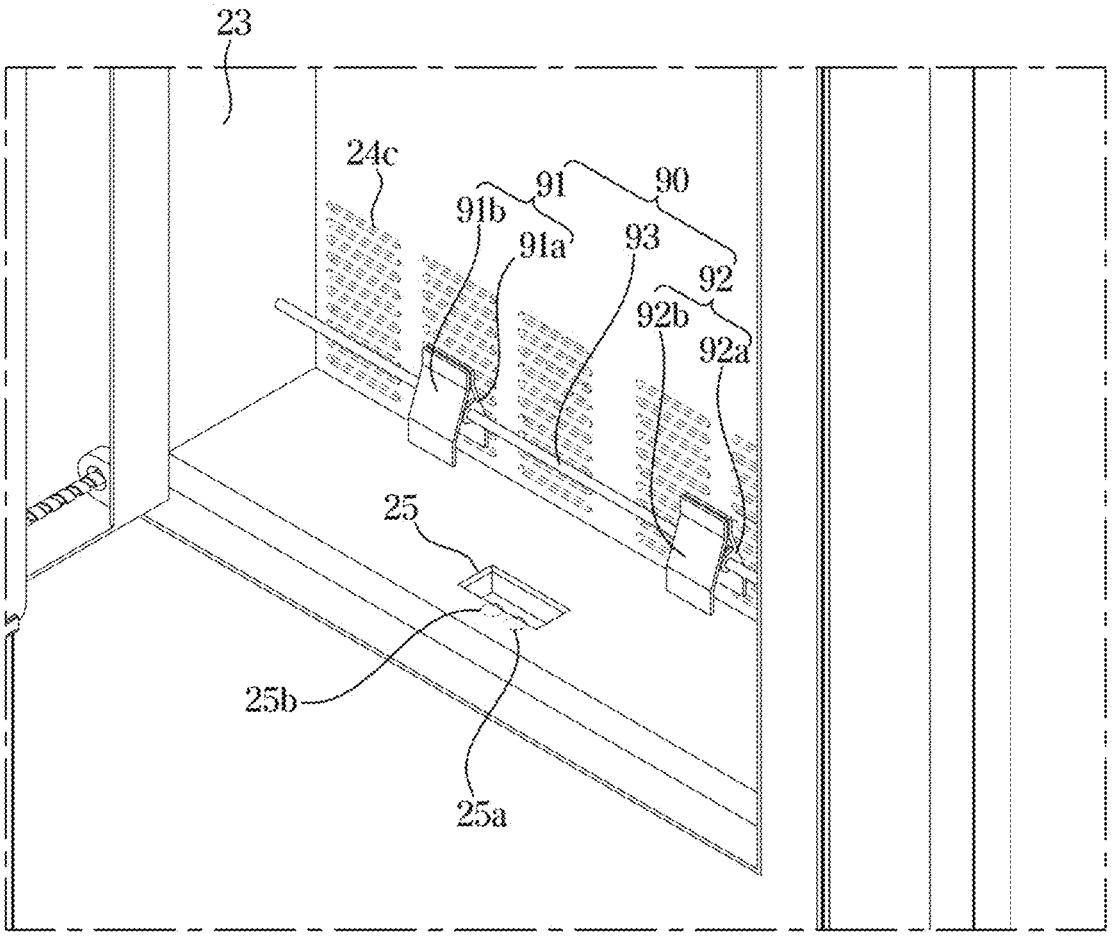
FIG. 16 is an enlarged view of the encircled portion A of FIG. 3.

FIG. 14 illustrates a second chamber, according to an embodiment. FIG. 15 is an enlarged view of the encircled portion B of FIG. 4. FIG. 16 is an enlarged view of the encircled portion A of FIG. 3.

Referring to FIGS. 14 to 16, an embodiment of the clothes care apparatus 1 may include a supporter 80 and a fixer 90 arranged in the second chamber 22.

There may be a lighting device 38 provided in the second chamber 22. For example, the lighting device 38 may be arranged on the upper end of the case 23 that forms the second chamber 22.

The supporter 80 may be arranged to be adjacent to the top of the second chamber 22. The supporter 80 may be provided to support hangers (H) or support the garment, as shown in FIG. 14. The supporter 80 may be arranged to be movable in the vertical direction.

The supporter 80 may provided with a guide hole 82 extending vertically, and a support member 81 arranged to be vertically movable along the guide hole 82 and fixed at a position in the guide hole 82.

The guide hole 82 may be formed on the rear surface of the second chamber 22. The guide hole 82 may be formed at a location adjacent to the top of the rear surface of the second chamber 22. The guide hole 82 may extend vertically. The support member 81 may be vertically movable within the guide hole 82. Hence, the guide hole 82 may define a vertical movement range of the support member 81. In an embodiment, the vertical extension length of the guide hole 82 may be increased to increase the vertical movement range of the support member 81.

The supporter 80 may include a coupling member 85 coupled to the support member 81 to fix the support member 81 at one position within the guide hole 82. The coupling member 85 may be coupled to the support member 81 from outside of the second chamber 22. The coupling member 85 may be coupled to the support member 81 by being turned.

For example, the coupling member 85 may correspond to a nut and the support member 81 may correspond to a bolt. The coupling member 85 may include a screw thread 85*a* on the inside, and the support member 81 may include a screw thread 81*a* on the outside.

The support member 81 may include a first groove 83*a* and a second groove 84*c* formed for at least a portion of the hanger H to be inserted thereto. The support member 81 may include a first projection 83 and a second projection 84*a* that radially protrude from the support member 81 to form the first groove 83*a*. The support member 81 may include a third projection 84*b* that radially protrudes from the support member 81 to form the second groove 84*c*. The first groove 83*a* may be formed between the first projection 83 and the second projection 84*a*, and the second groove 84*c* may be formed between the second projection 84*a* and the third projection 84*b*.

The first groove 83*a* may have a larger width than the second groove 84*c* in the forward and backward directions. The forward and backward direction may refer to the left and right direction of FIG. 15 The user may put the hanger H in the second groove 84*c* to fix the hanger H in the forward and backward directions. The user may put the hanger in the first groove 83*a* when the hanger is too thick to fit into the second groove 84*c*. That is, the hanger H may be hung in the second chamber 22 by putting the hanger H in the first groove 83*a* or the second groove 84*c* according to a choice of the user.

Referring to FIG. 16, the clothes care apparatus 1 may include the fixer 90 arranged to fix the garment accommodated in the second chamber 22.

The fixer 90 may be provided to hold and fix at least a portion of the garment. The fixer 90 may include a bar 93 arranged to be adjacent to the bottom of the second chamber 22 and provided to horizontally cross the second chamber 22, and fixing members 91 and 92 provided to be horizontally movable along the bar 93.

The fixing members 91 and 92 may be provided to hold and fix the garment. In an embodiment, the fixing members 91 and 92 may include two first fixing member, i.e., the first fixing member 91 and the second fixing member 92. Alternatively, there may be one or three or more fixing members.

The first fixing member 91 may include a first moving member 91*a* provided to be horizontally movable along the bar 93 and a first rotating member 91*b* rotationally coupled with the first moving member 91*a*. The first rotating member 91*b* may be elastically biased in a direction approaching the first moving member 91*a*. In an embodiment, the first fixing member 91 may include an elastic member (not shown).

The second fixing member 92 may include a second moving member 92*a* provided to be horizontally movable along the bar 93 and a second rotating member 92*b* rotationally coupled with the second moving member 92*a*. The second rotating member 92*b* may be elastically biased in a direction approaching the second moving member 92*a*. In an embodiment, the second fixing member 92 may include an elastic member (not shown).

In an embodiment, the bar 93 may be fixed to a position adjacent to the bottom of the second chamber 22. As the support member 81 is arranged to be vertically movable within the guide hole 82 even when the bar 93 is fixed, the support member 81 or the hanger H hung on the support member 81 may support an upper portion of the garment and the fixing members 91 and 92 may fix a lower portion of the garment. When the garment is short in vertical direction, the support member 81 is moved downward so that the support member 81 or the hanger H hung on the support member 81 may support the upper portion of the garment and the fixing members 91 and 92 may fix the lower portion of the garment. In order to fix upper and lower portions of the garment having various sizes, the bar 93 may be provided to be movable vertically.

In such an embodiment, the garment accommodated in the second chamber 22 may be pulled tightly in the vertical direction by using the supporter 80 and the fixer 90 included in the clothes care apparatus 1. The supporter 80 may fix the upper portion of the garment and the fixer 90 may hold and fix the lower portion of the garment, so that the garment may remain in the tightly pulled state. This may facilitate spot cleaning of the spot cleaning device 100 and increase the cleaning efficiency of the spot cleaning device 100.

Referring to FIG. 16, a home position part 25 may be arranged at the second chamber 22. Charging terminals 25*a* and 25*b* may be arranged in the home position part 25 to charge the battery of the spot cleaning device 100. The charging terminals 25*a* and 25*b* may include the positive electrode 25*a* and the negative electrode 25*b*.

The spot cleaning device 100 may be docked to the home position part 25 such that the charging terminals 115*a* and 115*b* of the spot cleaning device 100 come into contact with the charging terminals 25*a* and 25*b* arranged in the home position part 25 of the first door 20, respectively. The spot cleaning device 100 may be docked to the home position part 25, may charge the battery 118*b*, and then clean the target portion of the garment accommodated in the second chamber 22 under an instruction of the controller 300 (see FIG. 17).

Figure 17:
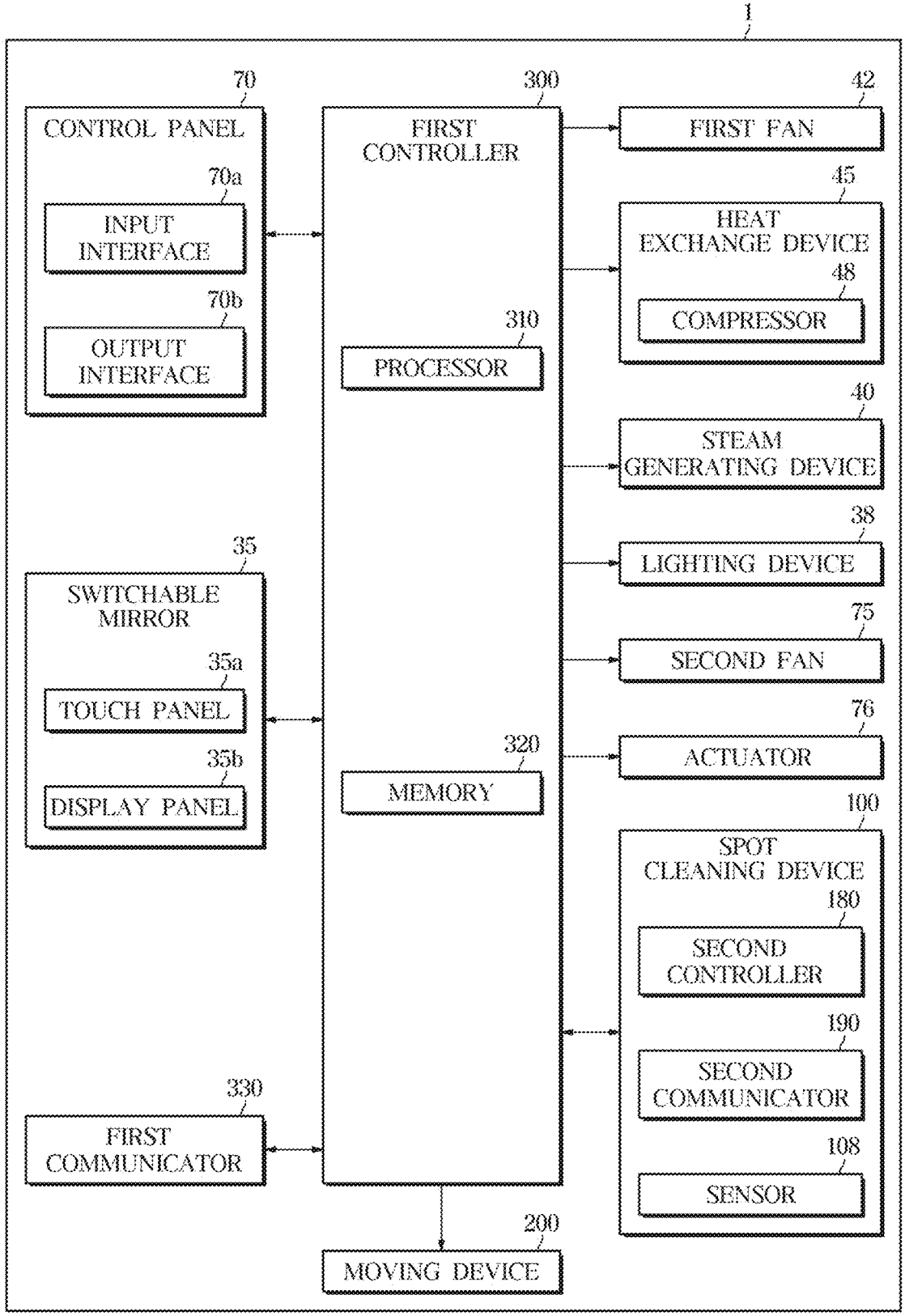
FIG. 17 is a control block diagram of a clothes care apparatus, according to an embodiment.

FIG. 17 is a control block diagram of a clothes care apparatus, according to an embodiment.

Referring to FIG. 17, the clothes care apparatus 1 according to an embodiment may include the switchable mirror 35, the control panel 70, the heat exchange device 45, the first fan 42, the steam generating device 40, the second fan 75, an actuator 76, the lighting device 78, the spot cleaning device 100, the moving device 200, a communicator 330 and/or a first controller 300.

The switchable mirror 35 may operate in a mirror mode and a transparent mode.

The mirror mode may refer to a mode to reflect most incident light, and the transparent mode may refer to a mode to transmit most incident light. The transparent mode may include a fully transparent mode and/or a transparent display mode. The fully transparent mode may refer to a mode to transmit most incident light without displaying any image, and the transparent display mode may refer to a mode to transmit most incident light while displaying an image.

The switchable mirror 35 may operate in the mirror mode or the transparent mode based on a control signal of the first controller 300.

Figure 18:
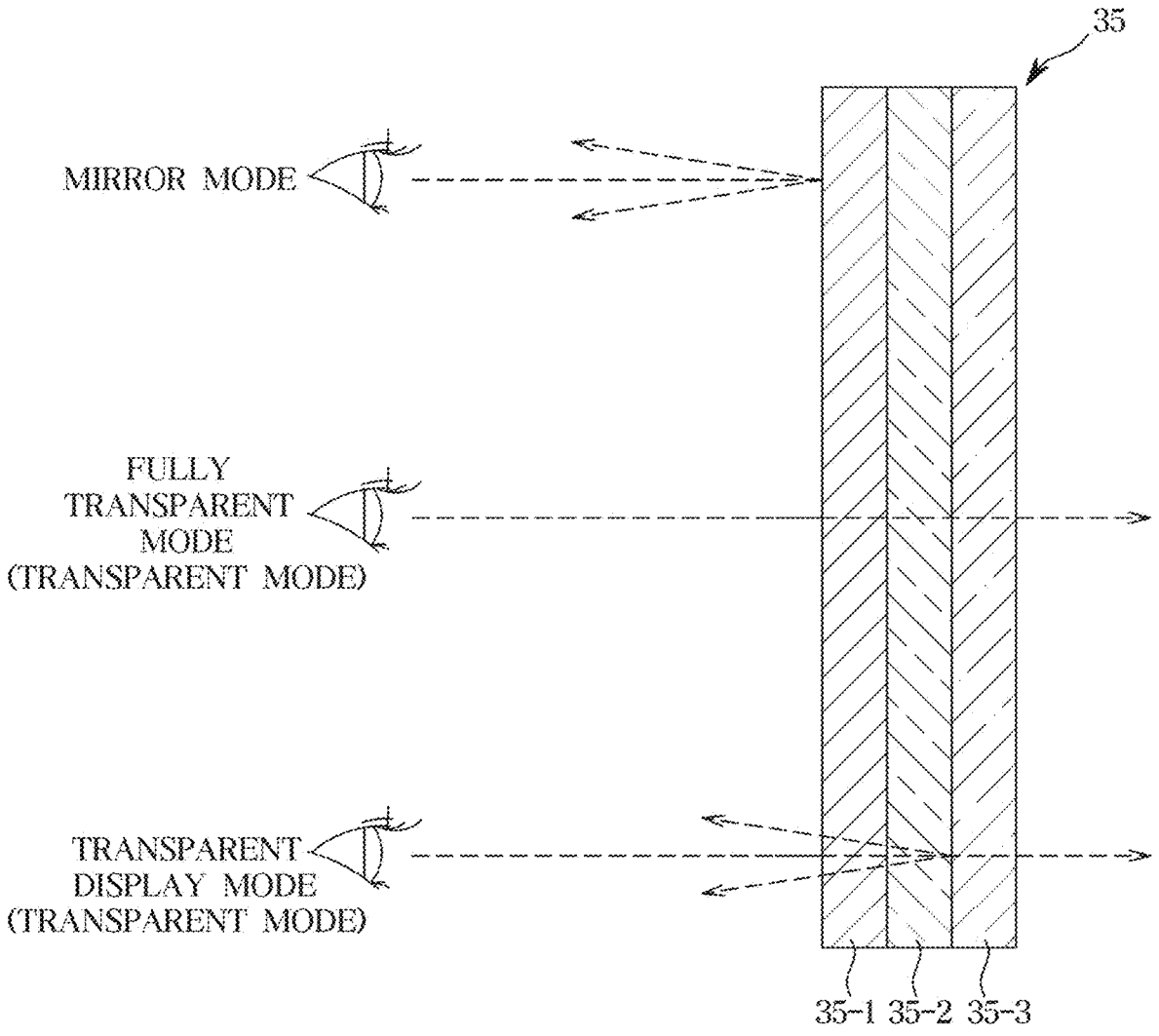
FIG. 18 is a diagram for describing a switchable mirror, according to an embodiment.

FIG. 18 is a diagram for describing a switchable mirror, according to an embodiment.

Referring to FIG. 18, an embodiment of the switchable mirror 35 may include a first layer 35-1, a second layer 35-2 and a third layer 35-3.

The first layer 35-1, the second layer 35-2 and the third layer 35-3 may be sequentially stacked in a rearward direction from the front of the clothes care apparatus 1.

The first layer 35-1 may include a transparent mirror that is operable in the mirror mode and the transparent mode. The first layer 35-1 may include a first polarizing plate, a first transparent electrode (transparent conductive oxide (TCO)), a liquid crystal layer, a second transparent electrode and a second polarizing plate.

The first layer 35-1 may operate in the mirror mode or the transparent mode depending on the voltage applied to the liquid crystal layer. When the first layer 35-1 operates in the transparent mode, the light irradiated toward the first layer 35-1 may penetrate the first layer 35-1. When the first layer 35-1 operates in the mirror mode, the light irradiated toward the first layer 35-1 may be mostly reflected by the first layer 35-1.

The second layer 35-2 may include a transparent display. The transparent display may include a display panel 35*b*. The transparent display may include an LCD display, a micro LED display and/or an OLED display.

In an embodiment where the second layer 35-2 includes the transparent LCD display, the switchable mirror 35 may further include an edge-type backlight unit.

In an embodiment where the second layer 35-2 is implemented as a transparent LCD display, the second layer 35-2 may include a first polarizing plate, a first transparent electrode, a transparent color filter, a liquid crystal layer, a second transparent electrode and a second polarizing plate. The display panel 35*b* may include the liquid crystal layer.

In an embodiment where the second layer 35-2 is implemented as the transparent micro LED display, the second layer 35-2 may include the first polarizing plate, the first transparent electrode, a light emitting layer, the transparent color filter, the second transparent electrode and the second polarizing plate. The display panel 35*b* may include the light emitting layer. The light emitting layer may include a plurality of micro LEDs.

In an embodiment where the second layer 35-2 is implemented as a transparent OLED display, the second layer 35-2 may include the first polarizing plate, the first transparent electrode, the light emitting layer, the second transparent electrode and the second polarizing plate. The display panel 35*b* may include the light emitting layer. The light emitting layer may include a plurality of OLEDs.

The display panel 35*b* of the second layer 35-2 may output an image based on a control signal of the first controller 300.

The third layer 35-3 may operate in a transparent mode to transmit light and an opaque mode to reflect light.

The third layer 35-3 may include a polyethylene terephthalate (PET) film and a polymer dispersed liquid crystal (PDLC) film.

The third layer 35-3 may operate in the transparent mode or the opaque mode depending on the voltage applied to the PDLC film. The opaque mode may be replaced by a black mode.

When both the first layer 35-1 and the third layer 35-3 operate in the transparent mode, the switchable mirror 35 may operate in the transparent mode. The transparent mode may include a fully transparent mode and a transparent display mode.

When the second layer 35-2 outputs an image while both the first layer 35-1 and the third layer 35-3 are operating in the transparent mode, the switchable mirror 35 may operate in the transparent display mode, and when the second layer 35-2 outputs no image while both the first layer 35-1 and the third layer 35-3 are operating in the transparent, the switchable mirror 35 may operate in the fully transparent mode.

When the first layer 35-1 operates in the mirror mode and the third layer 35-3 operates in the opaque mode, the switchable mirror 35 may operate in the mirror mode.

In various embodiments, the switchable mirror 35 may be implemented only by the first layer 35-1. When the switchable mirror 35 includes only the first layer 35-1, the switchable mirror 35 operating in the transparent mode may mean that it operates in the fully transparent mode.

In various embodiments, the switchable mirror 35 may be implemented only by the first layer 35-1 and the third layer 35-3. When the switchable mirror 35 includes only the first layer 35-1 and the third layer 35-3, the switchable mirror 35 operating in the transparent mode may mean that it operates in the fully transparent mode.

In various embodiments, the switchable mirror 35 may be implemented only by the first layer 35-1 and the second layer 35-2.

In an embodiment, the switchable mirror 35 may include a touch panel 35*a*. For example, the first layer 35-1, the second layer 35-2 and/or the third layer 35-3 may include the touch panel 35*a*.

The touch panel 35*a* may detect a touch input of the user.

In an embodiment, the switchable mirror 35 may constitute the front of the second door 30. When the switchable mirror 35 operates in the transparent mode, the user is able to observe the garment in the second chamber 22 without opening the second door 30. As will be described later, as the user is allowed to look at the garment in the second chamber without opening the second door 30, the user may easily set up a target portion.

When the switchable mirror 35 operates in the mirror mode, the user may use the clothes care apparatus 1 as a mirror.

Furthermore, as the switchable mirror 35 includes the touch panel to make room for receiving user inputs in addition to the control panel 70.

The control panel 70 may include at least one input interface 70*a* and at least one output interface 70*b*.

The at least one input interface 70*a* may convert sensory information received from the user into an electric signal.

Figure 19A:
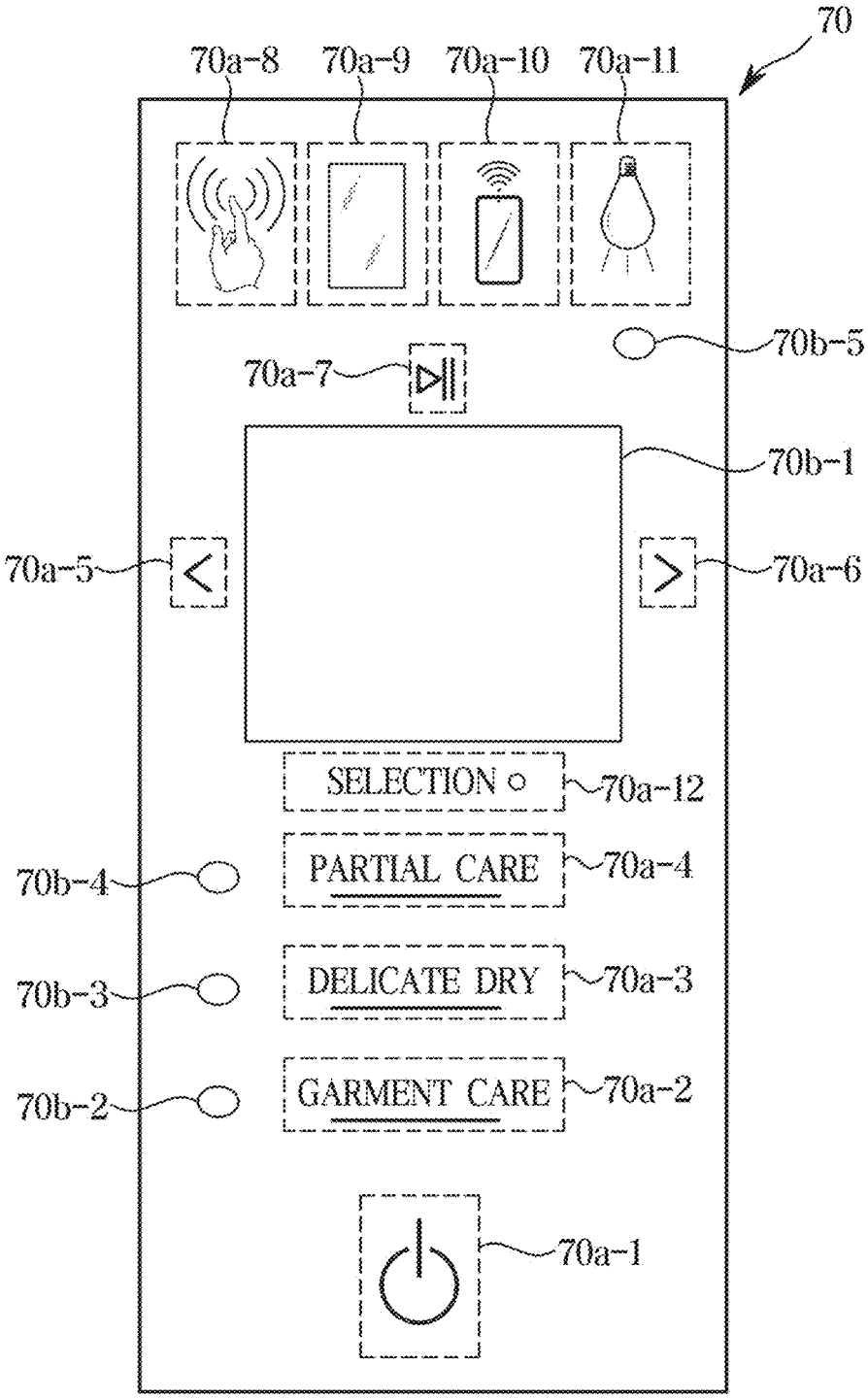
FIG. 19A illustrates an example of a control panel, according to an embodiment.

FIG. 19A illustrates an example of a control panel, according to an embodiment.

Referring to FIG. 19A, the at least one input interface 70*a* may include a power button 70*a*-1, course selection buttons 70*a*-2, 70*a*-3 and 70*a*-4, direction selection buttons 70*a*-5 and 70*a*-6, a start/pause button 70*a*-7, a second door 30 open button 70*a*-8, a mirror switching button 70*a*-9, a communication button 70*a*-10, a lighting button 70*a*-11 and/or a selection button 70*a*-12.

Each button may include a visual indicator (e.g., text, an icon, etc.) that may indicate the function corresponding thereto.

The at least one input interface 70*a* may include, for example, a tact switch, a push switch, a slide switch, a toggle switch, a micro switch, a touch switch, a touch pad, a touch screen, a jog dial and/or a microphone.

In the disclosure, the term button may be replaced by a user interface (UI) element, a tact switch, a push switch, a slide switch, a toggle switch, a micro switch, a touch switch, a touch pad, a touch screen, a jog dial and/or a microphone.

The at least one output interface 70*b* may send various information relating to the operation of the clothes care apparatus 1 to the user by generating sensory information.

For example, the at least one output interface 70*b* may send information relating to a garment care course, operation time of the clothes care apparatus 1, target portion settings for partial care, etc., to the user. The information relating to the operation of the clothes care apparatus 1 may be output through a display 70*b*-1, an indicator 70*b*-2, 70*b*-3, 70*b*-4 or 70*b*-5, voice, etc. The at least one output interface 70*b* may include, for example, a liquid crystal display (LCD) panel, an indicator, a light emitting diode (LED) panel, a speaker, etc.

The display 70*b*-1 may output information relating to a garment care course, operation time of the clothes care apparatus 1, target portion settings for partial care, etc. The display 70*b*-1 may include a touch panel for receiving the user's touch input.

The indicator 70*b*-2, 70*b*-3, 70*b*-4 or 70*b*-5 may visually indicate operation status of the clothes care apparatus 1 to the user.

The garment care indicator 70*b*-2 may be turned on during operation of a garment care course.

The delicate dry indicator 70*b*-3 may be turned on during operation of a delicate dry course.

The partial care indicator 70*b*-4 may be turned on during operation of a partial care course.

The lighting indicator 70*b*-5 may be turned on during operation of the lighting device 38.

The power button 70*a*-1 is a button to power on or off the clothes care apparatus 1.

The course selection buttons 70*a*-2, 70*a*-3 and 70*a*-4 are buttons to select a course of the clothes care apparatus 1.

The course selection buttons 70*a*-2, 70*a*-3 and 70*a*-4 may include the buttons 70*a*-2 and 70*a*-3 to select a course for caring the garment accommodated in the first chamber 11 and the button 70*a*-4 to select a course for caring the garment accommodated in the second chamber 22.

The buttons to select a course for caring the garment accommodated in the first chamber 11 may include the garment care button 70*a*-2.

Once the garment care button 70*a*-2 is selected, at least one course corresponding to garment care may be displayed on the output interface 70*b* (e.g., the display 70*b*-1) and the user may select a desired course by using the direction selection button 70*a*-5 or 70*a*-6. The at least one course may include various courses such as a standard course, a large-volume care course, a sterilization course, a fine dust course, a quick course, a school uniform course, a denim course, a coat course, a wool/knit course, a suit course, etc.

The buttons to select a course for caring the garment accommodated in the first chamber 11 may include the delicate dry button 70*a*-2.

Once the delicate dry button 70*a*-2 is selected, at least one course corresponding to delicate dry may be displayed on the output interface 70*b* (e.g., the display 70*b*-1) and the user may select a desired course by using the direction selection button 70*a*-5 or 70*a*-6. The at least one course may include various courses such as a customized dry course, a shirts course, a swimsuit course, an outdoor wear course, fitness wear course, a blouse course, a denim course, a coat course, a wool/knit course, a suit course, a space dehumidification course, etc.

Once the start button 70*a*-7 is selected after a course for caring the garment is selected, the first controller 300 may perform the selected course by controlling a component (e.g., the heat exchange device 45, the steam generating device 40, the first fan 42 and/or the second fan 75) of the clothes care apparatus 1 according to an algorithm for the selected course.

In the disclosure, as the second chamber 22 includes the air current inlets 24*a* and 24*b* and the air current outlet 24*c*, the garment accommodated in the second chamber 22 may also be cared when a course for caring the garment accommodated in the first chamber 11 is performed.

Accordingly, it is also possible for the user to select a course for caring the garment accommodated in the first chamber 11 in order to care the garment accommodated in the second chamber 22.

The button 70*a*-4 to select a course for caring the garment accommodated in the second chamber 22 may include the partial care button 70*a*-4.

The partial care button 70*a*-4 is a button to select a course for partially caring the garment accommodated in the second chamber 22 by using the spot cleaning device 100.

Once the partial care button 70*a*-4 is selected, an interface for controlling the spot cleaning device 100 may be provided on the output interface 70*b* (e.g., the display 70*b*-1).

For example, once the partial care button 70*a*-4 is selected, an interface for setting up a target portion may be provided on the output interface 70*b* (e.g., the display 70*b*-1).

The direction selection buttons 70*a*-5 and 70*a*-6 may include the left button 70*a*-5 and the right button 70*a*-6. In various embodiments, it is also possible that the direction selection buttons 70*a*-5 and 70*a*-6 include the top button and the bottom button or that one of the buttons is omitted.

The direction selection buttons 70*a*-5 and 70*a*-6 are buttons to manipulate an interface provided through the display 70*b*-1. For example, the direction selection buttons 70*a*-5 and 70*a*-6 may be used to change the selection of a UI element provided by the display 70*b*-1.

In an embodiment, the direction selection button 70*a*-5 and 70*a*-6 may be used to set up a target portion for the partial care course.

The start/pause button 70*a*-7 is a button to start the selected course or pause the course in operation.

The second door 30 open button 70*a*-8 is a button to automatically open the second door 30.

The mirror switching button 70*a*-9 is a button to switch the operation mode of the switchable mirror 35. The mirror switching button 70*a*-9 may receive a user input to switch the switchable mirror 35 into the transparent mode or the mirror mode.

For example, when the mirror switching button 70*a*-9 is selected while the switchable mirror 35 is operating in the mirror mode, the switchable mirror 35 may operate in the transparent mode. On the other hand, when the mirror switching button 70*a*-9 is selected while the switchable mirror 35 is operating in the transparent mode, the switchable mirror 35 may operate in the mirror mode.

The communication button 70*a*-10 is a button to set up communication of the clothes care apparatus 1. The clothes care apparatus 1 may access a nearby access point (AP) through the communication button 70*a*-10. The clothes care apparatus 1 may communicate with an external device such as a server, a user equipment, another home appliance, etc., through the nearby AP.

The lighting button 70*a*-11 is a button to turn on/off the lighting device 38.

When the lighting button 70*a*-11 is selected, an interface for setting the lighting device 38 may be provided on the display 70*b*-1, and intensity of the output light of the lighting device 38 and/or color of the output light may be adjusted through the interface for setting the lighting device 38.

The selection button 70*a*-12 is a button to manipulate an interface provided by the display 70*b*-1. For example, the selection button 70*a*-12 may be used to select a UI element provided by the display 70*b*-1.

In an embodiment of the disclosure, various buttons included on the control panel 70 are not limited to the above example, and it is obvious that some of the buttons may be omitted or certain buttons may be added thereto.

For example, the control panel 70 may further include an interface button for displaying the user interface 36 associated with the spot cleaning device 100 on the switchable mirror 35 or not displaying the user interface 36 from the switchable mirror 35, which will be described later.

The heat exchange device 45 may include the compressor 48 for compressing the refrigerant to heat the air supplied into the first chamber 11. The compressor 48 may operate based on a control signal of the first controller 300.

The first fan 42 may force the air in the first chamber 11 to pass through the machine room 13, the evaporator 46 and the condenser 47 and to be released back into the first chamber 11. The first fan 42 may be operated based on a control signal of the first controller 300.

The steam generating device 40 may spray steam into the first chamber 11. The steam generating device 40 may operate based on a control signal of the first controller 300.

The second fan 75 may force the air in the first chamber 11 to circulate through the second air current outlet 12*b* or the garment support member 50 back into the first chamber 11. The second fan 75 may be operated based on a control signal of the first controller 300.

The actuator 76 may open the second door 30. The actuator 76 may operate based on a control signal of the first controller 300. For example, the actuator 76 may include a member such as an electromagnet or a link member or may include any component that is able to push the second door 30.

The lighting device 38 may provide light for the second chamber 22. The lighting device 38 may include a smart bulb that may control intensity and/or color of the output light. The lighting device 38 may operate based on a control signal of the first controller 300.

The clothes care apparatus 1 may include the first communicator 330 for communicating with an external device (e.g., a server, a user equipment, the spot cleaning device 100 and/or a home appliance) wiredly and/or wirelessly.

The first communicator 330 may include at least one of a short-range communication module or a long-range communication module.

The first communicator 330 may transmit data to the external device or receive data from the external device. For example, the first communicator 330 may establish communication with the server, the user equipment and/or the other home appliance to transmit or receive various data.

In an embodiment, the first communicator 330 may support establishment of a direct (e.g., wired) communication channel or a wireless communication channel with the external device, and communication through the established communication channel. In an embodiment, the first communicator 330 may include a wireless communication module (e.g., a cellular communication module, a short-range wireless communication module or a global navigation satellite system (GNSS) communication module) or a wired communication module (e.g., a local area network (LAN) communication module or a power-line communication module). A corresponding one of the communication modules may communicate with an external device over a first network (e.g., a short-range communication network such as Bluetooth, wireless-fidelity (Wi-Fi) direct or infrared data association (IrDA)) or a second network (e.g., a remote communication network such as a legacy cellular network, a fifth generation (5G) network, a next generation communication network, the Internet, or a computer network (e.g., a LAN or wide area network (WAN)). These various types of communication modules may be integrated into a single component (e.g., a single chip) or implemented as a plurality of separate components (e.g., a plurality of chips).

The short-range communication module may include a Bluetooth communication module, a Bluetooth low energy (BLE) communication module, a near field communication (NFC) module, a WLAN, e.g., Wi-Fi, communication module, a Zigbee communication module, an infrared data association (IrDA) communication module, a Wi-Fi direct (WFD) communication module, an ultrawideband (UWB) communication module, an Ant+ communication module, a microwave (uWave) communication module, etc., without being limited thereto.

The long-range communication module may include a communication module for performing various types of long-range communication and include a first mobile communicator 330. The first mobile communicator 330 transmits or receives wireless signals to and from at least one of a base station, an external terminal, or a server in a mobile communication network.

In an embodiment, the first communicator 330 may communicate with an external device such as a server, a user equipment, another home appliance, etc., through a nearby AP. The AP may connect a LAN connected to the clothes care apparatus 1, another home appliance and/or user equipment to a WAN connected to the server. The clothes care apparatus 1, the other home appliance and/or the user equipment may be connected to the server through the WAN.

The spot cleaning device 100 may be arranged in the second chamber 22 to do the partial wash (spot cleaning) on the garment received in the second chamber 22.

The spot cleaning device 100 may include the second controller 180 for controlling the components of the spot cleaning device 100 (e.g., the water sprayer 101, the washing fluid sprayer 102, the vibrator 103, the suction part 103, the roller 105 and/or the at least one sensor 108) and the second communicator 190 for communicating with an external device (e.g., a server, a user equipment, the first communicator 330 and/or a home appliance).

The second communicator 190 included in the spot cleaning device 100 may communicate with the first communicator 330 of the clothes care apparatus 1 wiredly or wirelessly.

In an embodiment, when the second communicator 190 included in the spot cleaning device 100 performs wireless communication with the first communicator 330 of the clothes care apparatus 1, a wire for connecting the cabinet 10 of the clothes care apparatus 1 may be dispensed to the spot cleaning device 100, thereby effectively preventing the wire from spoiling the appearance inside the second chamber 22.

The controlling of the spot cleaning device 100 by the first controller 300 may include transmitting a control command to the second controller 180 by the first controller 300.

The second communicator 190 may communicate with the first communicator 330 of the clothes care apparatus 1 to forward the control command sent from the first controller 300 to the second controller 180.

The second controller 180 may control the components of the spot cleaning device 100 based on the control command forwarded from the first controller 300.

The moving device 200 may move the spot cleaning device 100.

In various embodiments, the moving device 200 may receive a control command from the second controller 180. That is, the second controller 180 may control the moving device 200. The moving device 200 may include a third controller (not shown) for controlling the first to fourth motors and a wired or wireless third communicator (not shown) for performing wired or wireless communication.

For example, when the first controller 300 sends a movement control signal to the spot cleaning device 100, the second controller 180 of the spot cleaning device 100 may control the moving device 200 to move the spot cleaning device 100. In another example, the motor of the moving device 200 may be connected to the second controller 180 of the spot cleaning device 100 by a cable and may be controlled directly by the second controller 180.

In various embodiments, the moving device 200 may receive a control command from the first controller 300. That is, the first controller 300 may control the moving device 200. For example, the first controller 300 may control the spot cleaning device 100 to move the spot cleaning device 100.

In the disclosure, the controlling of the spot cleaning device 100 may include controlling not only the components (e.g., the water sprayer 101, the washing fluid sprayer 102, the vibrator 103, the suction part 104 and/or the at least one sensor 108) of the spot cleaning device 100 but also the moving device 200 to control movement of the spot cleaning device 100.

In an embodiment, the spot cleaning device 100 may include at least one sensor 108. Sensor data collected from the at least one sensor 108 may be sent to the first controller 300. For example, the sensor 108 of the spot cleaning device 100 may include a camera, and image data collected from the camera may be sent to the first controller 300.

The first controller 300 may control various components (e.g., the switchable mirror 35, the control panel 70, the heat exchange device 45, the first fan 42, the steam generating device 40, the second fan 75, the actuator 76, the lighting device 38, the spot cleaning device 100, the moving device 200, and the first communicator 330) of the clothes care apparatus 1. The first controller 300 may control the various components of the clothes care apparatus 1 to perform a garment care course or a partial care course based on a user input. For example, the first controller 300 may control the heat exchange device 45 and the first fan 42 to supply hot air into the first chamber 11, control the steam generating device 40 to supply steam into the first chamber 11, control the second fan 75 to circulate the air in the first chamber 11, or do the partial wash on the garment accommodated in the second chamber 22.

In another example, the first controller 300 may control the actuator 76 to open the second door 30, control the lighting device 38 to provide light into the second chamber 22 or control the switchable mirror 35 to change the operation mode.

The first controller 300 may process the data collected from the various components (e.g., the control panel 70, the switchable mirror 35, the first communicator 330 and the spot cleaning device 100) of the clothes care apparatus 1. The first controller 300 may process a user input entered through the control panel 70 and/or the switchable mirror 35 and perform an operation corresponding to the user input.

For example, the first controller 300 may change the operation mode of the switchable mirror 35 based on the mirror switching button **70*a*-9** being selected.

For example, the first controller 300 may operate the lighting device 38 based on the lighting button **70*a*-10** being selected.

In another example, the first controller 300 may control the actuator 76 to open the second door 30 based on the second door 30 open button **70*a*-8** being selected.

The first controller 300 may process image data collected from the at least one sensor 108 of the spot cleaning device 100.

The first controller 300 may include hardware such as a CPU, a microcontroller or a memory, and software such as a control program. For example, the first controller 300 may include at least one memory 320 that stores data in the form of an algorithm or a program for controlling operations of the components in the clothes care apparatus 1, and at least one processor 310 for performing the aforementioned and following operations with the use of the data stored in the at least one memory 320. The memory 320 and the processor 310 may be implemented in separate chips. The processor 310 may include one, two or more processor chips or one, two or more processing cores. The memory 320 may include one, two or more memory chips or one, two or more memory blocks. Alternatively, the memory 320 and the processor 310 may be implemented in a single chip.

The at least one memory 320 may store algorithms for the garment care course, the partial care course and target portion settings.

The first controller 300 may be mounted on e.g., a printed circuit board provided on the rear side of the control panel 70, but the position of the first controller 300 is not limited thereto.

The first controller 300 may be electrically connected to the switchable mirror 35, the control panel 70, the heat exchange device 45, the first fan 42, the steam generating device 40, the second fan 75, the actuator 76, the lighting device 38, the spot cleaning device 100, the moving device 200 and/or the first communicator 330.

The components shown in FIG. 17 are merely an example of the components of the clothes care apparatus 1 according to an embodiment, and the clothes care apparatus 1 may further include some other components than the components shown in FIG. 17 or may not include some of the components shown in FIG. 17.

For example, the clothes care apparatus 1 may include an actuator for automatically opening the first door 20, a first door open/close sensor for detecting opening or closing of the first door 20, a second door open/close sensor for detecting opening or closing of the second door 30, a proximity sensor for detecting approaching of an object to a certain location around the clothes care apparatus 1, etc. In an embodiment, the first controller 300 may turn on the lighting device 38 when opening of the second door 30 is detected by the second door open/close sensor.

Hereinafter, the first controller 300 is referred to as the controller 300 and the first communicator 330 is referred to as the communicator 330 for convenience of explanation.

Figure 19B:
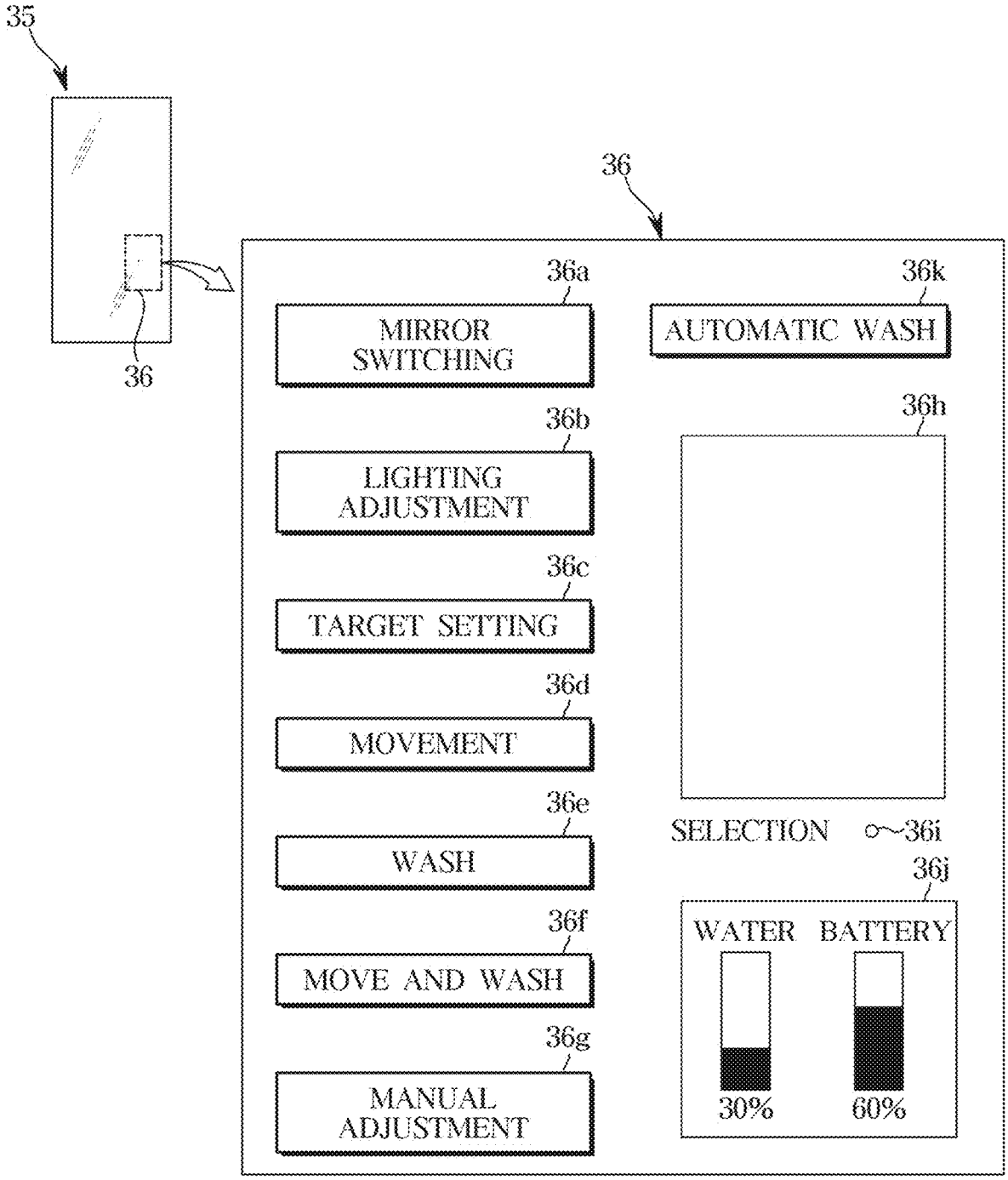
FIG. 19B illustrates an example of a user interface that may be displayed on a switchable mirror, according to an embodiment.

FIG. 19B illustrates an example of a user interface that may be displayed on a switchable mirror, according to an embodiment.

Referring to FIG. 19B, the switchable mirror 35 according to an embodiment may provide the user interface 36 associated with the spot cleaning device 100 according to a preset condition.

Because there is a restriction of space for installing the control panel 70 on the cabinet 10 of the clothes care apparatus 1, the user interface associated with the spot cleaning device 100 may be provided by the switchable mirror 35.

In an embodiment of the disclosure, as the user interface 36 associated with the spot cleaning device 100 is provided by the switchable mirror 35, the user may intuitively and easily control the spot cleaning device 100.

The user interface 36 associated with the spot cleaning device 100 may include at least one of a visual indicator **36*j* to indicate status information of the spot cleaning device 100 or UI elements 36*c*, 36*d*, 36*e*, 36*f*, 36*g* and 36*k* to control the spot cleaning device 100**.

The user interface 36 associated with the spot cleaning device 100 may further include an interface region 36*h* for providing an interface for settings associated with the spot cleaning device 100.

The user interface 36 associated with the spot cleaning device 100 may be displayed in at least a portion of the switchable mirror 35. In an embodiment, the user interface 36 associated with the spot cleaning device 100 may be displayed in the whole area of the switchable mirror 35 or in a portion of the switchable mirror 35. The size of the user interface 36 associated with the spot cleaning device 100 may be changed according to the user's settings.

The user interface 36 associated with the spot cleaning device 100 may further include a mirror switching button 36*a* to switch the operation mode of the switchable mirror 35 and/or a lighting adjustment button 36*b* to control the lighting device 38.

The UI elements for controlling the spot cleaning device 100 may include a button 36*c* for setting up a target portion, a button 36*d* for inputting a command to move the spot cleaning device 100, a button 36*e* for inputting a command to wash for the spot cleaning device 100, a button 36*f* for inputting a command to move and wash for the spot cleaning device 100, a button 36*g* for adjusting the position of the spot cleaning device 100, and a button 36*k* for inputting automatic wash for the spot cleaning device 100.

The button 36*c* for setting up a target portion may receive a user input to set up the target portion.

In an embodiment, when the button 36*c* for setting up a target portion is selected, a user interface for setting up a target portion on the switchable mirror 35 and/or in the interface region 36*h* may be provided.

The controller 300 may control the switchable mirror 35 to provide a user interface for setting up a target portion based on the user input to set up the target portion being received. Examples of the user interface for setting up a target portion will be described later.

The user may set up a target portion of the garment received in the second chamber 22 through the user interface for setting up a target portion.

The controller 300 may determine a target portion according to the user input to set up the target portion.

The movement button 36*d* may receive a user input to move the spot cleaning device 100 to the target portion.

In an embodiment, when the movement button 36*d* is selected, the spot cleaning device 100 may be moved to the target portion.

The controller 300 may control the spot cleaning device 100 to move to the target portion according to the user input to move the spot cleaning device 100 to the target portion.

The controlling of the spot cleaning device 100 to move to the target portion may include transmitting, to the moving device 200, a command to move to the target portion or transmitting, to the spot cleaning device 100, the command to move to the target portion.

The command to move to the target portion may include coordinate data corresponding to the set target portion.

The wash button 36*e* may receive a user input to perform a washing process of the spot cleaning device 100.

In an embodiment, when the wash button 36*e* is selected, the spot cleaning device 100 may perform a washing process. The washing process performed by the spot cleaning device 100 may include a washing fluid spraying process of spraying a washing fluid toward the garment, a water spraying process of spraying water toward the garment, a vibration process for the vibrator 103 to provide micro-vibration for the garment, and a suction process for the suction unit 104 to draw in the water and washing fluid sprayed toward the garment and foreign materials. In an embodiment, the washing process performed by the spot cleaning device 100 may further include a rolling process for the roller 105 to remove foreign materials on the garment.

The controller 300 may control the spot cleaning device 100 to proceed the washing process at a corresponding location according to a user input to perform the washing process.

The controlling of the spot cleaning device 100 to proceed the washing process may include transmitting a command to perform the washing process to the spot cleaning device 100.

The move and wash button 36*f* may receive a user input for the spot cleaning device 100 to move to the target portion and perform the washing process.

In an embodiment, when the move and wash button 36*f* is selected, the spot cleaning device 100 may move to the target portion and perform the washing process.

According to the user input for the spot cleaning device 100 to move to the target portion and perform the washing process, the controller 300 may control the spot cleaning device 100 to move to the target portion and proceed the washing process.

The controlling of the spot cleaning device 100 to move to the target portion and proceed the washing process may include transmitting a command to move and a command to perform the washing process to the spot cleaning device 100. The controlling of the spot cleaning device 100 to move to the target portion and proceed the washing process may include transmitting, to the moving device 200, a command to move, and based on completion of the movement to the target portion, transmitting, to the spot cleaning device 100, a command to perform the washing process.

The manual adjustment button 36*g* may receive user inputs to manually control the movement of the spot cleaning device 100.

In an embodiment, the user may manually control the movement of the spot cleaning device 100 through the manual adjustment button 36*g*.

For example, the manual adjustment button 36*g* is selected, an interface may be provided in the interface region 36*h* to manually control the movement of the spot cleaning device 100.

In another example, movement of the spot cleaning device 100 may be controlled based on a direction of a touch input on the manual adjustment button 36*g*.

The controller 300 may control the movement of the spot cleaning device 100 according to the user input to manually control the movement of the spot cleaning device 100.

In an embodiment, the user may make the spot cleaning device 100 proceed the washing process at a corresponding location by setting up a target portion on the garment accommodated in the second chamber 22 through the button 36*c* to set up a target portion, moving the spot cleaning device 100 to the target portion through the movement button 36*d*, manually controlling the movement of the spot cleaning device 100 through the manual adjustment button 36*g* and selecting the wash button 36*e*.

In an embodiment, the user may make the spot cleaning device 100 proceed the washing process at the target portion by setting up the target portion on the garment accommodated in the second chamber 22 through the button 36*c* to set up a target portion, and moving thereto and selecting the wash button 36*f*.

In an embodiment, the user may make the spot cleaning device 100 proceed the washing process at a corresponding location by manually controlling the spot cleaning device 100 through the manual adjustment button 36*g* and selecting the wash button 36*f*.

The automatic wash button 36*k* may receive a user input to perform an automatic washing process of the spot cleaning device 100. The automatic washing process may refer to a process of the spot cleaning device 100 automatically washing a contaminated portion (i.e., a portion desired to be cleaned or washed) of the garment accommodated in the second chamber 22 without a need for the user to manually set up a target portion.

In an embodiment, when the automatic wash button 36*k* is selected, the spot cleaning device 100 may scan the garment accommodated in the second chamber 22 to find a contaminated portion of the garment accommodated in the second chamber 22, set up the contaminated portion as a target portion and proceed a washing process for the contaminated portion.

The controller 300 may transmit a scan command to the spot cleaning device 100 according to a user input to perform the automatic washing process of the spot cleaning device 100.

The spot cleaning device 100 may move along the second chamber 22 to collect data about the garment accommodated in the second chamber 22 based on reception of (or receiving) the scan command.

For example, at least one sensor 108 of the spot cleaning device 100 may include a camera, and the spot cleaning device 100 may collect image data of the garment accommodated in the second chamber 22 while moving along the second chamber 22.

The controller 300 may identify a contaminated portion of the garment accommodated in the second chamber 22 based on the image data of the garment accommodated in the second chamber 22 being received and processed. The first controller 300 may determine the contaminated portion of the garment accommodated in the second chamber 22 as the target portion, and control the spot cleaning device 100 to do the wash on the target portion.

In another example, at least one sensor 108 of the spot cleaning device 100 may include a photo sensor, and the spot cleaning device 100 may collect light amount data by irradiating light to the garment accommodated in the second chamber 22 and receiving reflected light while moving along the second chamber 22.

The controller 300 may identify the contaminated portion of the garment accommodated in the second chamber 22 based on the light amount data being received and processed. The first controller 300 may determine the contaminated portion of the garment accommodated in the second chamber 22 as the target portion, and control the spot cleaning device 100 to do the wash on the target portion.

In an embodiment of the disclosure, as the spot cleaning device 100 may automatically wash the contaminated portion of the garment only by the user's selecting of the automatic wash button 36*k*, user convenience is improved.

Various interfaces such as an interface for setting up a target portion, an interface for changing the setting values for the lighting device 38, etc., may be provided in the interface region 36*h* that provides an interface for settings associated with the spot cleaning device 100.

A selection button 36*i* may be used to select a UI element provided in the interface region 36*h* that provides the interface for settings associated with the spot cleaning device 100.

For example, when the selection button 36*i* is selected after the setup of the target portion is done through the interface provided in the interface region 36*h*, the setup of the target portion may be completed.

The visual indicator 36*j* that indicates status information of the spot cleaning device 100 may include state of charge (SoC) information of the battery of the spot cleaning device 100 and/or information about a remaining amount of water in the water supply tub of the water tub 120 of the spot cleaning device 100. In an embodiment, the spot cleaning device 100 may further include a water level sensor for detecting a water level of the water supply tub of the water tub 120.

The example of the UI element included in the user interface 36 associated with the spot cleaning device 100 is not limited thereto, and any UI element for settings associated with the spot cleaning device 100 may be included in the user interface 36 associated with the spot cleaning device 100 without limitation.

For example, the user interface 36 associated with the spot cleaning device 100 may further include a home button to move the spot cleaning device 100 to the home position part 25. The home button may receive a user input to move the spot cleaning device 100 to the home position part 25.

The controller 300 may move the spot cleaning device 100 to the home position part 25 based on the user input to move the spot cleaning device 100 to the home position part 25 being received.

According to the disclosure, the user may easily control the movement of the spot cleaning device 100 while looking into the second chamber 22 during the operation of the switchable mirror 35 in the transparent mode.

Figure 20:
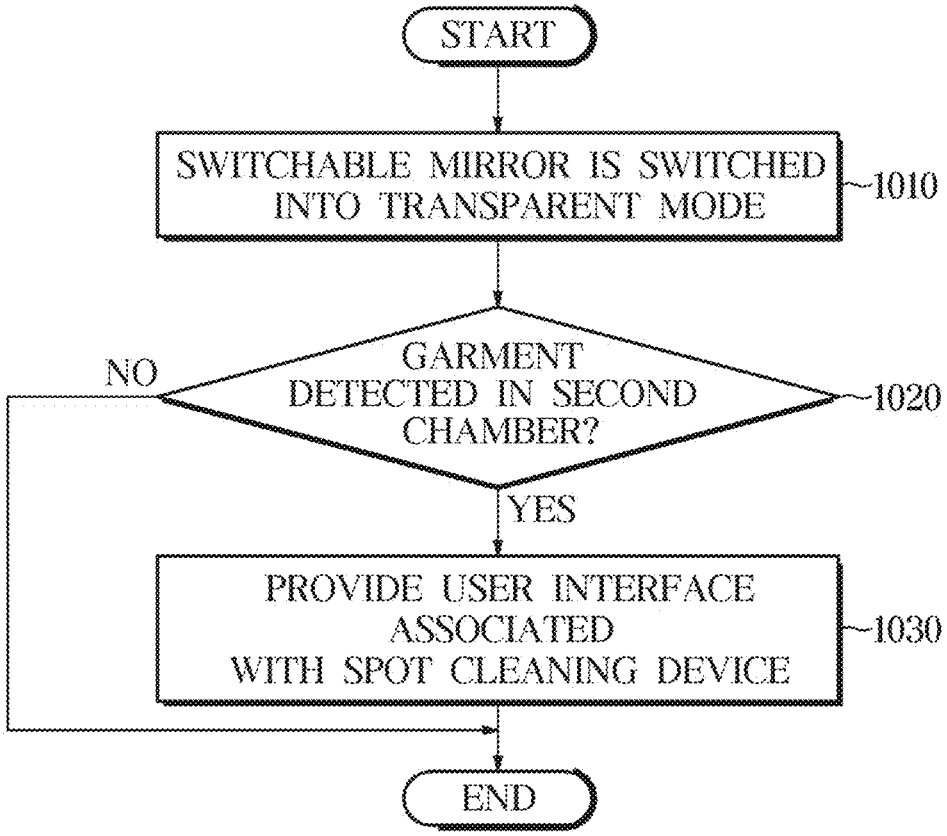
FIG. 20 is a flowchart illustrating a procedure for providing a user interface by a switchable mirror, according to an embodiment.
Figure 21A:
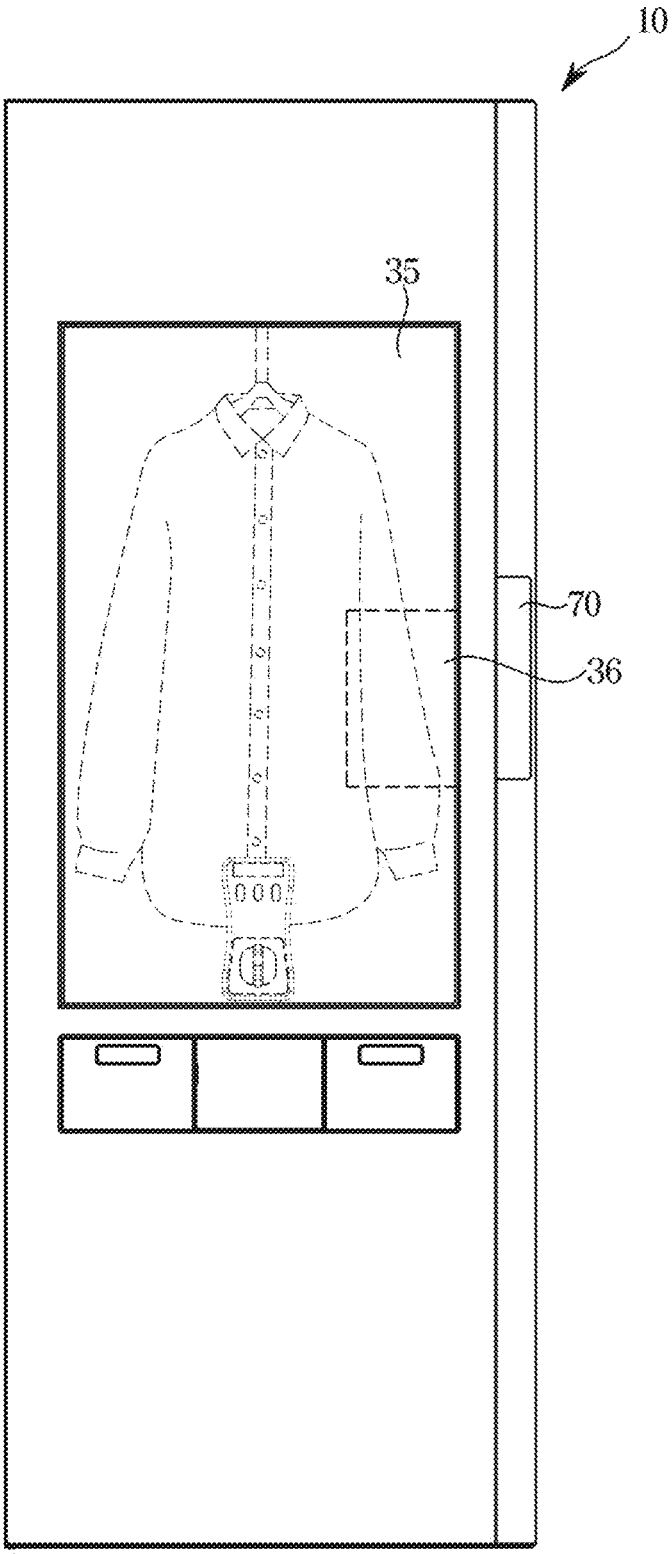
FIG. 21A illustrates a user interface being provided by a switchable mirror, according to an embodiment.
Figure 21B:
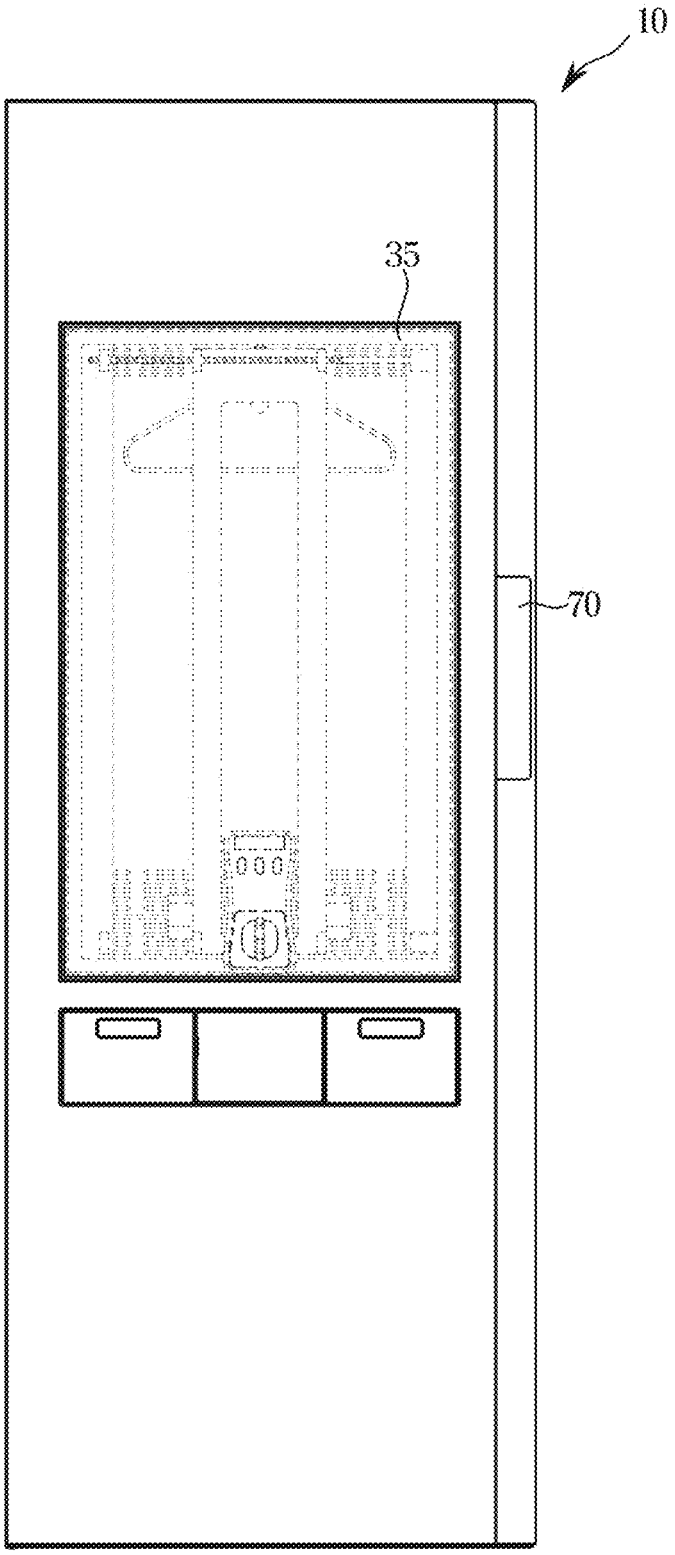
FIG. 21B illustrates no user interface provided by a switchable mirror, according to an embodiment.

FIG. 20 is a flowchart illustrating a procedure for providing a user interface by a switchable mirror, according to an embodiment. FIG. 21A illustrates a user interface being provided by a switchable mirror, according to an embodiment. FIG. 21B illustrates no user interface provided by a switchable mirror, according to an embodiment.

Referring to FIG. 20, in an embodiment, the first controller 300 may operate the switchable mirror 35 in the transparent mode based on a preset condition being satisfied, (1010 in FIG. 20). In an embodiment, the first controller 300 may turn on the lighting device 38 based on the switchable mirror 35 being operated in the transparent mode.

For example, the first controller 300 may operate the switchable mirror 35 in the transparent mode based on a user input received through the user interface 36 provided by the switchable mirror 35 and/or the control panel 70 to change the operation mode of the switchable mirror 35.

In an embodiment, the first controller 300 may operate the switchable mirror 35 in the mirror mode based on a user input received through the user interface 36 provided by the switchable mirror 35 and/or the control panel 70 to change the operation mode of the switchable mirror 35.

In another example, the first controller 300 may change the operation mode of the switchable mirror 35 based on a touch input on the switchable mirror 35. In an embodiment, the first controller 300 may change the operation mode of the switchable mirror 35 once at least one touch is made on the switchable mirror 35.

In another example, the first controller 300 may change the operation mode of the switchable mirror 35 based on a mirror switching command being received through a mike of the clothes care apparatus 1.

In another example, the first controller 300 may change the operation mode of the switchable mirror 35 based on the proximity sensor of the clothes care apparatus 1 provided to detect the approach of an object at a certain location.

As such, the operation mode of the switchable mirror 35 may be changed in response to various conditions being satisfied.

The user may set a preset condition to change the operation mode of the switchable mirror 35 through the user interface 36 provided by the switchable mirror 35 and/or the control panel 70.

Depending on various conditions, the user interface 36 associated with the spot cleaning device 100 may or may not be provided by the switchable mirror 35 while the switchable mirror 35 is operating in the transparent mode.

For example, when no garment is in the second chamber 22, the user interface 36 associated with the spot cleaning device 100 may not be provided.

In an embodiment, the first controller 300 may determine whether to provide the user interface 36 associated with the spot cleaning device 100 depending on whether there is a garment in the second chamber 22.

The controller 300 may determine whether a garment is detected in the second chamber 22 through various sensors.

For example, the first controller 300 may determine whether there is a garment in the second chamber 22 based on data obtained by the at least one sensor 108 of the spot cleaning device 100. In another example, the first controller 300 may detect whether there is a garment in the second chamber 22 based on the data collected through a sensor for detecting pressure applied to the supporter 80 that supports the hanger H in the second chamber 22. In another example, the first controller 300 may detect whether there is a garment in the second chamber 22 based on data collected by a camera for capturing the inside of the second chamber 22.

Based on a garment in the second chamber 22 being detected (1020 in FIG. 20), the controller 300 may control the switchable mirror 35 to provide the user interface 36 associated with the spot cleaning device 100 (1030 in FIG. 20).

The controlling of the switchable mirror 35 to provide the user interface 36 associated with the spot cleaning device 100 may include controlling the second layer 35-2 to provide the user interface 36 associated with the spot cleaning device 100.

Referring to FIG. 21A, when a garment is detected in the second chamber 22 and the switchable mirror 35 operates in the transparent mode, it may be seen that the user interface 36 associated with the spot cleaning device 100 is provided by the switchable mirror 35.

Based on no garment being detected in the second chamber 22 (1020 in FIG. 20), the controller 300 may control the switchable mirror 35 not to provide the user interface 36 associated with the spot cleaning device 100.

Referring to FIG. 21B, when no garment is detected in the second chamber 22 and the switchable mirror 35 operates in the transparent mode, the user interface 36 associated with the spot cleaning device 100 is not provided by the switchable mirror 35.

In various embodiments, even when a garment is detected in the second chamber 22, the first controller 300 may control the switchable mirror 35 not to provide the user interface associated with the spot cleaning device 100 based on a user input to terminate the user interface 36 associated with the spot cleaning device 100 being received. The user may have his/her garment (e.g., a bag) hung in the second chamber 22 for decoration while in a state of setting the switchable mirror 35 into the transparent mode. In this case, the user may use the clothes care apparatus 1 as a decorative prop by terminating the user interface 36 associated with the spot cleaning device 100.

In various embodiments, even when a garment is not detected in the second chamber 22, the first controller 300 may control the switchable mirror 35 to provide the user interface associated with the spot cleaning device 100 based on a user input to turn on the user interface 36 associated with the spot cleaning device 100 being received. The user may be provided with the user interface 36 associated with the spot cleaning device 100 in a situation where no garment is detected by the at least one sensor 108 of the spot cleaning device 100 even when the garment is present in the second chamber 22.

Figure 22:
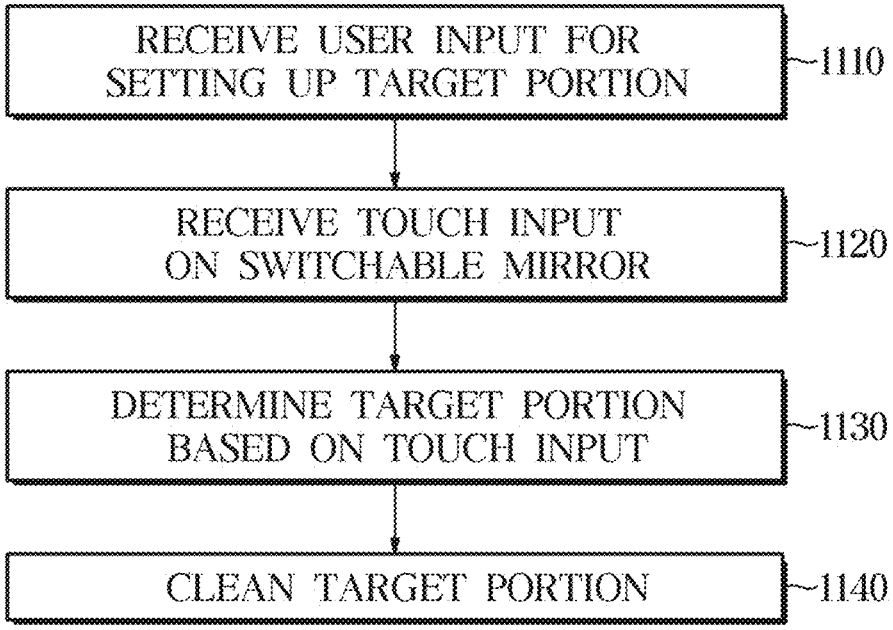
FIG. 22 is a flowchart illustrating an example of a method in which a clothes care apparatus determines a target portion, according to an embodiment.

FIG. 22 is a flowchart illustrating a method in which a clothes care apparatus determines a target portion, according to an embodiment.

Referring to FIG. 22, the clothes care apparatus 1 may receive a user input to set up a target portion (1110 in FIG. 22).

For example, the clothes care apparatus 1 may receive the user input to set up a target portion through the control panel 70.

In another example, the clothes care apparatus 1 may receive a user input to set up a target portion through the user interface 36 provided by the switchable mirror 35.

In an embodiment, the first controller 300 may operate the switchable mirror 35 in the transparent mode based on a user input to switch the switchable mirror 35 into the transparent mode being received.

In an embodiment, the user input to set up a target portion may be recognized as a user input to switch the switchable mirror 35 into the transparent mode. In other words, the first controller 300 may operate the switchable mirror 35 in the transparent mode based on a user input to set up a target portion being received.

The controller 300 may provide the user interface 36 on the switchable mirror 35 based on a garment being detected in the second chamber 22 while the switchable mirror 35 is operating in the transparent mode.

The user may input a command to set up a target portion to the clothes care apparatus 1 through the target setup button 36*c* of the user interface 36.

In another example, the user may input a command to set up a target portion to the clothes care apparatus 1 through the partial care button 70*a*-4 of the control panel 70.

The command for the clothes care apparatus 1 to set up a target portion is not limited to the aforementioned example, and it would be understood that a method of inputting a command to set up a target portion according to the user's settings may be added. For example, the clothes care apparatus 1 may recognize successive touch inputs on the switchable mirror 35 as the user input to set up a target portion.

Based on the user input to set up a target portion being received, the clothes care apparatus 1 may output a visual indicator (e.g., text, an icon, etc.) that guides the setup of a target portion through the output interface 70*b* and/or the switchable mirror 35.

The visual indicator that guides the setup of a target portion may include text such as e.g., "touch a target portion" and/or a visual indicator that partitions the switchable mirror 35 into multiple sections.

In an embodiment, the clothes care apparatus 1 may receive a touch input on the switchable mirror 35, in 1120.

In an embodiment, the first controller 300 may determine a target portion based on the touch input on the switchable mirror 35, in 1130.

In an embodiment, the first controller 300 may control the spot cleaning device 100 to wash the target portion based on the determination of the target portion, in 1140. The controlling of the spot cleaning device 100 to wash the target portion may include controlling the spot cleaning device 100 to move to the target portion and/or perform a washing process on the target portion.

The controller 300 may control the spot cleaning device 100 to move to the target portion based on the determination of the target portion. For example, the first controller 300 may control the spot cleaning device 100 to move to the target portion based on the determination of the target portion and selection of the start button 70*a*-7, the selection button 70*a*-12 or 36*i*, the movement button 36*d* and/or the move and wash button 36*f*.

Figure 23:
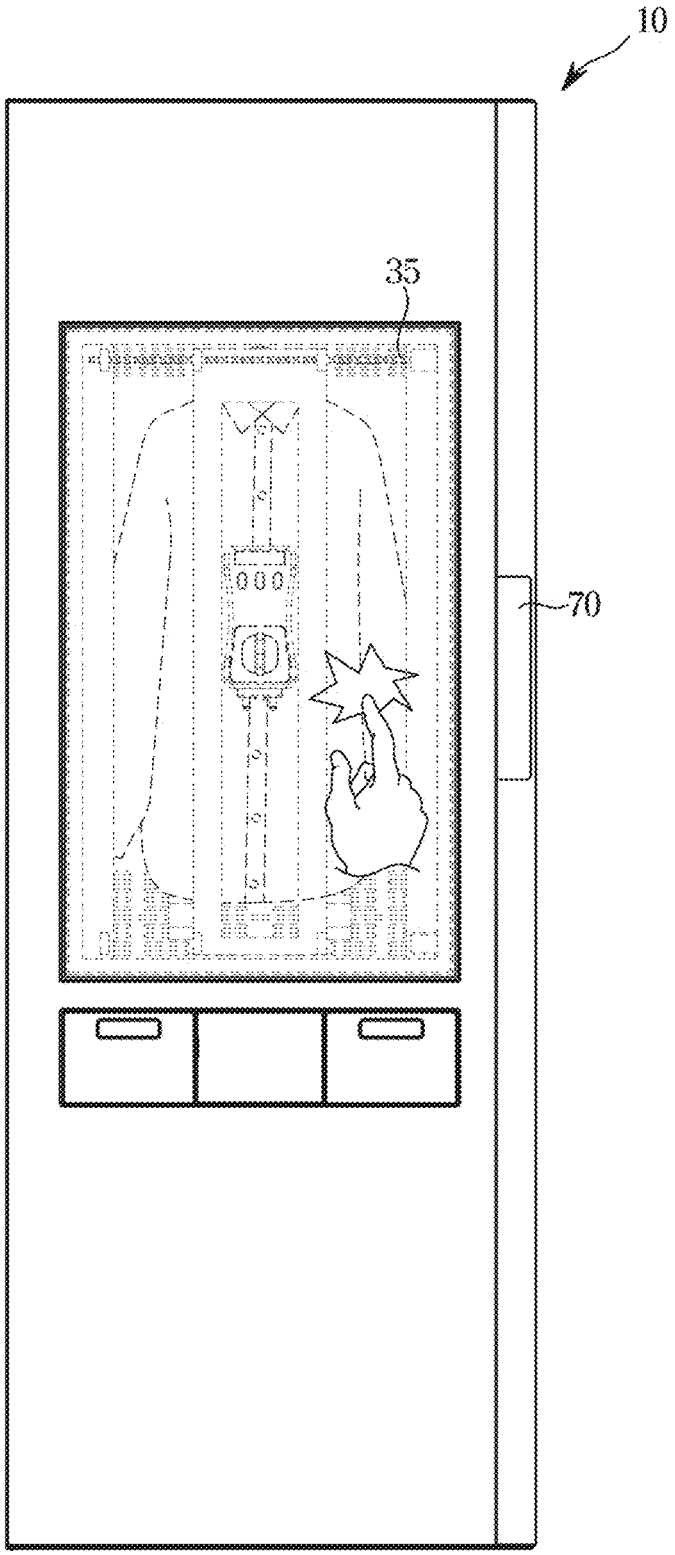
FIG. 23 illustrates an example in which a clothes care apparatus determines a target portion based on a location of a touch input on a switchable mirror, according to an embodiment.

FIG. 23 illustrates an example in which the clothes care apparatus 1 determines a target portion based on a location of a touch input on the switchable mirror 35, according to an embodiment.

Referring to FIG. 23, in an embodiment, the first controller 300 may determine a target portion based on a location of a touch input on the switchable mirror 35.

The user may identify a contaminated portion of the garment accommodated in the second chamber 22 through the switchable mirror 35 that operates in the transparent mode, and determine a target portion by touching a portion of the switchable mirror 35 corresponding to the contaminated portion.

The controller 300 may control the switchable mirror 35 to output an indicator corresponding to the location of the touch input based on the touch input on the switchable mirror 35 being received.

Accordingly, the user may accurately identify the location of the touch input.

When the user finds that the location of the touch input corresponds to a portion of the garment accommodated in the second chamber 22 desired to be washed, the user may input a command to proceed the spot cleaning to the clothes care apparatus 1. For example, the user may select the start button 70*a*-7, the selection button 70*a*-12 or 36*i*, the movement button 36*d* and/or the move and wash button 36*f*. In various embodiments, it would be understood that the user may input a command to proceed the spot cleaning to the clothes care apparatus 1 through a voice command.

In an embodiment of the disclosure, the user may easily determine a target portion by touching a portion of the garment accommodated in the second chamber 22 required to be washed while looking into the switchable mirror 35 switched into the transparent mode.

Figure 24:
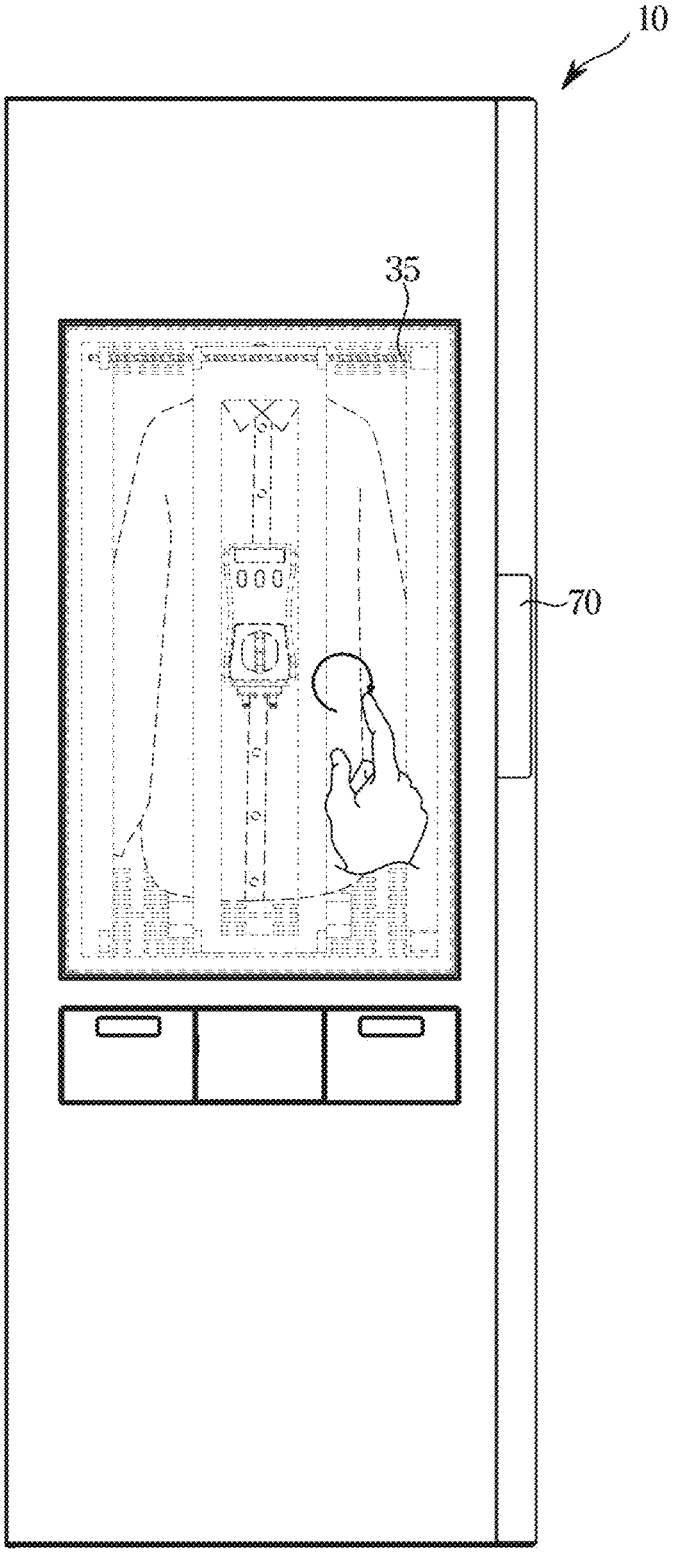
FIG. 24 illustrates an example in which a clothes care apparatus determines a target portion based on a region designated by a touch and drag input on a switchable mirror, according to an embodiment.

FIG. 24 illustrates an example in which the clothes care apparatus 1 determines a target portion based on a region designated by a touch-and-drag input on the switchable mirror 35, according to an embodiment.

Referring to FIG. 24, in an embodiment, the first controller 300 may determine a target portion based on a region formed by a touch input on the switchable mirror 35.

A touch input may include a drag input, and the first controller 300 may determine a region designated by the drag input as a target portion.

The user may identify a contaminated portion of the garment accommodated in the second chamber 22 through the switchable mirror 35 that operates in the transparent mode, and determine a region corresponding to the identified portion through the drag input.

The controller 300 may control the switchable mirror 35 to output an indicator corresponding to the region designated by the touch input based on the touch input on the switchable mirror 35 being received.

Accordingly, the user may accurately identify the region designated by the touch input.

When the user finds that the region designated by the touch input corresponds to a portion of the garment accommodated in the second chamber 22 desired to be washed, the user may input a command to proceed spot cleaning to the clothes care apparatus 1. For example, the user may select the start button 70*a*-7, the selection button 70*a*-12 or 36*i*, the movement button 36*d* and/or the move and wash button 36*f*. In various embodiments, it would be understood that the user may input a command to proceed spot cleaning to the clothes care apparatus 1 through a voice command.

In an embodiment of the disclosure, the user may easily determine a target portion by touching a portion of the garment accommodated in the second chamber 22 required to be washed while looking into the switchable mirror 35 switched into the transparent mode.

Figure 25:
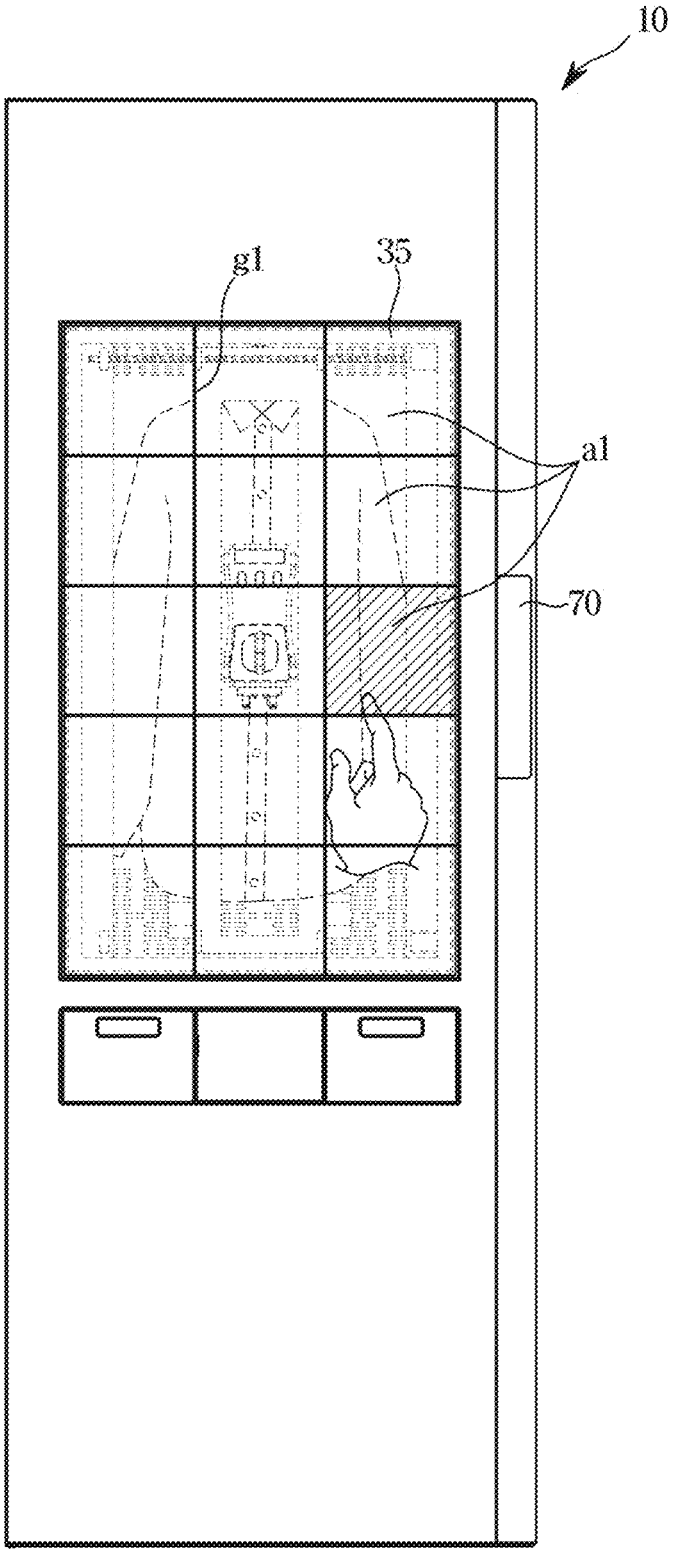
FIG. 25 illustrates an example in which a clothes care apparatus determines a target portion based on a region designated by a touch input on a switchable mirror, according to an embodiment.

FIG. 25 illustrates an example in which the clothes care apparatus 1 determines a target portion based on a region designated by a touch input on the switchable mirror 35, according to an embodiment.

Referring to FIG. 25, in an embodiment, the first controller 300 may control the switchable mirror 35 to display a visual indicator g1 that partitions the switchable mirror 35 into multiple sections a1 based on reception of a user input to set up a target portion.

The visual indicator g1 that partitions the switchable mirror 35 into the multiple sections a1 may define grids, but the form of the visual indicator g1 that partitions the switchable mirror 35 into the multiple sections a1 is not limited thereto.

In an embodiment, the multiple sections a1 may have a size corresponding to a cleaning range of the spot cleaning device 100, but are not limited thereto.

With the visual indicator g1 that partitions the switchable mirror 35 into the multiple sections a1 displayed on the switchable mirror 35, the user may select a section, in which a portion to be selected of the garment accommodated in the second chamber 22 is located, more easily.

The user may determine a target portion by touching at least one of the multiple sections a1 separated by the visual indicator g1.

The controller 300 may determine at least one of the multiple sections a1, on which the touch input is received, as a target portion.

The controller 300 may control the switchable mirror 35 to output a visual indication to distinguish the at least one section set up as a target portion in response to the reception of the touch input from the other sections that are not set up as the target portion. For example, the first controller 300 may control the switchable mirror 35 to differentiate the color of the section among the multiple sections a1 that is set up as the target portion in response to the reception of the touch input or the color of edges corresponding to the section set up as the target portion from colors of the other sections that are not set up as the target portion or colors of edges of the other sections.

The controller 300 may release the section having been determined as the target portion from the target portion based on a second touch on the section.

The user may easily set up a target portion by touching at least one of the multiple sections a1 separated by the visual indicator g1.

When the user finds that at least one of the multiple sections a1 corresponds to a portion of the garment accommodated in the second chamber 22 required to be washed according to a touch input, the user may input a command to proceed the spot cleaning to the clothes care apparatus 1. For example, the user may select the start button 70*a*-7, the selection button 70*a*-12 or 36*i*, the movement button 36*d* and/or the move and wash button 36*f*. In various embodiments, it is obvious that the user may input a command to proceed the spot cleaning to the clothes care apparatus 1 through a voice command.

In an embodiment of the disclosure, convenience of the user in setting up a target portion may be improved by displaying the visual indicator to partition the switchable mirror 35 into the multiple sections.

Figure 26:
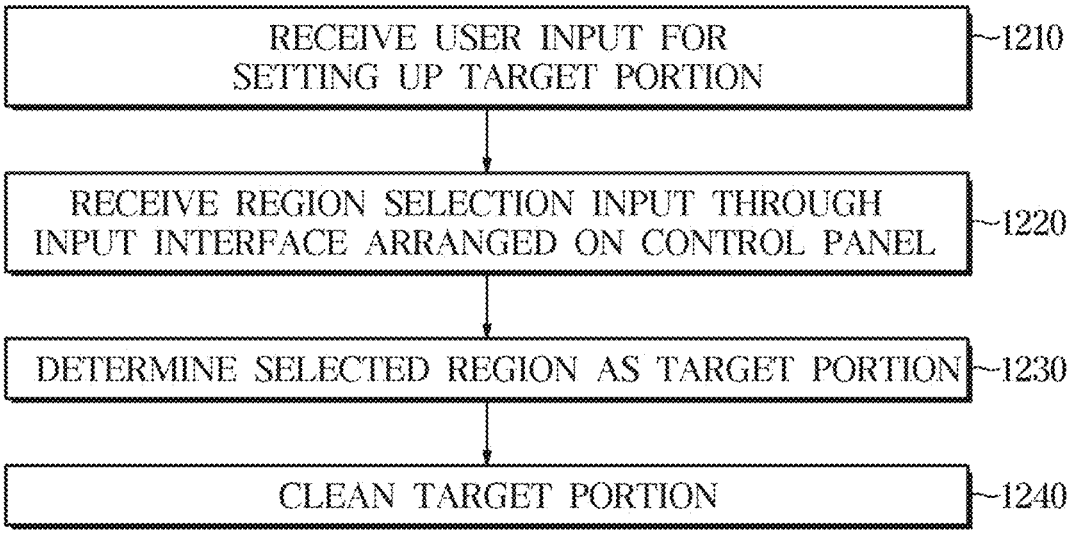
FIG. 26 is a flowchart illustrating another example of a method in which a clothes care apparatus determines a target portion, according to an embodiment.

FIG. 26 is a flowchart illustrating another example of a method in which the clothes care apparatus 1 determines a target portion, according to an embodiment.

Referring to FIG. 26, the clothes care apparatus 1 may receive a user input to set up a target portion, in 1210. As described above, the clothes care apparatus 1 may receive the user input to set up a target portion through various methods.

In an embodiment, the clothes care apparatus 1 may determine a target portion based on the user input received through the input interface 70*a* of the control panel 70.

In an embodiment, the first controller 300 may receive an input to select at least one of the multiple sections through the control panel 70, in 1220.

The controller 300 may determine the at least one section selected through the control panel 70 from among the multiple sections as the target portion, in 1230.

Figure 27:
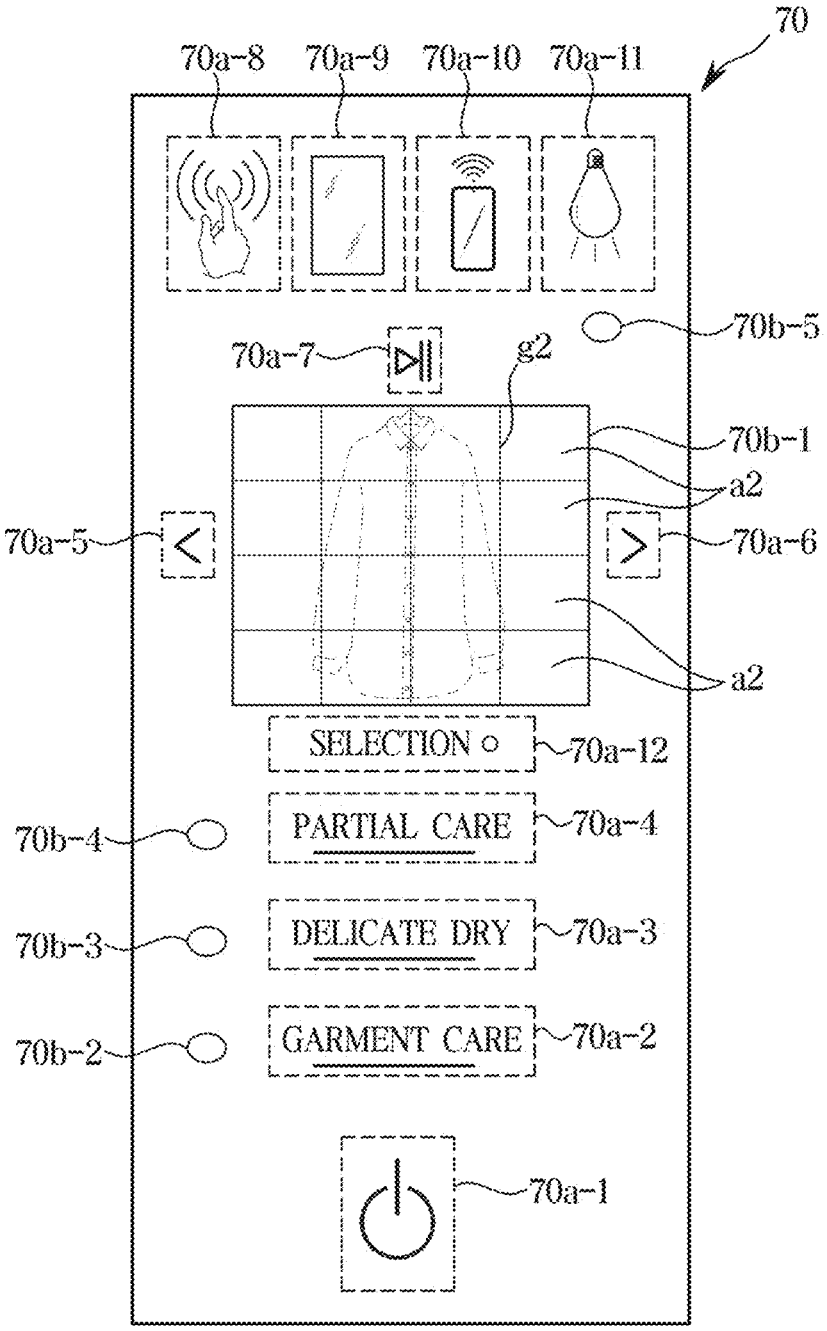
FIG. 27 illustrates an example of an interface for setting up a target portion, which is provided by a control panel, according to an embodiment.

FIG. 27 illustrates an example of an interface for setting up a target portion, which is provided by the control panel 70, according to an embodiment.

Referring to FIG. 27, the first controller 300 may control the output interface 70*b* to provide an interface for receiving a selection of at least one of the multiple sections separated from one another based on reception of the user input for setting up the target portion.

For example, the first controller 300 may control the display 70*b*-1 to provide the interface for receiving the selection of at least one of multiple sections a2 separated from one another based on a selection of the partial care button 70*a*-4.

In an embodiment, the interface for receiving the selection of at least one of the multiple sections a2 separated from one another may include a pre-stored garment image and a visual indicator g2 that partitions the pre-stored garment image into the multiple sections a2.

In an embodiment, the first controller 300 may control the display 70*b*-1 to provide an interface for determining the type of the garment (e.g., short sleeves, long sleeves, pants, etc.) based on a selection of the partial care button 70*a*-4, and control the display 70*b*-1 to output a pre-stored garment image corresponding to the type of the garment and the visual indicator g2 that partitions the pre-stored garment image into the multiple sections a2 based on a selection of the type of the garment.

The visual indicator g2 may define grids, but the form of the visual indicator g2 that partitions the pre-stored garment image displayed on the display 70*b*-1 into the multiple sections a2 is not limited thereto.

The user may select at least one of the multiple sections a2 through the control panel 70. For example, the user may select at least one of the multiple sections a2 through the direction selection button 70*a*-5 or 70*a*-6 and the selection button 70*a*-12, or select at least one of the multiple sections a2 through a touch input on the display 70*b*-1.

The controller 300 may control the display 70*b*-1 to output a visual indication to distinguish the at least one section selected through the control panel 70 from among the multiple sections a2 from the non-selected sections.

The controller 300 may determine the at least one section selected through the control panel 70 from among the multiple sections a2 as a target portion.

In an embodiment of the disclosure, even when the switchable mirror 35 is not operating in the transparent mode or the user is unable to see the garment accommodated in the second chamber 22, the user may identify a contaminated portion of the garment in advance and easily set up a target portion by selecting at least one section corresponding to the contaminated portion.

Figure 28:
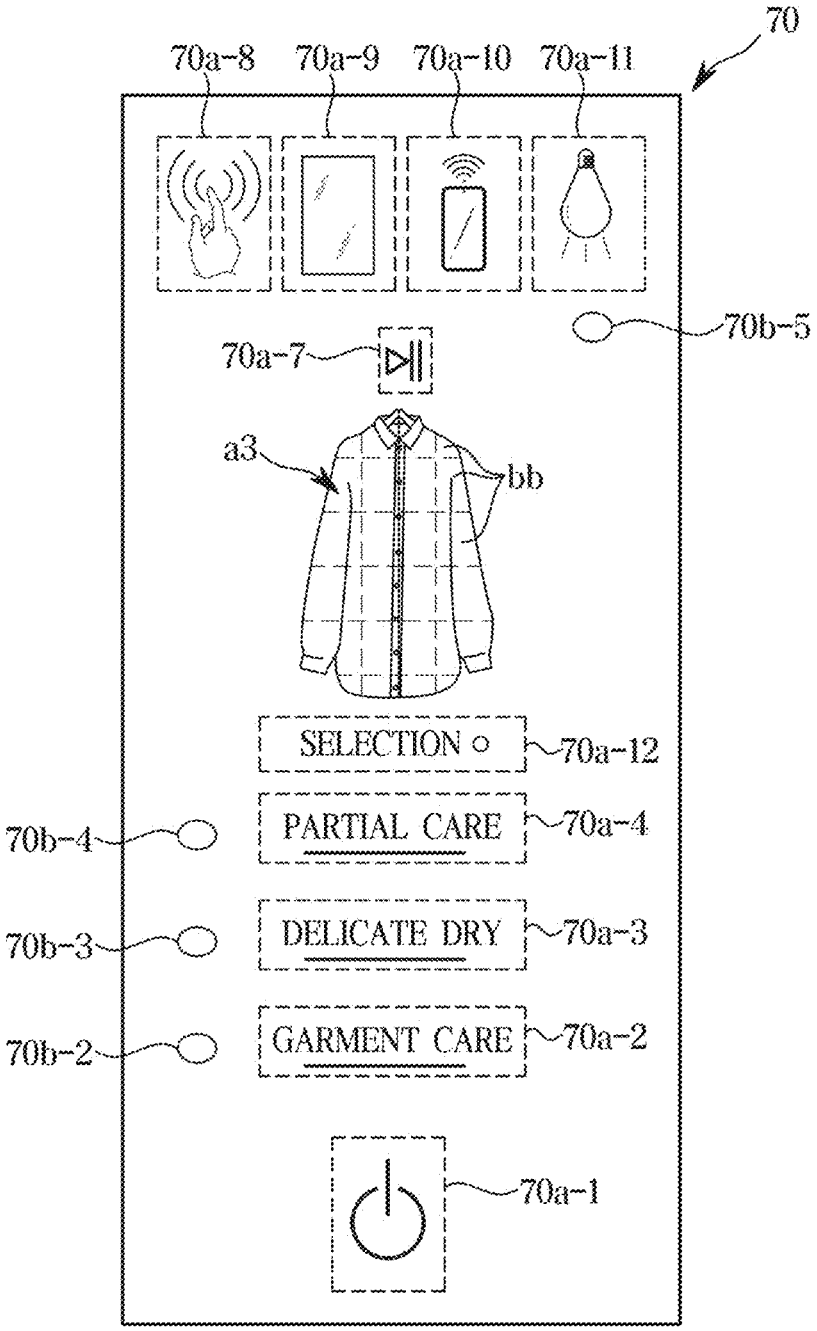
FIG. 28 illustrates an example of buttons for setting up a target portion, which are arranged on a control panel, according to an embodiment.

FIG. 28 illustrates an example of buttons for setting up a target portion, which are arranged on the control panel 70, according to an embodiment.

In an embodiment, the control panel 70 may include a plurality of buttons bb to receive a selection of at least one of multiple sections a3 separated from one another.

In an embodiment, the plurality of buttons bb may form a garment shape. For example, the plurality of buttons bb may form a half-sleeve shape, a long-sleeve shape, a pants shape and/or a Y-shirt shape.

The plurality of buttons bb may correspond to the multiple sections a3. In other words, the plurality of buttons bb may correspond to the multiple sections a3, respectively.

The user may select at least one of the multiple sections a3 separated from one another by selecting a button bb corresponding to a portion desired to be cleaned from among the plurality of buttons bb.

Each of the plurality of buttons bb may refer to a physical button. Each of the plurality of buttons bb may be turned on in response to being selected, and turned off in response to a release from the selection. In another example, the plurality of buttons bb may be provided on the touch panel, and the button regions may be turned on or off.

The controller 300 may determine the at least one section selected through the control panel 70 from among the multiple sections a3 as a target portion. In other words, the first controller 300 may determine a section corresponding to the button selected from among the plurality of buttons bb as a target portion.

In an embodiment of the disclosure, even when the switchable mirror 35 is not operating in the transparent mode or the user is unable to see the garment accommodated in the second chamber 22, the user may identify a contaminated portion of his/her garment in advance and easily set up a target portion by selecting at least one button bb corresponding to the contaminated portion.

In the disclosure, the user may set up a target portion through the control panel 70 of the clothes care apparatus 1.

Figure 29:
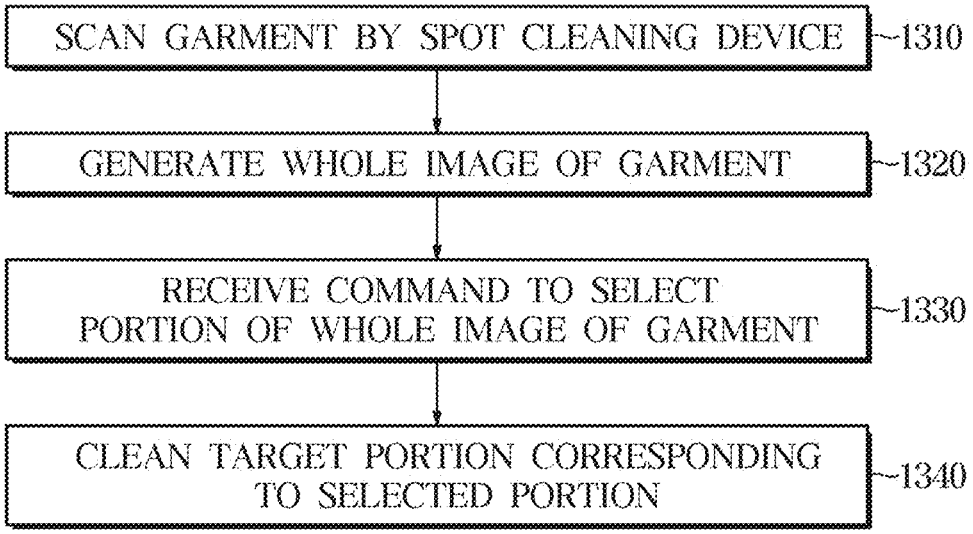
FIG. 29 is a flowchart illustrating another example of a method in which a clothes care apparatus determines a target portion, according to an embodiment.

FIG. 29 is a flowchart illustrating another example of a method in which the clothes care apparatus 1 determines a target portion, according to an embodiment.

Referring to FIG. 29, the first controller 300 may transmit a garment scan command to the spot cleaning device 100 based on a preset condition being satisfied (1310 in FIG. 29). The spot cleaning device 100 may move along the second chamber 22 to obtain a whole image of the garment accommodated in the second chamber 22 based on reception of the garment scan command from the first controller 300.

In other words, based on the preset condition being satisfied, the first controller 300 may control the spot cleaning device 100 to move along the second chamber 22 to obtain the whole image of the garment accommodated in the second chamber 22.

The preset condition may include at least one of opening or closing of the second door 30 being detected, a new garment being detected based on an image obtained by the camera of the spot cleaning device 100, garment replacement being detected based on the image obtained by the camera of the spot cleaning device 100 or the garment scan command being received.

For example, the first controller 300 may control the spot cleaning device 100 to obtain the whole image of the garment accommodated in the second chamber 22 based on reception of the garment scan command through the user interface 36 provided by the control panel 70 and/or the switchable mirror 35.

In another example, the first controller 300 may control the spot cleaning device 100 to obtain the whole image of the garment accommodated in the second chamber 22 based on reception of the garment scan command through the communicator 330.

In another example, the first controller 300 may control the spot cleaning device 100 to obtain the whole image of the garment accommodated in the second chamber 22 based on reception of a user input to set up a target portion.

In another example, the first controller 300 may control the spot cleaning device 100 to obtain the whole image of the garment accommodated in the second chamber 22 based on detection of opening or closing of the second door 30.

In another example, the first controller 300 may control the spot cleaning device 100 to obtain the whole image of the garment accommodated in the second chamber 22 based on detection of a new garment or detection of garment replacement based on an image obtained by the camera of the spot cleaning device 100.

Figure 30:
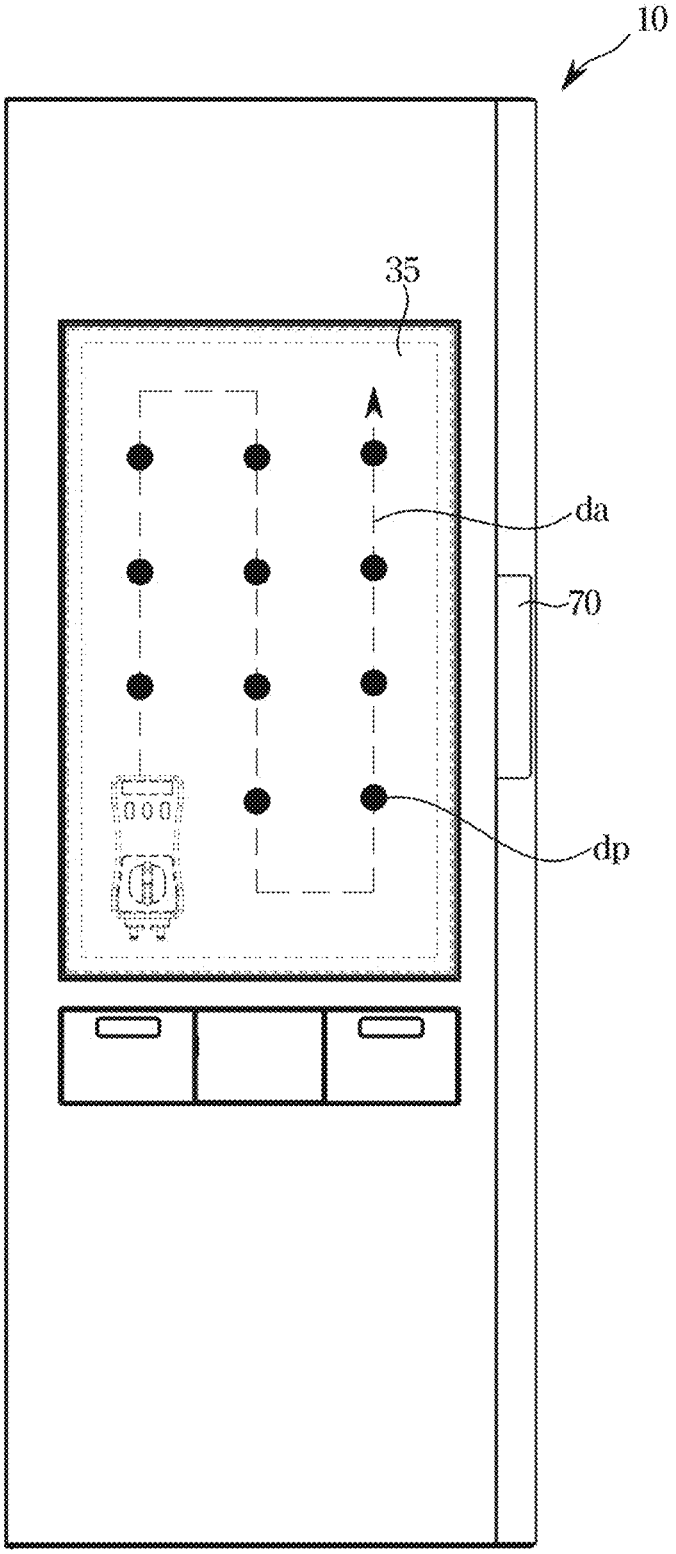
FIG. 30 illustrates a spot cleaning device scanning a garment received in a second chamber, according to an embodiment.
Figure 31:
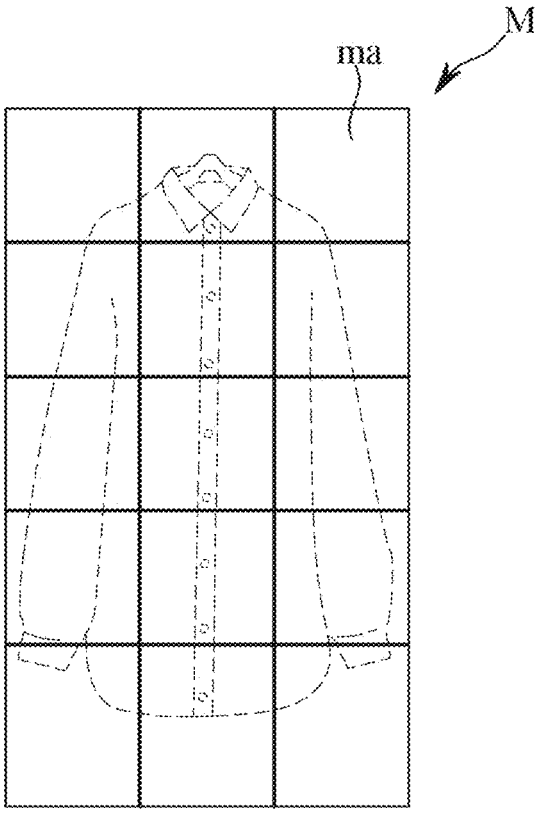
FIG. 31 illustrates an example of a whole image of a garment obtained by a spot cleaning device, according to an embodiment.

FIG. 30 illustrates the spot cleaning device 100 scanning a garment accommodated in the second chamber 22, according to an embodiment. FIG. 31 illustrates an example of a whole image of a garment obtained by the spot cleaning device 100, according to an embodiment.

Referring to FIGS. 30 and 31, the spot cleaning device 100 may obtain a partial image ma of a garment accommodated in the second chamber 22 at each of a plurality of positions while moving along the second chamber based on reception of a garment scan command from the first controller 300.

For example, the spot cleaning device 100 may obtain partial images ma of the garment accommodated in the second chamber 22 at a plurality of predetermined positions dp while moving along a predetermined path da in the second chamber based on reception of the garment scan command from the first controller 300. The partial image ma may be obtained by the camera, an example of the sensor 108 provided in the spot cleaning device 100.

The spot cleaning device 100 may send the plurality of partial images ma obtained at the plurality of predetermined positions dp to the first controller 300. The clothes care apparatus 1 may generate a whole image M of the garment by combining the plurality of partial images ma obtained at the plurality of positions dp (1320 in FIG. 20).

In an embodiment, the first controller 300 may generate the whole image M of the garment by combining the plurality of partial images ma.

In an embodiment, the first controller 300 may identify a contaminated portion from the whole image M of the garment. In such an embodiment, the memory 320 may store an algorithm for identifying a contaminated portion from the whole garment image. For example, the first controller 300 may identify a contaminated portion by inputting the whole image M of the garment to a machine learning model.

In various embodiments, the second controller 180 of the spot cleaning device 100 may combine the plurality of partial images ma to generate the whole image M of the garment.

The clothes care apparatus 1 may receive a command to select a portion of the whole image M of the garment (1330 in FIG. 29).

The command to select a portion of the whole image M of the garment may be received from the control panel 70, the user interface 36 provided by the switchable mirror 35 and/or an external device through the communicator 330.

The clothes care apparatus 1 needs to show the user the whole image M of the garment to receive the command to select a portion from the whole image M of the garment.

Based on reception of the command to select a partial region from the whole image M of the garment, the clothes care apparatus 1 may determine the selected portion as a target portion and the spot cleaning device 100 may clean the target portion (1340 in FIG. 29).

Figure 32:
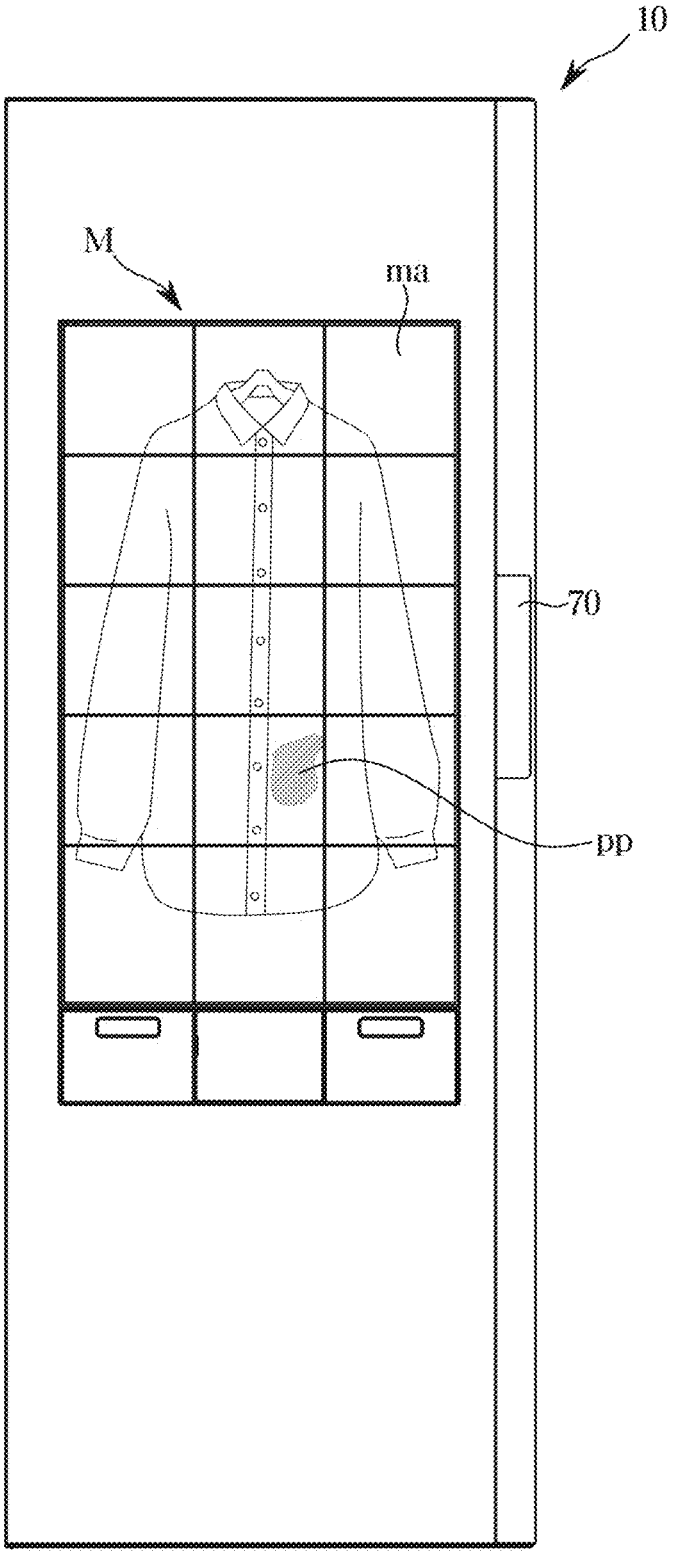
FIG. 32 illustrates an example in which a whole image of a garment is displayed on a switchable mirror, according to an embodiment.

FIG. 32 illustrates an example in which a whole image of a garment is displayed on the switchable mirror 35, according to an embodiment.

Referring to FIG. 32, in an embodiment, the first controller 300 may control the switchable mirror 35 to display the whole image of the garment based on reception of the user input to set up a target portion.

The whole garment image may be displayed in the entire area of the switchable mirror 35 or in a portion of the switchable mirror 35 based on a user setting.

The controller 300 may control the switchable mirror 35 to display a visual indicator pp to highlight the contaminated portion identified from the whole image M of the garment while displaying the whole image M of the garment.

In the disclosure, the user may easily set up the target portion by referring to the contaminated portion identified by the clothes care apparatus 1 from the whole image M of the garment.

The whole image M of the garment displayed on the switchable mirror 35 may be scaled up or down based on a user input to scale up or down the whole image M of the garment.

The user input to scale up or down the whole image M of the garment may include, for example, a pinch zoom touch input on the switchable mirror 35.

The controller 300 may control the switchable mirror 35 to scale up or down the whole image M of the garment based on reception of the user input to scale up or down the whole image M of the garment.

In the disclosure, the user may easily locate a contaminated portion of the garment while scaling up or down the whole image M of the garment.

The controller 300 may determine a target portion based on the selection of a portion of the whole image M of the garment displayed on the switchable mirror 35.

The controller 300 may control the spot cleaning device 100 to clean the target portion based on the determination of the target portion.

The receiving of the selection of a portion of the whole image of the garment displayed on the switchable mirror 35 may include receiving a touch input on the switchable mirror 35 as described above in connection with FIGS. 23, 19 and 20.

In various embodiments, as in the embodiment of FIG. 25, the whole image M of the garment displayed on the switchable mirror M may be partitioned into multiple sections by the visual indicator.

According to such embodiments of the disclosure, the user may set up a target portion more easily based on the image displayed on the switchable mirror 35.

Figure 33:
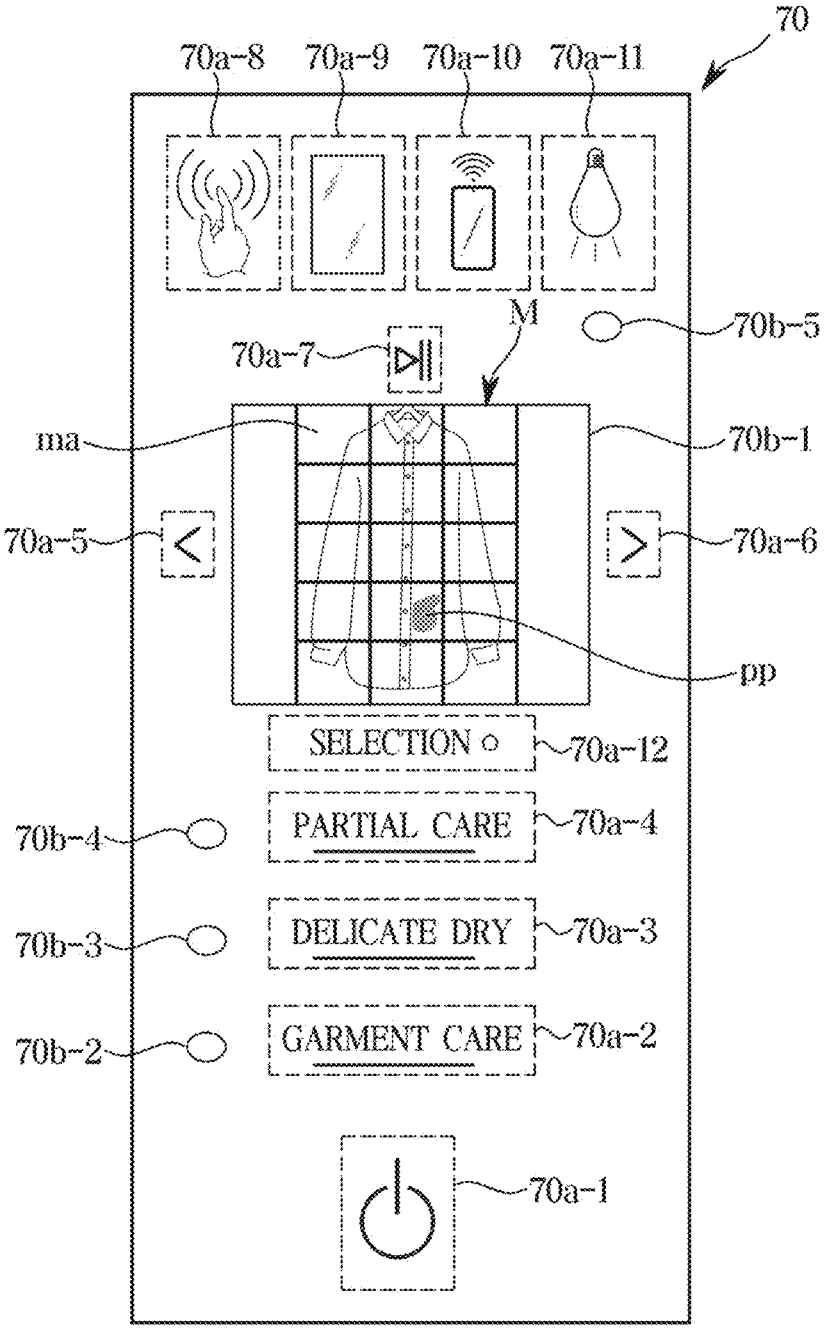
FIG. 33 illustrates an example in which a whole image of a garment is displayed on a control panel, according to an embodiment.

FIG. 33 illustrates an example in which a whole image of a garment is displayed on the control panel 70, according to an embodiment.

Referring to FIG. 33, in an embodiment, the first controller 300 may control the display 70*b*-1 on the control panel 70 to display the whole image of the garment based on reception of the user input to set up a target portion.

The whole image of the garment may be displayed on the display 70*b*-1 on the control panel 70.

The controller 300 may control the display 70*b*-1 to display a visual indicator pp to highlight the contaminated portion identified from the whole image M of the garment while displaying the whole image M of the garment.

In the disclosure, the user may easily set up the target portion by referring to the contaminated portion identified by the clothes care apparatus 1 from the whole image M of the garment.

The whole image M of the garment displayed on the display 70*b*-1 may be scaled up or down based on a user input to scale up or down the whole image M of the garment.

The user input to scale up or down the whole image M of the garment may include, for example, a pinch zoom touch input on the display 70*b*-1.

The controller 300 may control the display 70*b*-1 to scale up or down the whole image M of the garment based on reception of the user input to scale up or down the whole image M of the garment.

In the disclosure, the user may easily locate a contaminated portion of the garment while scaling up or down the whole image M of the garment.

The controller 300 may determine a target portion based on the selection of a portion from among the whole image M of the garment displayed on the display 70*b*-1.

The controller 300 may control the spot cleaning device 100 to clean the target portion based on the determination of the target portion.

The receiving of the selection of the portion from among the whole image M of the garment displayed on the display 70*b*-1 may include receiving a touch input on the display 70*b*-1 and/or using the direction selection button 70*a*-5 or 70*a*-6 and the selection button 70*a*-12 on the control panel 70.

In various embodiments, as in the embodiment of FIG. 27, the whole image M of the garment displayed on the display 70*b*-1 may be partitioned into multiple sections by the visual indicator.

Figure 34:
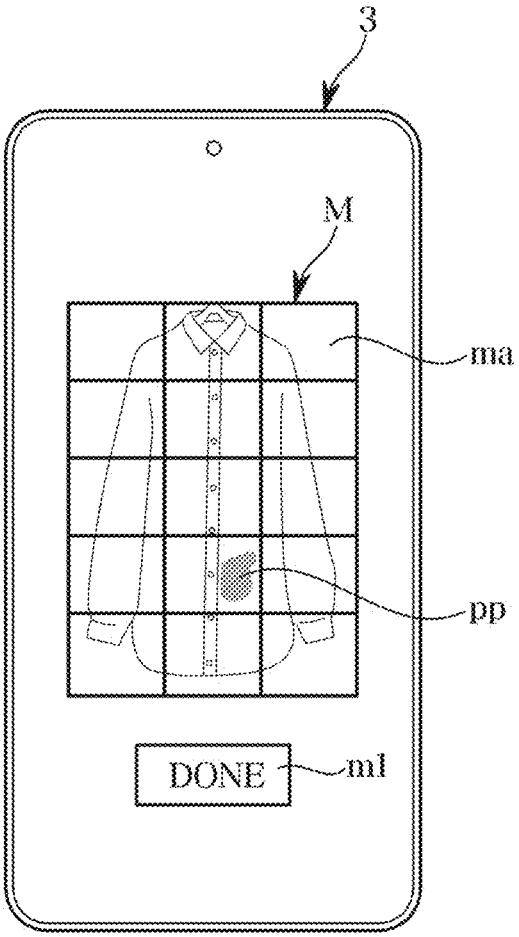
FIG. 34 illustrates a whole image of a garment obtained by a clothes care apparatus and transmitted to a user equipment, according to an embodiment.

FIG. 34 illustrates a whole image of a garment obtained by the clothes care apparatus 1 and transmitted to a user equipment, according to an embodiment.

Referring to FIG. 34, the first controller 300 may transmit the whole image M of the garment to an external device (e.g., the user equipment 3) through the communicator 330.

For example, the first controller 300 may transmit the whole image M of the garment to the external device in response to reception of a command for target settings from the external device through the communicator 330.

In another example, the first controller 300 may transmit the whole image M of the garment to the external device (e.g., user equipment) based on creation of the whole image M of the garment.

The user equipment may store an application for managing a home appliance.

The user may run the application for managing the home appliance through the user equipment 3, make access to an account of the user and transmit various control commands to the home appliance associated with the account or receive various information from the home appliance associated with the account.

When the clothes care apparatus 1 is associated with the account of the user, the user may transmit a command to control the clothes care apparatus 1 through the user equipment 3.

When the clothes care apparatus 1 is associated with the account of the user, the clothes care apparatus 1 may transmit the whole image M of the garment to the user equipment 3.

The user equipment 3 may display the whole image M of the garment received from the clothes care apparatus 1 according to the user's manipulation.

The user equipment 3 may display the visual indicator pp to highlight the contaminated portion identified from the whole image M of the garment while displaying the whole image M of the garment.

The whole image M of the garment displayed by the user equipment 3 may be partitioned into multiple sections by the visual indicator.

A method of receiving the selection of a portion from among the whole image M of the garment displayed on the user equipment 3 may include receiving a touch input to the user equipment 3.

The user may select a confirm button m1 after finishing the selection of a portion from among the whole image M of the garment by manipulating the user equipment 3.

The user equipment 3 may transmit a spot cleaning command to the clothes care apparatus 1 based on reception of the selection of the portion from among the whole image M of the garment and selection of the confirm button m1.

The spot cleaning command may include a command to select a portion from the whole image M of the garment.

The controller 300 may determine a region corresponding to the portion selected by the user equipment 3 from the whole image M of the garment as a target portion.

The controller 300 may control the spot cleaning device 100 to clean the target portion based on the determination of the target portion.

In the disclosure, the user may set up the target portion even remotely.

In the disclosure, the target portion may be set up through various methods and means.

Figure 35:
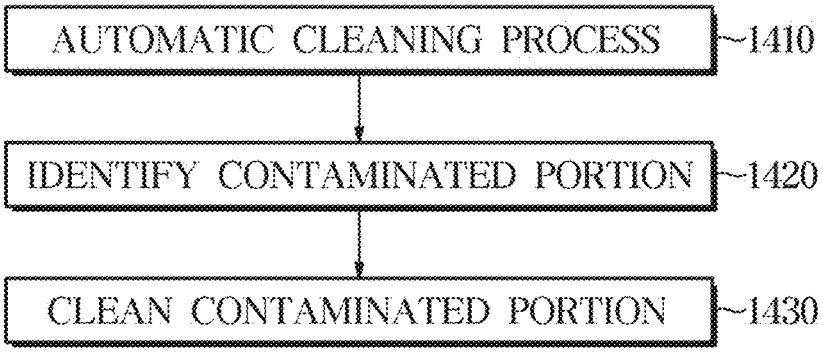
FIG. 35 is a flowchart for describing a method in which a clothes care apparatus automatically sets up a target portion, according to an embodiment.

FIG. 35 is a flowchart for describing a method in which the clothes care apparatus 1 automatically sets up a target portion, according to an embodiment.

Referring to FIG. 35, the clothes care apparatus 1 may automatically set up a target portion.

The controller 300 may receive a user input to start an automatic washing process (1410 in FIG. 35). The user input to start the automatic washing process may be sent to the first controller 300 in various methods.

For example, when the partial care button 70*a*-4 is selected, an interface for selecting an automatic washing mode may be provided on the display 70*b*-1, and the first controller 300 may perform the automatic washing process based on selection of the start button 70*a*-7 during the automatic washing mode selected.

In another example, based on selection of the automatic wash button 36*k* of the user interface 36 provided by the switchable mirror 35, the first controller 300 may perform the automatic washing process.

The automatic washing process may refer to a process of automatically identifying the contaminated portion of the garment accommodated in the second chamber 22 based on sensor data collected from the at least one sensor 108 of the spot cleaning device 100, and cleaning the contaminated portion by the spot cleaning device 100.

In various embodiments, the first controller 300 may control the spot cleaning device 100 to move along a certain path in the second chamber 22 based on the start of the automatic washing process.

In an embodiment, the first controller 300 may identify the contaminated portion of the garment accommodated in the second chamber 22 based on the sensor data collected from the sensor 108 while the spot cleaning device 100 is moving (1420 in FIG. 35).

The controller 300 may identify the contaminated portion of the garment based on the sensor data collected from the sensor 108. In an embodiment, the memory 320 may store an algorithm for identifying a contaminated portion based on the sensor data. For example, the first controller 300 may identify a contaminated portion by inputting the sensor data to a machine learning model.

When the sensor 108 is a camera, the first controller 300 may identify a contaminated portion of the garment based on image data. When the sensor 108 is a photo sensor, the first controller 300 may identify a contaminated portion of the garment based on light intensity data.

In various embodiments, when the second controller 180 of the spot cleaning device 100 is able to identify the contaminated portion of the garment based on the sensor data collected from the sensor 108, the aforementioned operation and the following operation may be performed by the second controller 180.

In an embodiment, the first controller 300 may control the spot cleaning device 100 to clean the contaminated portion (1430 in FIG. 35).

In various embodiments, the first controller 300 may control the spot cleaning device 100 to clean the contaminated portion in response to the contaminated portion being identified while the spot cleaning device 100 is moving along the certain path in the second chamber 22.

In an embodiment, the spot cleaning device 100 may clean the contaminated portion in real time while moving along the second chamber 22.

In various embodiments, the first controller 300 may control the spot cleaning device 100 to store coordinate data of the contaminated portion while moving along the certain path in the second chamber 22 and clean the contaminated portion in response to the spot cleaning device 100 being done with garment scanning.

In an embodiment, as the contaminated portion of the garment accommodated in the second chamber 22 is correctly identified and then cleaned, the time required to finish the automatic washing process may be relatively precisely calculated.

According to an embodiment of the disclosure, a clothes care apparatus 1 may include a cabinet 10, where a first chamber 11 is defined in the cabinet 10; a first door 20 configured to open or close the first chamber 11, where a second chamber 22 separated from the first chamber 11 and arranged to accommodate a garment is defined in the first door; a second door 30 pivotally coupled to the first door 20 and configured to open or close the second chamber 22; a switchable mirror 35 arranged on the second door 30 and operable in a mirror mode or a transparent mode; a spot cleaning device 100 arranged in the second chamber 22, where the spot cleaning device 100 partially cleans the garment accommodated in the second chamber 22 and is movable in the second chamber 22; and a controller 300 or 140 configured to control the switchable mirror 35 and the spot cleaning device 100.

The controller 300 or 140 may operate the switchable mirror 35 in the transparent mode based on receiving (or in response to) a user input for switching the switchable mirror 35 into the transparent mode, determine a target portion based on a touch input on the switchable mirror 35, and control the spot cleaning device 100 to move to face the target portion.

The controller 300 or 140 may control the switchable mirror 35 to display a visual indicator g1 to partition the switchable mirror 35 into multiple sections a1 based on receiving a user input for setting up the target portion.

The controller 300 or 140 may determine at least one of the multiple sections a1, in which the touch input is received, as the target portion.

The clothes care apparatus 1 may further include a control panel 70 for receiving a selection of at least one of multiple sections a2 or a3 partitioned from one another, and the controller 300 or 140 may determine at least one of the multiple sections a2 or a3 selected through the control panel 70 as a target portion and control the spot cleaning device 100 to move to the target portion.

The controller 300 or 140 may control the switchable mirror 35 to provide a user interface 36 associated with the spot cleaning device 100 only when a garment is detected in the second chamber 22.

The user interface 36 associated with the spot cleaning device 100 may include at least one of a visual indicator to indicate status information of the spot cleaning device 100 or a user interface element to control the spot cleaning device 100.

The spot cleaning device 100 may further include a camera 108 having a field of view toward a garment accommodated in the second chamber 22, and the controller 140 may control the spot cleaning device 100 to move along the second chamber 22 to obtain a whole image M of the garment accommodated in the second chamber 22 based on a preset condition being satisfied.

The preset condition may include at least one of opening and closing of the second door 30 being detected, a new garment being detected based on an image obtained by the camera 108, garment replacement being detected based on the image obtained by the camera 108 or a garment scan command being received.

The controller 300 or 140 may control the switchable mirror 35 to display the whole image of the garment based on receiving a user input for setting up a target portion, determine the target portion based on a selection of a portion of the whole image M of the garment, and control the spot cleaning device 100 to move to the target portion.

The controller 300 or 140 may identify a contaminated portion of the garment from the whole image M of the garment, and control the switchable mirror 35 to display a visual indicator to highlight the identified contaminated portion while displaying the whole image M of the garment.

The controller 300 or 140 may control the switchable mirror 35 to scale up or down the whole image M of the garment based on receiving a user input to scale up or down the whole image M of the garment.

The clothes care apparatus 1 may further include a communicator configured to transmit the whole image M of the garment to an external device, and the controller 300 or 140 may determine, based on receiving a command to select a portion from the whole image M of the garment from the external device through the communicator, a region corresponding to the portion selected from the whole image M of the garment as a target portion and control the spot cleaning device 100 to move to the target portion.

The spot cleaning device 100 may further include a sensor 108 for detecting a contaminated portion of the garment accommodated in the second chamber 22, and the controller 300 or 140 may identify a contaminated portion of the garment received in the second chamber 22 based on sensor data collected by the sensor and control the spot cleaning device 100 to clean the contaminated portion.

According to an embodiment of the disclosure, a method of controlling a clothes care apparatus 1 including a cabinet 10, where a first chamber 11 is defined in the cabinet 10; a first door 20 configured to open or close the first chamber 11, where a second chamber 22 separated from the first chamber 11 and configured to accommodate a garment is defined in the first door 20; a second door 30 pivotally coupled to the first door 20 and configured to open or close the second chamber 22; a switchable mirror 35 arranged on the second door 30 and operable in a mirror mode or a transparent mode; and a spot cleaning device 100 arranged in the second chamber 22, where the spot cleaning device 100 partially cleans the garment received in the second chamber 22 and is movable in the second chamber 22, may include controlling the switchable mirror 35 and the spot cleaning device 100.

The controlling of the switchable mirror 35 and the spot cleaning device 100 may include operating the switchable mirror 35 in the transparent mode based on receiving a user input to switch the switchable mirror 35 into the transparent mode; determining a target portion based on a touch input on the switchable mirror 35; and controlling the spot cleaning device 100 to move to face the target portion.

The controlling of the switchable mirror 35 may include controlling the switchable mirror 35 to display a visual indicator g1 to partition the switchable mirror 35 into multiple sections a1 based on receiving a user input for setting up the target portion.

The determining of the target portion may include determining at least one of the multiple sections a1, on which the touch input is received, as the target portion.

The method of controlling the clothes care apparatus 1 may further include controlling the spot cleaning device 100 to move along the second chamber 22 to obtain a whole image M of the garment accommodated in the second chamber 22 based on a preset condition being satisfied.

The method of controlling the clothes care apparatus 1 may further include identifying a contaminated portion from the whole image M of the garment, and the controlling of the spot cleaning device 100 may include controlling the spot cleaning device 100 to clean the contaminated portion.

The embodiments of the disclosure set forth herein may be implemented in the form of a recording medium for storing instructions to be carried out by a computer. The instructions may be stored in the form of program codes, and when executed by a processor, may generate program modules to perform operations in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In the disclosure, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A clothes care apparatus comprising:

a cabinet, wherein a first chamber is defined in the cabinet;

a first door configured to open or close the first chamber, wherein a second chamber separated from the first chamber and configured to accommodate a garment is defined in the first door;

a second door pivotally coupled to the first door and configured to open or close the second chamber;

a switchable mirror arranged on the second door and operable in a mirror mode or a transparent mode;

a spot cleaning device arranged in the second chamber to partially clean the garment accommodated in the second chamber, and movable in the second chamber; and a controller configured to control the switchable mirror and the spot cleaning device.

2. The clothes care apparatus of claim 1, wherein the controller is configured to operate the switchable mirror in the transparent mode in response to a user input for switching the switchable mirror into the transparent mode, determine a target portion based on a touch input on the switchable mirror, and control the spot cleaning device to move to the target portion.

3. The clothes care apparatus of claim 2, wherein the controller is configured to control the switchable mirror to display a visual indicator partitioning the switchable mirror into multiple sections, in response to a user input for setting up the target portion.

4. The clothes care apparatus of claim 3, wherein the controller is configured to determine at least one section which receives the touch input as the target portion among the multiple sections.

5. The clothes care apparatus of claim 1, further comprising: a control panel configured to receive a selection of at least one of multiple sections partitioned from one another, wherein the controller is configured to determine at least one section selected through the control panel from among the multiple sections as a target portion, and control the spot cleaning device to move to the target portion.

6. The clothes care apparatus of claim 1, wherein the controller is configured to control the switchable mirror to display a user interface associated with the spot cleaning device only when a garment is detected in the second chamber.

7. The clothes care apparatus of claim 6, wherein the user interface associated with the spot cleaning device comprises at least one of a visual indicator indicating status information of the spot cleaning device or a user interface element for controlling the spot cleaning device.

8. The clothes care apparatus of claim 1, wherein:

the spot cleaning device further comprises a camera having a field of view toward the garment accommodated in the second chamber, and the controller is configured to control the spot cleaning device to move along the second chamber to obtain a whole image of the garment accommodated in the second chamber, based on a preset condition being satisfied.

9. The clothes care apparatus of claim 8, wherein the preset condition comprises at least one of opening and closing of the second door being detected, a new garment being detected based on an image obtained by the camera, garment replacement being detected based on the image obtained by the camera or a garment scan command being received.

10. The clothes care apparatus of claim 8, wherein the controller is configured to control the switchable mirror to display the whole image of the garment in response to a user input for setting up a target portion, determine the target portion based on a selection of a portion of the whole image of the garment, and control the spot cleaning device to move to the target portion.

11. The clothes care apparatus of claim 10, wherein the controller is configured to identify a contaminated portion of the garment from the whole image of the garment, and control the switchable mirror to display a visual indicator to highlight the identified contaminated portion while displaying the whole image of the garment.

12. The clothes care apparatus of claim 10, wherein the controller is configured to control the switchable mirror to scale up or down the whole image of the garment in response to a user input to scale up or down the whole image of the garment.

13. The clothes care apparatus of claim 8, further comprising: a communicator configured to transmit the whole image of the garment to an external device, wherein the controller is configured to, in response to a command to select a portion from the whole image of the garment from the external device through the communicator, determine a region corresponding to the portion selected from the whole image of the garment as a target portion and control the spot cleaning device to move to the target portion.

14. The clothes care apparatus of claim 1, wherein:

the spot cleaning device further comprises a sensor configured to detect a contaminated portion of the garment in the second chamber, and the controller is configured to identify the contaminated portion of the garment accommodated in the second chamber based on sensor data collected by the sensor and to control the spot cleaning device to clean the contaminated portion.

15. A method of controlling a clothes care apparatus including a cabinet, wherein a first chamber is defined in the cabinet; a first door configured to open or close the first chamber, wherein a second chamber separated from the first chamber and configured to accommodate a garment is defined in the first door; a second door pivotally coupled to the first door and configured to open or close the second chamber; a switchable mirror arranged on the second door and operable in a mirror mode or a transparent mode; and a spot cleaning device arranged in the second chamber to partially clean the garment received in the second chamber and movable in the second chamber, the method comprising:

controlling the switchable mirror and the spot cleaning device.

16. The method of claim 15, further comprising:

when the switchable mirror in the mirror mode is change into the transparent mode, determining whether the garment is detected in the second chamber; and providing a user interface associated with the spot cleaning device when it is determined that the garment is detected in the second chamber.

17. The method of claim 16, further comprising:

receiving a user input for setting up a target portion of the garment in the second chamber on the switchable mirror in the transparent mode;

receiving a touch input on the switchable mirror in the transparent mode; and determining the target portion based on the touch input, wherein the controlling the switching mirror and the spot cleaning device comprises controlling the spot cleaning device in a way such that the target portion is cleaned.

18. The method of claim 15, further comprising:

receiving a user input for setting up a target portion of the garment in the second chamber;

receiving a region selection input through an input interface arranged on a control panel of the clothes care apparatus; and determining a region selected by the region selection input as the target portion, wherein the controlling the switching mirror and the spot cleaning device comprises controlling the spot cleaning device in a way such that the target portion is cleaned.

19. The method of claim 15, wherein the controlling the switching mirror and the spot cleaning device comprises:

scanning the garment in the second chamber by using the spot cleaning device, wherein the spot cleaning device includes a camera;

generating a whole image of the garment;

receiving a command to select a portion of the whole image of the garment; and controlling the spot cleaning device in a way such that a portion of the garment corresponding to the selected portion of the whole image thereof is cleaned.

20. The method of claim 15, further comprising:

receiving a user input to start an automatic washing process, wherein the controlling the switching mirror and the spot cleaning device comprises:

controlling the spot cleaning device to move along a certain path in the second chamber in response to the user input, wherein the spot cleaning device includes a sensor configured to detect a contaminated portion of a garment accommodated in the second chamber;

identifying the contaminated portion of the garment in the second chamber based on sensor data collected from the sensor while the spot cleaning device is moving; and controlling the spot cleaning device in a way such that the contaminated portion of the garment is cleaned.

* * * * *